US012369639B2

(12) United States Patent
Austin et al.

(10) Patent No.: US 12,369,639 B2
(45) Date of Patent: Jul. 29, 2025

(54) AEROSOL DELIVERY DEVICE

(71) Applicant: Imperial Tobacco Limited, Bristol (GB)

(72) Inventors: Andrew Austin, Liverpool (GB); Tamas Sajtos, Liverpool (GB); Pete Lomas, Liverpool (GB); Chris Lord, Liverpool (GB); Ross Shenton, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 731 days.

(21) Appl. No.: 17/533,526

(22) Filed: Nov. 23, 2021

(65) Prior Publication Data

US 2022/0142257 A1 May 12, 2022

Related U.S. Application Data

(63) Continuation of application No. PCT/EP2020/067259, filed on Jun. 19, 2020, and a
(Continued)

(30) Foreign Application Priority Data

Jun. 21, 2019 (EP) ..... 19181679
Jun. 21, 2019 (EP) ..... 19181683
(Continued)

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/30* (2020.01); *A24F 40/42* (2020.01); *A24F 40/44* (2020.01)

(58) Field of Classification Search
None
See application file for complete search history.

(56) References Cited

U.S. PATENT DOCUMENTS 439,707 A 11/1890 Warren et al.
3,927,806 A 12/1975 Meshberg
(Continued)

FOREIGN PATENT DOCUMENTS

CN 206949545 U 2/2018
CN 206978764 U 2/2018
(Continued)

OTHER PUBLICATIONS

European Patent Office, Examination Report, dated Apr. 30, 2024, regarding European Patent Application No. 20734007.6-1122, 8 pages.
(Continued)

*Primary Examiner* — Linda L Gray
(74) *Attorney, Agent, or Firm* — DUNLAP CODDING. P.C.

(57) ABSTRACT

An aerosol delivery device comprises: a storage for storing aerosol precursor liquid, the storage comprising an air bleed channel for permitting air to enter the storage as the storage empties of aerosol precursor in use; and a liquid transfer element for transferring aerosol precursor liquid from the storage to an aerosol generator, wherein the air bleed channel and the liquid transfer element are configured such that aerosol precursor liquid from the liquid transfer element forms an obstruction in the air bleed channel in use to reduce flow through the air bleed channel, the aerosol delivery device further configured such that the obstruction is removed to open the air bleed channel in response to a user drawing on the aerosol delivery device.

11 Claims, 31 Drawing Sheets

Related U.S. Application Data continuation of application No. PCT/EP2020/067256, filed on Jun. 19, 2020, said application No. PCT/EP2020/067259 is a continuation of application No. PCT/EP2020/067257, filed on Jun. 19, 2020.

(30) Foreign Application Priority Data

| | | |
|---|---|---|
| Jun. 21, 2019 | (EP) | 19181686 |
| Jun. 21, 2019 | (EP) | 19181690 |
| Jun. 21, 2019 | (EP) | 19181694 |

(51) Int. Cl.

| | |
|---|---|
| ***A24F 40/30*** | (2020.01) |
| ***A24F 40/42*** | (2020.01) |
| ***A24F 40/44*** | (2020.01) |

(56) References Cited

U.S. PATENT DOCUMENTS

| | | | |
|---|---|---|---|
| 9,386,805 | B2 | 7/2016 | Liu |
| 9,642,397 | B2 | 5/2017 | Dai et al. |
| 9,901,120 | B2 | 2/2018 | Liu |
| 10,034,495 | B2 | 7/2018 | Alarcon et al. |
| 2005/0211241 | A1 | 9/2005 | Anderson et al. |
| 2010/0282779 | A1 | 11/2010 | Ramsey et al. |
| 2011/0226236 | A1 | 9/2011 | Buchberger |
| 2012/0111346 | A1 | 5/2012 | Rinker et al. |
| 2012/0118301 | A1 | 5/2012 | Montaser |
| 2014/0224248 | A1 | 8/2014 | Edwards et al. |
| 2015/0272216 | A1 | 10/2015 | Dai et al. |
| 2016/0345630 | A1 | 12/2016 | Mironov et al. |
| 2016/0366944 | A1 | 12/2016 | Larson |
| 2017/0281883 | A1 | 10/2017 | Li et al. |
| 2017/0367407 | A1 | 12/2017 | Althorpe et al. |
| 2018/0077967 | A1 | 3/2018 | Hatton et al. |
| 2018/0220707 | A1 | 8/2018 | Biel et al. |
| 2018/0297047 | A1 | 10/2018 | Tong |

FOREIGN PATENT DOCUMENTS

| | | | |
|---|---|---|---|
| CN | 207011690 | U | 2/2018 |
| CN | 208318234 | U | 1/2019 |
| EP | 1386630 | B1 | 5/2006 |
| EP | 3113637 | | 1/2017 |
| EP | 3113637 | A1 | 1/2017 |
| EP | 3254574 | B1 | 3/2019 |
| EP | 3158883 | B1 | 4/2019 |
| EP | 3305109 | B1 | 12/2021 |
| GB | 2419292 | A | 4/2006 |
| GB | 2529201 | | 2/2016 |
| GB | 2529201 | A | 2/2016 |
| GB | 2566766 | A | 3/2019 |
| GB | 2566774 | | 3/2019 |
| GB | 2566774 | A | 3/2019 |
| GB | 2561867 | B | 4/2021 |
| WO | WO 01/03851 | A1 | 1/2001 |
| WO | WO 2006/115732 | A2 | 11/2006 |
| WO | WO2011/050943 | A1 | 5/2011 |
| WO | WO2014/012907 | A1 | 1/2014 |
| WO | WO 2014/046993 | A1 | 3/2014 |
| WO | WO2016/050244 | A1 | 4/2016 |
| WO | WO2016/079155 | | 5/2016 |
| WO | WO 2016/079155 | A1 | 5/2016 |
| WO | WO2016/124741 | A1 | 8/2016 |
| WO | WO2017/108268 | | 6/2017 |
| WO | WO 2017/108268 | A1 | 6/2017 |
| WO | WO2017/167513 | | 10/2017 |
| WO | WO 2017/167513 | A1 | 10/2017 |
| WO | WO2017/185051 | A1 | 10/2017 |
| WO | WO 2018/001095 | A1 | 1/2018 |
| WO | WO2018/037206 | | 3/2018 |
| WO | WO 2018/037206 | A1 | 3/2018 |
| WO | WO 2018/114261 | A1 | 6/2018 |
| WO | WO2020/075139 | A1 | 4/2020 |

OTHER PUBLICATIONS

European Patent Office; Extended European Search Report regarding European Patent Application No. 23164457.6 filed Jun. 19, 2020; dated Jul. 5, 2023.

European Patent Office acting as the International Search Authority; International Search Report and Written Opinion regarding PCT/EP2020/067256; Sep. 22, 2020, 11 pages.

European Patent Office acting as the International Search Authority; International Search Report and Written Opinion regarding PCT/EP2020/067257; Sep. 23, 2020; 11 pages.

European Patent Office acting as the International Search Authority; International Search Report and Written Opinion regarding PCT/EP2020/067259; Aug. 17, 2020; 12 pages.

European Search Report (19181679.2-1122), dated Sep. 26, 2019.

European Search Report (19181683.4-1006), dated Dec. 18, 2019.

European Search Report (19181686.7-1122), dated Oct. 1, 2019.

European Search Report (19181690.9-1122), dated Dec. 5, 2019.

European Search Report (19181694.1-1122), dated Dec. 13, 2019.

AEROSOL DELIVERY DEVICE

CROSS-REFERENCE TO RELATED APPLICATIONS

This application is a non-provisional application claiming benefit to the international application no. PCT/EP2020/067259, filed on Jun. 19, 2020, which claims priority to EP 19181679.2, filed on Jun. 21, 2019. This application also claims benefit to the international application no. PCT/EP2020/067256, filed on Jun. 19, 2020, which claims priority to EP 19181683.4, filed on Jun. 21, 2019; EP 19181686.7, filed on Jun. 21, 2019; and EP 19181694.1, filed on Jun. 21, 2019. This application also claims benefit to the international application no. PCT/EP2020/067257, filed on Jun. 19, 2020, which claims priority to EP 19181690.9, filed on Jun. 21, 2019. The entire contents of each of the above-referenced applications are hereby incorporated herein by reference in their entirety.

FIELD OF THE DISCLOSURE

In one aspect, the present disclosure relates to an aerosol delivery device and system and particularly, although not exclusively, to an aerosol delivery device and system which aims to reduce leakage.

In another aspect, the present disclosure also relates to an aerosol delivery device and system and particularly, although not exclusively, to an aerosol delivery device and system which can be assembled more reliably.

In another aspect, the present disclosure also relates to an aerosol delivery device and system and particularly, although not exclusively, to an aerosol delivery device and system configured to reduce leakage.

BACKGROUND

One form of an aerosol delivery system (or device) is a smoking-substitute system that permits the user to simulate the act of smoking by producing an aerosol or vapor that is drawn into the lungs through the mouth and then exhaled. The inhaled aerosol or vapor typically bears nicotine and/or other flavorings without the odor and health risks associated with traditional smoking and tobacco products. In use, the user experiences a similar satisfaction and physical sensation to those experienced from a traditional smoking or tobacco product, and exhales an aerosol or vapor of similar appearance to the smoke exhaled when using such traditional smoking or tobacco products.

One approach for a smoking substitute system is the so-called "vaping" approach, in which a vaporizable liquid, typically referred to (and referred to herein) as "e-liquid", is heated by a heating element to produce an aerosol/vapor which is inhaled by a user. The e-liquid typically includes a base liquid as well as nicotine and/or flavorings. The resulting vapor therefore also typically contains nicotine and/or flavorings. The base liquid may include propylene glycol and/or vegetable glycerin.

A typical vaping smoking substitute system includes a mouthpiece, a power source (typically a battery), a tank for containing e-liquid, as well as a heating element. In use, electrical energy is supplied from the power source to the heating element, which heats the e-liquid to produce an aerosol (or "vapor") which is inhaled by a user through the mouthpiece.

Vaping smoking substitute systems can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a base unit which includes the power source, wherein the base unit is configured to be physically and electrically coupled to a consumable including the tank and the heating element. The consumable may also be referred to as a cartomizer. In this way, when the tank of a consumable has been emptied, the consumable is disposed of. The base unit can be reused by connecting it to a new, replacement, consumable. Another subset of closed system vaping smoking substitute systems are completely disposable, and intended for one-use only.

An example vaping smoking substitute system is the Myblu® (RTM) e-cigarette. The Myblu® (RTM) e-cigarette is a closed system which includes a base unit and a consumable. The base unit and consumable are physically and electrically coupled together by pushing the consumable into the base unit. The base unit includes a rechargeable battery. The consumable includes a mouthpiece, a sealed tank which contains e-liquid, as well as a heating element, which for this system is a heating filament coiled around a portion of a wick. The wick is partially immersed in the e-liquid, and conveys e-liquid from the tank to the heating filament. The system is activated when a microprocessor on board the base unit detects a user inhaling through the mouthpiece. When the system is activated, electrical energy is supplied from the power source to the heating element, which heats e-liquid from the tank to produce a vapor which is inhaled by a user through the mouthpiece.

For a smoking-substitute system (or device), it is desirable to deliver nicotine into the user's lungs, where it can be absorbed into the bloodstream. As explained above, in the vaping approach, e-liquid is heated by a heating device to produce an aerosol/vapor which is inhaled by a user. Many e-cigarettes also deliver flavor to the user, to enhance the experience. Flavor compounds are contained in the e-liquid that is heated. Heating of the flavor compounds may be undesirable as the flavor compounds are inhaled into the user's lungs. Toxicology restrictions are placed on the amount of flavor that can be contained in the e-liquid. This can result in some e-liquid flavors delivering a weak and underwhelming taste sensation to consumers in the pursuit of safety.

In some aerosol delivery systems (or devices), it is desirable to avoid leakage of aerosol precursor. The first mode of the present disclosure has been devised in light of the above considerations.

In some aerosol delivery systems (or devices), it is desirable to be able to assemble component parts of the system in an easy and reliable manner. In some smoking-substitute systems, liquid used to form an aerosol can leak from the system and/or can collect in or on parts of the device. When such liquid collects in parts of the system that are within an airflow path of the system, such liquid can be entrained in an airflow in the airflow path. It may also be desirable to increase the degree of sanitation relating to the system. The second mode of the present disclosure has been devised in light of the above considerations.

In some aerosol delivery systems (or devices), it is desirable to avoid leakage of e-liquid as such leakage can result in inconvenience for the user. Leakage of e-liquid has been observed during use of the known systems and it is believed that the leakage occurs as a result of condensation of the e-liquid vapor on internal surfaces of the system. The condensed e-liquid then leaks from the system either through the mouthpiece or through air inlets provided in the device. The third mode of the present disclosure has been devised in light of the above considerations.

SUMMARY OF THE DISCLOSURE

First Mode: An Aerosol Delivery Device in which Aerosol Precursor from a Liquid Transfer Element Forms an Obstruction in an Air Bleed Channel to Reduce Flow Through the Air Bleed Channel.

Generally, a first mode of the present disclosure relates to an aerosol delivery device in which aerosol precursor from a liquid transfer element forms an obstruction in an air bleed channel to reduce flow through the air bleed channel.

According to the first mode, there is provided aerosol delivery device comprising: a storage for storing aerosol precursor liquid, the storage comprising an air bleed channel for permitting air to enter the storage as the storage empties of aerosol precursor in use; and a liquid transfer element for transferring aerosol precursor liquid from the storage to an aerosol generator, wherein the air bleed channel and the liquid transfer element are configured such that aerosol precursor liquid from the liquid transfer element forms an obstruction in the air bleed channel in use to reduce flow through the air bleed channel, the aerosol delivery device further configured such that the obstruction is removed to open the air bleed channel in response to a user drawing on the aerosol delivery device.

The air bleed channel and the liquid transfer element may be positioned such that a meniscus forms between them in use, the meniscus providing the obstruction. When the user draws on the aerosol delivery device, the aerosol generator forms an aerosol from aerosol precursor liquid, which causes the amount of aerosol precursor liquid in the liquid transfer element to reduce. The liquid transfer element then absorbs further aerosol precursor liquid from the storage, which causes the obstruction to be pulled from the air bleed channel and into the storage. This temporarily opens the air bleed channel and permits air to enter the storage to reduce the pressure difference between the storage and the external environment. Once the liquid transfer element reaches a certain level of saturation with liquid, the obstruction forms again, closing the air bleed channel.

The air bleed channel being closed prevents further liquid being transferred through the liquid transfer element until the user draws on the device again, reducing leakage. Additionally, the obstruction may prevent leakage of liquid through the air bleed channel.

Optional features will now be set out. These are applicable singly or in any combination with any aspect of the first mode.

The aerosol delivery device may further comprise an aerosol generator, the aerosol generator comprising an aerosol generator portion configured to receive the aerosol precursor from the storage, the aerosol delivery device further comprising an air flow passage configured to direct air past the aerosol generator portion to pick up the aerosol precursor from the aerosol generator portion to form an aerosol.

The aerosol delivery device may further comprise a member, the member comprising the liquid transfer element and the aerosol generator portion. An external opening of the air bleed channel may have a diameter of less than 1 mm. The external opening may have a diameter of substantially 0.5 mm.

The external opening of the air bleed channel may be located adjacent to the liquid transfer element. The liquid transfer element may define a side of the air bleed channel.

The air bleed channel may follow a tortuous path. The tortuous path may be implemented by the air bleed channel following a non-linear path, for example by turning away from the liquid transfer element.

The aerosol delivery device may further comprise a sealing element for inhibiting flow through the air bleed channel when in a deactivated state, wherein the sealing element is openable into an activated state to permit air flow through the air bleed channel when the obstruction is removed from the air bleed channel. The sealing element may comprise a bung received in the air bleed channel in the deactivated state, the bung movable into the activated state.

The bung may comprise an enlarged portion and a neck portion, wherein the enlarged portion extends fully across the air bleed channel to block the air bleed channel in the deactivated state, and the enlarged portion moves out of the air bleed channel and the neck portion moves into the air bleed channel when the bung is moved from the deactivated to the activated state, the neck portion extending partially across the air bleed channel.

The aerosol delivery device may further comprise a barrier arrangement for inhibiting flow of aerosol precursor from the storage to the liquid transfer element, wherein the barrier arrangement is openable so that the liquid transfer element can receive aerosol precursor from the storage.

The liquid transfer element may be movable to contact the barrier arrangement to open the barrier arrangement.

The aerosol delivery device may be a consumable for a vaping device.

The aerosol delivery device may further comprise an additional aerosol generator, the additional aerosol generator configured to produce an additional aerosol from an additional aerosol precursor.

The additional aerosol generator may be configured to heat the additional aerosol precursor to form the additional aerosol.

The liquid transfer element may be configured to transfer aerosol precursor to a heated vaporizer.

The aerosol delivery device may comprise a vapor flow passage for fluid flow therethrough. The vapor flow passage may extend in a longitudinal direction between (and may fluidly connect) an inlet of the aerosol delivery device to an outlet aperture of the aerosol delivery device. The inlet may define an upstream end of the vapor flow passage, whilst the outlet aperture may define a downstream end of the vapor flow passage. The outlet aperture may be at a mouthpiece of the device and may therefore hereinafter be described as a mouthpiece aperture. In this respect, a user may draw fluid (e.g., air) into and through the vapor flow passage of the aerosol delivery device by inhaling at the mouthpiece aperture.

The terms "upstream" and "downstream" are used with reference to the direction of airflow (from inlet to outlet) through the device during normal use of the device (i.e., by way of inhalation at the mouthpiece aperture). The vapor flow passage may comprise a plurality of passage branches that each define a separate airflow path through the aerosol delivery device. For example, in one embodiment of the first mode, the aerosol delivery device may comprise first and second passage branches that are spaced laterally so as to extend along opposite lateral sides of the aerosol delivery device. The first and second passage branches may branch (e.g., in a transverse/radial direction) proximate to the vapor passage inlet, and may merge (i.e., re-join) proximate to the mouthpiece aperture.

In other embodiments of the first mode, at least a portion of the vapor flow passage may comprise an annular transverse-cross sectional shape.

The aerosol delivery device may comprise a tank defining a storage chamber for containing a first aerosol precursor (e.g., a flavor liquid). The first aerosol precursor may, for example, comprise a flavorant having a menthol, licorice, chocolate, fruit flavor (including, e.g., citrus, cherry etc.), vanilla, spice (e.g., ginger, cinnamon) and/or tobacco flavor.

The first aerosol precursor may be stored in the form of a free liquid. Alternatively, a porous body may be disposed within the storage chamber, which may contain the first aerosol precursor.

The tank may at least partially define the vapor flow passage. For example, where the vapor flow passage comprises first and second passage branches, the first and second passage branches may be defined between an outer surface of the tank and an inner surface of a housing of the aerosol delivery device (i.e., a space may be formed between the tank and the housing for flow of vapor therethrough). Similarly, where at least a portion of the vapor flow passage is annular, the annular portion of the vapor flow passage may be defined between the tank and the housing.

The aerosol delivery device may comprise an air bleed channel configured to allow the bleeding of air into the storage chamber to replace (first) aerosol precursor that is removed from the storage chamber. The air bleed channel may be in fluid communication with the vapor flow passage, such that (e.g., under certain conditions) air from the vapor flow passage can enter the storage chamber through the air bleed channel.

The aerosol delivery device may comprise an aerosol generator in the form of a porous liquid transfer element (i.e., formed of a porous material). As will be described further below, the liquid transfer element may be configured to generate an aerosol in the vapor flow passage. The liquid transfer element, however, may do this in such a way that does not use heat to form the aerosol, and therefore in some embodiments may be referred to as a "passive" aerosol generator.

The liquid transfer element may comprise a conveying portion and an aerosol generating portion. The conveying portion may be elongate and generally cylindrical, and may be at least partially enclosed within one or more internal walls of the aerosol delivery device. The one or more internal walls enclosing the conveying portion may form part of the tank defining the storage chamber. In this respect, the tank may at least partly surround (e.g., may fully surround) the conveying portion of the liquid transfer element. That is, the tank may define a conduit through which the conveying portion passes. Thus, the conveying portion may extend generally longitudinally (e.g., centrally) through a portion of the tank (i.e., through the conduit defined by the tank). The liquid transfer element may be supported in the aerosol delivery device by the mouthpiece. That is, the mouthpiece may comprise a holder for holding (and gripping) the liquid transfer element in position within the aerosol delivery device.

The aerosol generating portion of the liquid transfer element may be disposed at a downstream end of the conveying portion and may thus define a downstream longitudinal end of the liquid transfer element. The aerosol generating portion may be at least partly located in the vapor flow passage so as to be exposed to airflow within the vapor flow passage. In particular, the aerosol generating portion of the liquid transfer element may extend into an aerosolization chamber forming part of the vapor flow passage. The aerosolization chamber may be located proximate to (and in fluid communication with) the mouthpiece aperture of the device and may define a portion of the vapor flow passage at the first and second passage branches of the vapor flow passage merge. Airflow through the flow passage may pass across or through the aerosol generating portion of the liquid transfer element prior to being discharged through the mouthpiece aperture.

The aerosol generating portion may define an enlarged (e.g., radially enlarged) portion of the liquid transfer element. For example, the aerosol generating portion may be bulb-shaped or bullet-shaped, and may comprise a portion which is wider than the conveying portion. The aerosol generating portion may taper (inwardly) to a tip at a downstream end of the aerosol generating portion (i.e., proximate the outlet/mouthpiece aperture). The aerosol-generating portion may have a flattened downstream end surface.

The liquid transfer element may extend into the storage chamber so as to be in contact with (e.g., at least partially submerged in) the first aerosol precursor. In this way, the liquid transfer element may be configured to convey (e.g., via a wicking/capillary action) the first aerosol precursor from the storage chamber to the aerosolization chamber. As will be described further below, this may allow the first aerosol precursor to form an aerosol and be entrained in an airflow passing through aerosolization chamber (i.e., for subsequent receipt in a user's mouth).

The vapor flow passage may be constricted (i.e., narrowed) at the aerosolization chamber. For example, the presence of the aerosol generating portion in the vapor flow passage may create a constricted or narrowed portion of the vapor flow passage (because the aerosol generating portion extends partway across the vapor flow passage). In this respect, the narrowest portion of the vapor flow passage may be at aerosolization chamber (adjacent to the aerosol generating portion of the liquid transfer element). This constriction of the vapor flow passage increases the velocity of air/vapor passing through the aerosolization chamber. In this respect, the constriction may be referred to as a Venturi aperture. The constriction may have a toroidal shape (i.e., extending about the aerosol generating portion of the liquid transfer element). The toroidal shape may, however, be interrupted by supports (e.g., projections, ribs, etc.) protruding inwardly from wall(s) of the vapor flow passage to support the aerosol generating portion in the aerosolization chamber.

In addition to increasing the airflow velocity, the constriction reduces the air pressure of the airflow flowing through the constriction (i.e., in the vicinity of the aerosol generating portion). This low pressure and high velocity facilitate the generation of an aerosol from the first aerosol precursor held in the aerosol generating portion (i.e., transferred from the storage chamber by the liquid transfer element). This aerosol, which is hereinafter referred to as the first aerosol, is entrained in the airflow passing through the constriction and is discharged from the mouthpiece aperture of the aerosol delivery device. In other examples the liquid transfer element does not comprise an aerosol generator, and is instead configured to transfer liquid, for example to a separate aerosol generator or vaporizer.

The first aerosol may be sized to inhibit pulmonary penetration. The first aerosol may be formed of particles with a mass median aerodynamic diameter that is greater than or equal to 15 microns, e.g., greater than 30 microns, or greater than 50 microns, or may be greater than 60 microns, or may be greater than 70 microns.

The first aerosol may be sized for transmission within at least one of a mammalian oral cavity and a mammalian nasal cavity. The first aerosol may be formed by particles having a maximum mass median aerodynamic diameter that is less than 300 microns, o, e.g., less than 200 microns, or less than 100 microns. Such a range of mass median aerodynamic diameter can produce aerosols which are sufficiently small to be entrained in an airflow caused by a user drawing air through the aerosol delivery device and to enter and extend through the oral and or nasal cavity to activate the taste and/or olfactory receptors.

The size of aerosol formed without heating may be typically smaller than that formed by condensation of a vapor.

It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol. The above configuration of the aerosol delivery device may be representative of an activated state of the aerosol delivery device. The aerosol delivery device may additionally be configurable in a deactivated state. In the deactivated state, the liquid transfer element may be isolated from the first aerosol precursor. This isolation may, for example, be provided by a plug (e.g., formed of silicon). The plug may be located at an end (i.e., upstream end) of the conduit (defined by the tank) so as to provide a barrier between the first aerosol precursor in the storage chamber and the conveying portion of the liquid transfer element. Alternatively, the aerosol delivery device may comprise a duck bill valve, a split valve or diaphragm; or a sheet of foil isolating the liquid transfer element from the first aerosol precursor.

In the deactivated state, the air bleed channel may be sealed by a sealing element. The sealing element may, for example, be in the form of a bung or plug (e.g., a silicone bung or plug). At least a portion of the bung may be received in the air bleed channel when the aerosol delivery device is in the deactivated state, so as to block the passage of airflow through the air bleed channel. The sealing element may alternatively be in the form of a pierceable membrane (e.g., formed of a metal foil) extending across the air bleed channel.

The aerosol delivery device may comprise a terminal component (e.g., the mouthpiece) that is movable relative to the tank defining the storage chamber. The terminal component/mouthpiece may be movable relative to the air bleed channel. In particular, movement of the terminal component may be in the longitudinal direction of the aerosol delivery device.

The terminal component/mouthpiece may comprise an activation member, which may protrude internally from an internal surface of terminal component/mouthpiece. When the terminal component/mouthpiece is moved longitudinally in an upstream direction, i.e., towards the storage tank, a distal end of the activation member may engage the sealing element so as to move the sealing element (i.e., in the upstream direction) relative to the air bleed channel. This movement of the sealing element may open the air bleed channel, so as to allow airflow therethrough and so as to move the aerosol delivery device to the activated state.

When the sealing element is a bung, the bung may comprise an enlarged portion, in some cases an enlarged end that extends fully across the air bleed channel, and a neck portion that extends only partway across the air bleed channel. Movement of the bung along the air bleed channel by the activation member may cause the enlarged end of the bung to move into the storage chamber such that only the neck portion remains in the air bleed channel. Thus, airflow may be permitted through the air bleed channel between the neck portion and the walls of the air bleed channel.

When the sealing element is a pierceable membrane, the activation member may pierce the pierceable membrane when moved in the upstream direction. To facilitate such piercing, the activation member may be in the form of a blade, or may be pointed.

The movement of the terminal component (e.g., the mouthpiece) may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the first aerosol precursor (i.e., so as to be able to convey the first aerosol precursor to the aerosol generating portion of the liquid transfer element).

The above components of the aerosol delivery device may form a consumable portion of the aerosol delivery device, and may collectively be referred to as an additive delivery article or flavor pod of the aerosol delivery device.

The aerosol delivery device may further comprise a cartomizer. The additive delivery article/flavor pod may be engageable with the cartomizer, for example, by way of an interference fit, snap-engagement, bayonet locking arrangement, etc. In other embodiments of the first mode, the additive delivery article/flavor pod and cartomizer may be integrally formed (e.g., defining a single consumable article). The cartomizer may comprise a vaporizing chamber and a vaporizer outlet for fluid flow therethrough. The vaporizer outlet may be fluidly connected to the vapor flow passage of the additive delivery article/flavor pod. The vaporizer outlet and vaporizing chamber may fluidly connect a cartomizer inlet opening and the inlet of the vapor flow passage. Thus, an airflow may be drawn into and through the cartomizer, and subsequently through the additive delivery article/flavor pod. The aerosol delivery device may comprise a reservoir defined by a container for containing a second aerosol precursor (which may be an e-liquid). The second aerosol precursor may, for example, comprise a base liquid and a physiologically active compound, e.g., nicotine. The base liquid may include an aerosol former such as propylene glycol and/or vegetable glycerin.

At least a portion of the container may be translucent. For example, the container may comprise a window to allow a user to visually assess the quantity of second aerosol precursor in the container. The cartomizer may be referred to as a "clearomizer" if it includes a window. The vaporizer outlet may extend longitudinally through the container, wherein an outlet wall of the vaporizer outlet may define the inner wall of the container. In this respect, the container may surround the vaporizer outlet, such that the container may be generally annular.

The aerosol delivery device may comprise a vaporizer. The vaporizer may be located in the vaporizing chamber.

The vaporizer may comprise a wick. The vaporizer may further comprise a heater. The wick may comprise a porous material. A portion of the wick may be exposed to fluid flow in the vaporizing chamber. The wick may also comprise one or more portions in contact with the second aerosol precursor stored in the reservoir. For example, opposing ends of the wick may protrude into the reservoir and a central portion (between the ends) may extend across the vaporizing chamber so as to be exposed to air flow in the vaporizing chamber. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid/air flowing through the vaporizing chamber. This vapor may subsequently cool to form an aerosol in the vaporizer outlet. This aerosol is hereinafter referred to as the second aerosol. This aerosol generation may be referred to as "active" aerosol generation because it makes use of heat to generate the aerosol.

This second aerosol may subsequently flow from the vaporizer outlet to (and through) the vapor flow passage of the additive delivery article/flavor pod (e.g., when engaged with the cartomizer). Thus, the fluid received through the mouthpiece aperture of the aerosol delivery device may be a combination of the first aerosol and the second aerosol.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The cartomizer may be a consumable part of the aerosol delivery device. For example, the cartomizer may be configured for engagement with a base unit. The cartomizer and the additive delivery article/flavor pod may be a single consumable component of the aerosol delivery device (when integrally formed) or may each define separate consumable components of the aerosol delivery device (when engageable with one another).

Thus, the cartomizer and additive delivery article/flavor pod (whether integral or separable) may define, and will be referred to herein as, a consumable of the aerosol delivery device. The first aerosol precursor and second aerosol precursor may be replenished by replacing a used consumable with an unused consumable. It should be appreciated that some of the features described herein as being part of the consumable may alternatively form part of a base unit for engagement with the consumable.

The base unit and the consumable (e.g., the cartomizer of the consumable) may be configured to be physically coupled together. For example, the consumable may be at least partially received in a recess of the base unit, such that there is snap engagement between the base unit and the consumable.

Alternatively, the base unit and the consumable may be physically coupled together by screwing one onto the other, or through a bayonet fitting.

Thus, the consumable may comprise one or more engagement portions for engaging with a base unit. In this way, one end of the consumable (i.e., the inlet end) may be coupled with the base unit, whilst an opposing end (i.e., the outlet end) of the consumable may define the mouthpiece.

The base unit or the consumable may comprise a power source or be connectable to a power source. The power source may be electrically connected (or connectable) to the heater. The power source may be a battery (e.g., a rechargeable battery). An external electrical connector in the form o, e.g., a USB port may be provided for recharging this battery.

The consumable may comprise an electrical interface for interfacing with a corresponding electrical interface of the base unit. One or both of the electrical interfaces may include one or more electrical contacts. Thus, when the base unit is engaged with the consumable, the electrical interface may be configured to transfer electrical power from the power source to a heater of the consumable. The electrical interface may also be used to identify the consumable from a list of known types. The electrical interface may additionally or alternatively be used to identify when the consumable is connected to the base unit. The base unit may alternatively or additionally be able to detect information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier, and which can be interrogated via the interface. The consumable or base unit may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method. The consumable or base unit may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the consumable (e.g., the cartomizer or additive delivery article/flavor pod) or the base unit.

In an alternative embodiment of the first mode, the aerosol delivery device may be a non-consumable device in which one or both of the first and second aerosol precursors of the device may be replenished by re-filling the reservoir or storage chamber of the device (rather than replacing the consumable). In this embodiment, the consumable described above may instead be a non-consumable component that is integral with the base unit. Thus, the device may comprise the features of the base unit described above. For example, the only consumable portion may be first and/or second aerosol precursor contained in reservoir and storage chamber of the device. Access to the reservoir and/or storage chamber (for re-filling of the aerosol precursor) may be provided vi, e.g., an opening to the reservoir and/or storage chamber that is sealable with a closure (e.g., a cap). The aerosol delivery device may be a smoking substitute device (e.g., an e-cigarette device). The consumable of the aerosol delivery device be a smoking substitute consumable (e.g., an e-cigarette consumable).

In a second aspect of the first mode, there is provided an aerosol delivery device comprising: a storage for storing aerosol precursor liquid, the storage comprising an air bleed channel for permitting air to enter the storage as the storage empties of aerosol precursor in use; an aerosol generator for generating an aerosol from the aerosol precursor liquid for inhalation by a user; and a liquid transfer element for transferring aerosol precursor liquid from the storage to an aerosol generator, wherein the air bleed channel and the liquid transfer element are configured such that aerosol precursor liquid from the liquid transfer element forms an obstruction in the air bleed channel in use to reduce flow through the air bleed channel, and the aerosol delivery device is further configured such that the obstruction is removed to open the air bleed channel in response to a user drawing on the aerosol delivery device by causing the aerosol precursor liquid in the liquid transfer element to reduce and the obstruction to be pulled from the air bleed channel into the storage to open the air bleed channel.

The aerosol delivery device of the second aspect of the first mode may otherwise be as described above with respect to the first aspect of the first mode. In a third aspect of the first mode, there is provided a smoking substitute system comprising a base unit having a power source, and a consumable as described above with respect to the first or second aspect of the first mode, the consumable being engageable with the base unit such that a vaporizer of the consumable is connected to the power source of the base unit. The consumable may comprise a cartomizer and an additive delivery article/flavor pod, each as described above with respect to the first or second aspect of the first mode. The cartomizer and additive delivery article/flavor pod may be integrally formed, or may be separate, but engageable with one another.

In a fourth aspect of the first mode, there is provided a method of using a smoking substitute system as described above with respect to the third aspect of the first mode, the method comprising engaging the consumable with the base unit so as to connect the vaporizer of the consumable with the power source of the base unit. The method may comprise engaging an additive delivery article/flavor pod of the consumable with a cartomizer of the consumable, such that a vapor flow passage of the additive delivery article/flavor pod is in fluid communication with the vaporizer outlet of the cartomizer.

The disclosure includes the combination of the aspects and preferred features described except where such a combination is clearly impermissible or expressly avoided.

Second Mode: An Aerosol Delivery Device Comprising a Terminal Housing Having Two Possible Orientations in which it can be Seated on the Upstream Device Components.

Generally, a second mode of the present disclosure relates to an aerosol delivery device comprising a terminal housing having two possible orientations in which it can be seated on the upstream device components.

According to a first aspect of the second mode, there is provided an aerosol delivery device comprising: a storage tank defining a storage chamber for storing a liquid aerosol precursor; a porous liquid transfer element for transferring the liquid aerosol precursor from the storage chamber to an aerosolization chamber in an activated state of the device; an air bleed channel configured to allow the bleeding of air into the chamber of the storage tank to replace liquid aerosol precursor as it is transferred by the liquid transfer element in the activated state of the device; a sealing element for sealing the air bleed channel in a deactivated state of the device; wherein the device further comprises first and second activation members depending from an inner surface of a terminal element, wherein, in a first orientation of the terminal element, the first activation member is longitudinally aligned with the sealing element and wherein, in a second orientation of the terminal element, the second activation member is longitudinally aligned with the sealing element.

By providing a device having a terminal element having two orientations and carrying two activation members which are alternatively aligned with the sealing element, the assembly of the device is simplified because there are two possible orientations of the terminal element relative to the storage tank/sealing element rather than just a single orientation. Optional features will now be set out. These are applicable singly or in any combination with any aspect of the second mode.

The terminal element may be rotated by 180 degrees between the first and second orientations.

The sealing element is configured to be movable or rupturable/pierceable to provide the activated state of the device where the air bleed channel is unblocked by the sealing element.

In the first orientation, the first activation member may be configured to engage (and may be configured to move) the sealing element to provide the activated state of the device. In the second orientation of the terminal housing, the second activation member may be configured to engage (and may be configured to move) the sealing element to provide the activated state of the device.

The storage tank may further comprise a filling port (for filling the storage chamber with the liquid aerosol precursor) which, in the activated state of the device, may be sealed by a stopper, e.g., a silicone stopper. In the first orientation of the terminal element, the second activation member may be longitudinally aligned with the filling port/stopper. In the second orientation of the terminal element, the first activation member may be longitudinally aligned with the filling port/stopper.

In some embodiments of the second mode, the liquid transfer element may be interposed between the first and second activation members. In some embodiments of the second mode, the first and second activation members may be parallel to the liquid transfer element.

In some embodiments of the second mode, the liquid transfer element may be an elongate, liquid transfer element extending longitudinally along the longitudinal axis of the device and the first and second activation members may extend parallel to the liquid transfer element (i.e., parallel to the longitudinal axis of the device). They may be symmetrically disposed either side of the liquid transfer element. The aerosol delivery device may comprise a flow passage for fluid flow therethrough. The flow passage may extend generally in a longitudinal direction between (and may fluidly connect) a vapor flow passage inlet to an outlet aperture of the aerosol delivery device.

The inlet may define an upstream end of the flow passage, whilst the outlet aperture may define a downstream end of the flow passage. The outlet aperture may be provided on the terminal element. The terminal element may comprise a downstream mouthpiece portion and an upstream device housing. The mouthpiece portion and the device housing may be integrally formed. The device housing may circumscribe the storage tank.

The outlet aperture may be provided on the mouthpiece portion and thus may be hereinafter described as a mouthpiece aperture. In this respect, a user may draw fluid (e.g., air) into and through the flow passage of the aerosol delivery device by inhaling at the mouthpiece aperture.

The terms "upstream" and "downstream" are used with reference to the direction of airflow (from inlet to outlet) through the device during normal use of the device (i.e., by way of inhalation at the mouthpiece aperture).

The first and second activation members may extend from the inner surface of the terminal element within the mouthpiece portion. They may be provided on opposing lateral/transverse sides of the mouthpiece aperture. They may be symmetrically disposed either side of the mouthpiece aperture. This allows for a symmetrical flow through the mouthpiece portion of the terminal housing.

The flow passage may comprise one or more deflections. It may comprise a transverse portion proximal the inlet such that there is a deflection between the inlet and the transverse portion of the flow passage.

The flow passage may then comprise a generally longitudinal portion downstream of the transverse portion. The longitudinal portion may extend within a spacing between the device housing (i.e., the upstream portion of the terminal element) and the tank. The flow passage may then deflect again (e.g., radially) at the upper surface of the tank within the mouthpiece portion (i.e., the downstream portion of the terminal element), through the aerosolization chamber, towards the mouthpiece aperture.

The flow passage may be a single (annular) flow passage around the tank, or it may comprise two branches which split around the tank and re-join within the mouthpiece portion of the terminal element, e.g., proximal the liquid transfer element.

The aerosol delivery device comprises a storage tank defining the storage chamber for containing the aerosol precursor (e.g., an e-liquid or a flavor liquid). The aerosol precursor may, for example, comprise a flavorant having a menthol, licorice, chocolate, fruit flavor (including, e.g., citrus, cherry etc.), vanilla, spice (e.g., ginger, cinnamon) and/or tobacco flavor.

The aerosol precursor may be stored in the form of a free liquid. Alternatively, a porous body may be disposed within the storage chamber, which may contain the aerosol precursor.

The tank may at least partially define the flow passage. For example, the flow passage may be defined between an outer surface of the tank and an inner surface of the device housing of the terminal element (which may be integral with the mouthpiece portion of the terminal element). The aerosol delivery device comprises an air bleed channel configured to allow the bleeding of air into the storage chamber to replace the aerosol precursor that is removed from the storage chamber. In the activated state, the air bleed channel may be in fluid communication with the flow passage, such that air from the flow passage (e.g., within the mouthpiece portion) can enter the storage chamber through the air bleed channel.

The aerosol delivery device comprises an aerosol generator in the form of a porous liquid transfer element (i.e., formed of a porous material). As will be described further below, the liquid transfer element may be configured to generate an aerosol in the flow passage. The liquid transfer element, however, may do this in such a way that does not use heat to form the aerosol, and therefore in some embodiments may be referred to as a "passive" aerosol generator.

The liquid transfer element may comprise a conveying portion and an aerosol generating portion. The conveying portion may be elongate and generally cylindrical, and may be at least partially enclosed within one or more internal walls of the aerosol delivery device. The one or more internal walls enclosing the conveying portion may form part of the tank defining the storage chamber. In this respect, the tank may at least partly surround (e.g., may fully surround) the conveying portion of the liquid transfer element. That is, the tank may define a conduit through which the conveying portion passes. Thus, the conveying portion may extend generally longitudinally (e.g., centrally) through a portion of the tank (i.e., through the conduit defined by the tank).

The liquid transfer element may be supported in the aerosol delivery device by the terminal element, e.g., by the mouthpiece portion of the terminal element. That is, the mouthpiece portion/terminal element may comprise a collar for holding (and gripping) the liquid transfer element in position within the aerosol delivery device.

The aerosol generating portion of the liquid transfer element may be disposed at a downstream end of the conveying portion and may thus define a downstream longitudinal end of the liquid transfer element. The aerosol generating portion may be at least partly located in the flow passage so as to be exposed to airflow within the flow passage. In particular, the aerosol generating portion of the liquid transfer element may extend into the aerosolization chamber forming part of the flow passage. The aerosolization chamber may be located proximate to (and in fluid communication with) the mouthpiece aperture of the device. Airflow through the flow passage may pass across or through the aerosol generating portion of the liquid transfer element prior to being discharged through the mouthpiece aperture.

The aerosol generating portion may define an enlarged (e.g., radially enlarged) portion of the liquid transfer element. For example, the aerosol generating portion may be bulb-shaped or bullet-shaped, and may comprise a portion which is wider than the conveying portion. The aerosol generating portion may taper (inwardly) to a tip at a downstream end of the aerosol generating portion (i.e., proximate the outlet/mouthpiece aperture). The aerosol-generating portion may have a flattened downstream end surface.

The liquid transfer element may extend into the storage chamber within the storage tank so as to be in contact with (e.g., at least partially submerged in) the aerosol precursor. In this way, the liquid transfer element may be configured to convey (e.g., via a wicking/capillary action) the aerosol precursor from the storage chamber to the aerosolization chamber. As will be described further below, this may allow the aerosol precursor to form an aerosol and be entrained in an airflow passing through the aerosolization chamber (i.e., for subsequent receipt in a user's mouth).

The flow passage may be constricted (i.e., narrowed) at the aerosolization chamber. For example, the presence of the aerosol generating portion in the flow passage may create a constricted or narrowed portion of the flow passage (because the aerosol generating portion extends partway across the flow passage). In this respect, the narrowest portion of the flow passage may be at aerosolization chamber (adjacent to the aerosol generating portion of the liquid transfer element). This constriction of the flow passage increases the velocity of air/vapor passing through the aerosolization chamber. In this respect, the constriction may be referred to as a Venturi aperture. The constriction may have a toroidal shape (i.e., extending about the aerosol generating portion of the liquid transfer element). The toroidal shape may, however, be interrupted by supports (e.g., projections, ribs, etc.) protruding inwardly from wall(s) of the flow passage to support the aerosol generating portion in the aerosolization chamber.

In addition to increasing the airflow velocity, the constriction reduces the air pressure of the airflow flowing through the constriction (i.e., in the vicinity of the aerosol generating portion). This low pressure and high velocity facilitate the generation of an aerosol from the aerosol precursor held in the aerosol generating portion (i.e., transferred from the storage chamber by the liquid transfer element). This aerosol is entrained in the airflow passing through the constriction and is discharged from the mouthpiece aperture of the aerosol delivery device.

The aerosol may be sized to inhibit pulmonary penetration. The aerosol may be formed of particles with a mass median aerodynamic diameter that is greater than or equal to 15 microns, e.g., greater than 30 microns, or greater than 50 microns, or may be greater than 60 microns, or may be greater than 70 microns.

The aerosol may be sized for transmission within at least one of a mammalian oral cavity and a mammalian nasal cavity. The aerosol may be formed by particles having a maximum mass median aerodynamic diameter that is less than 300 microns, or, e.g., less than 200 microns, or less than 100 microns. Such a range of mass median aerodynamic diameter can produce aerosols which are sufficiently small to be entrained in an airflow caused by a user drawing air through the aerosol delivery device and to enter and extend through the oral and or nasal cavity to activate the taste and/or olfactory receptors.

The size of aerosol formed without heating may be typically smaller than that formed by condensation of a vapor. It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

The above configuration of the aerosol delivery device may be representative of the activated state of the aerosol delivery device. The aerosol delivery device may additionally be configurable in a deactivated state. In the deactivated state, the liquid transfer element may be isolated from the aerosol precursor.

This isolation may, for example, be provided by a plug (e.g., formed of silicone). The plug may be located at an end (i.e., upstream end) of the conduit (defined by the tank) so as to provide a barrier between the aerosol precursor in the storage chamber and the conveying portion of the liquid transfer element. Alternatively, the aerosol delivery device may comprise a duck bill valve, a split valve or diaphragm; or a sheet of foil isolating the liquid transfer element from the aerosol precursor in the deactivated state.

In the deactivated state, the air bleed channel is sealed by the sealing element. The sealing element may, for example, be in the form of a bung or plug (e.g., a silicone bung or plug). At least a portion of the bung may be received in the air bleed channel when the aerosol delivery device is in the deactivated state, so as to block the passage of airflow through the air bleed channel. The sealing element may alternatively be in the form of a pierceable membrane (e.g., formed of a metal foil) extending across the air bleed channel. The terminal element (e.g., the mouthpiece portion/device housing) may be movable relative to the storage tank defining the storage chamber. The terminal element may be movable relative to the air bleed channel. In particular, movement of the terminal element may be in the longitudinal direction of the aerosol delivery device.

When the terminal component is moved longitudinally in an upstream direction, i.e., towards the storage tank, a distal end of the first or second activation member (depending on the orientation of the terminal element) may engage the sealing element. This movement of the terminal element may effect opening of the air bleed channel, so as to allow airflow therethrough and so as to move the aerosol delivery device to the activated state.

When the sealing element is a bung, the bung may comprise an enlarged end that extends fully across the air bleed channel, and a neck portion that extends only partway across the air bleed channel. Movement of the terminal element will effect movement of the bung along the air bleed channel by the first/second activation member which may cause the enlarged end of the bung to move into the storage chamber such that only the neck portion remains in the air bleed channel. Thus, airflow may be permitted through the air bleed channel between the neck portion and the walls of the air bleed channel. When the sealing element is a pierceable membrane, the first/second activation member may pierce the pierceable membrane when moved in the upstream direction. To facilitate such piercing, the first/second activation member may be in the form of a blade, or may have a pointed distal end.

The movement of the terminal component (i.e., the mouthpiece/device housing) may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the aerosol precursor (i.e., so as to be able to convey the aerosol precursor to the aerosol generating portion of the liquid transfer element).

The above components of the aerosol delivery device may collectively be referred to as a delivery article, e.g., an additive delivery article or (flavor) pod of the aerosol delivery device.

The aerosol delivery device may further comprise a cartomizer. The (additive) delivery article/(flavor) pod may be engageable with the cartomizer, for example, by way of an interference fit, snap-engagement, bayonet locking arrangement, etc. In other embodiments of the second mode, the (additive) delivery article/(flavor) pod and cartomizer may be integrally formed.

The terminal component (e.g., the device housing) may comprise opposing apertures for engagement with respective lugs provided on the cartomizer to secure the terminal element/device housing to the cartomizer. There may be two sets of longitudinally spaced lugs and two sets of longitudinally spaced apertures with only the downstream lugs engaged within the upstream apertures when the device is in its deactivated state. Movement of the terminal element (mouthpiece portion/device housing) causes engagement of the upstream lugs in the upstream apertures and the downstream lugs in the downstream apertures.

The cartomizer may comprise a vaporizing chamber and a vapor outlet for fluid flow therethrough. The vapor outlet may be fluidly connected to the flow passage of the (additive) delivery article/(flavor) pod. The vapor outlet and vaporizing chamber may fluidly connect a cartomizer inlet opening and the inlet of the flow passage. Thus, an airflow may be drawn into and through the cartomizer, and subsequently through the (additive) delivery article/(flavor) pod.

The aerosol delivery device (i.e., cartomizer) may comprise a reservoir defined by a container for containing a further aerosol precursor (which may be an e-liquid). The further aerosol precursor may, for example, comprise a base liquid and a physiologically active compound, e.g., nicotine. The base liquid may include an aerosol former such as propylene glycol and/or vegetable glycerin. At least a portion of the container may be translucent. For example, the container may comprise a window to allow a user to visually assess the quantity of further aerosol precursor in the container. The cartomizer may be referred to as a "clearomizer" if it includes a window. The vapor outlet may extend longitudinally through the container, wherein an outlet wall of the vapor outlet may define the inner wall of the container. In this respect, the container may surround the vapor outlet, such that the container may be generally annular.

The aerosol delivery device (i.e., the cartomizer) may comprise a vaporizer. The vaporizer may be located in the vaporizing chamber.

The vaporizer may comprise a wick. The vaporizer may further comprise a heater. The wick may comprise a porous material. A portion of the wick may be exposed to fluid flow in the vaporizing chamber. The wick may also comprise one or more portions in contact with the further aerosol precursor stored in the reservoir. For example, opposing ends of the wick may protrude into the reservoir and a central portion (between the ends) may extend across the vaporizing chamber so as to be exposed to air flow in the vaporizing chamber. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the reservoir) to be heated so as to form a vapor and become entrained in fluid/air flowing through the vaporizing chamber. This vapor may subsequently cool to form an aerosol in the vapor outlet. This aerosol generation may be referred to as "active" aerosol generation because it makes use of heat to generate the aerosol.

This aerosol may subsequently flow from the vapor outlet to (and through) the flow passage of the (additive) delivery article/(flavor) pod (e.g., when engaged with the cartomizer). Thus, the fluid received through the mouthpiece aperture (in the terminal component) of the aerosol delivery device may be a combination of two aerosols—one from the cartomizer and one from the (additive) delivery article/(flavor) pod.

The cartomizer aerosol is sized for pulmonary penetration (i.e., to deliver an active ingredient such as nicotine to the user's lungs). The cartomizer aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The cartomizer aerosol may also be referred to as a vapor.

The (additive) delivery article ((flavor) pod) and/or cartomizer may be a consumable part of an aerosol delivery system. In this regard, the device may be a termed "a consumable".

Accordingly, in a second aspect of the second mode, there is provided an aerosol delivery system comprising a base unit having a power source, and a device as described above with respect to the first aspect of the second mode.

The device may be engageable with the base unit such that the vaporizer of the device/consumable is connected to the power source of the base unit. For example, the cartomizer may be configured for engagement with the base unit. The cartomizer and the additive delivery article/flavor pod may be a single consumable component of the aerosol delivery system (when integrally formed) or may each define separate consumable components of the aerosol delivery system (when engageable with one another).

The aerosol precursor(s) may be replenished by replacing a used consumable with an unused consumable.

The base unit and the device/consumable (e.g., the cartomizer of the consumable) may be configured to be physically coupled together. For example, the device/consumable may be at least partially received in a recess of the base unit, such that there is snap engagement between the base unit and the consumable. Alternatively, the base unit and the device/consumable may be physically coupled together by screwing one onto the other, or through a bayonet fitting.

Thus, the device/consumable may comprise one or more engagement portions for engaging with a base unit. In this way, one end of the device/consumable (i.e., the inlet end) may be coupled with the base unit, whilst an opposing end (i.e., the outlet end) of the consumable may define the mouthpiece.

The base unit or the device/consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery.

The device/consumable may comprise an electrical interface for interfacing with a corresponding electrical interface of the base unit. One or both of the electrical interfaces may include one or more electrical contacts. Thus, when the base unit is engaged with the consumable, the electrical interface may be configured to transfer electrical power from the power source to a heater of the device/consumable. The electrical interface may also be used to identify the consumable from a list of known types. The electrical interface may additionally or alternatively be used to identify when the device/consumable is connected to the base unit. The base unit may alternatively or additionally be able to detect information about the consumable via an RFID reader, a barcode or QR code reader. This interface may be able to identify a characteristic (e.g., a type) of the consumable. In this respect, the device/consumable may include any one or more of an RFID chip, a barcode or QR code, or memory within which is an identifier, and which can be interrogated via the interface. The base unit may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method. The base unit may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the device or the base unit. In an alternative embodiment of the second mode, the aerosol delivery device may be a non-consumable device in which one or both of the aerosol precursors of the device may be replenished by re-filling the reservoir or storage chamber of the device (rather than replacing the consumable). In this embodiment, the consumable described above may instead be a non-consumable component that is integral with the base unit. For example, the only consumable portion may be the first and/or second aerosol precursor contained in reservoir and storage chamber of the device. Access to the reservoir and/or storage chamber (for re-filling of the aerosol precursors) may be provided via, e.g., an opening to the reservoir and/or the filling port of the storage chamber.

The aerosol delivery device may be a smoking substitute device (e.g., an e-cigarette device). The consumable of the aerosol delivery device be a smoking substitute consumable (e.g., an e-cigarette consumable). The aerosol delivery system may be a smoking substitute system (e.g., an e-cigarette system).

In a third aspect of the second mode, there is provided a method of using a smoking substitute system as described above with respect to the second aspect of the second mode, the method comprising engaging the device/consumable with the base unit so as to connect the vaporizer of the device/consumable with the power source of the base unit. The method may comprise engaging an additive delivery article/flavor pod of the device/consumable with a cartomizer of the device/consumable, such that a flow passage of the additive delivery article/flavor pod is in fluid communication with the vapor outlet of the cartomizer.

In a variation, the present disclosure may generally relate to an aerosol delivery device comprising an aerosolization chamber having a uniform/constant cross-sectional area along its length, and a porous liquid transfer element at least partly received in the aerosolization chamber.

According to a fourth aspect of the second mode, there is provided an aerosol delivery device comprising: a mouthpiece comprising an end surface at a longitudinal end of the mouthpiece, and a mouthpiece aperture formed in the end surface; an aerosolization chamber extending longitudinally into the device from the mouthpiece aperture; a storage chamber for storing an aerosol precursor; and a porous liquid transfer element comprising an aerosol generating portion at least partly received in the aerosolization chamber and a conveying portion for conveying liquid from the storage chamber to the aerosol generating portion, wherein a transverse cross-sectional area of the aerosolization chamber is uniform along a longitudinal length of the aerosolization chamber.

The provision of an aerosolization chamber having a uniform cross-sectional area, as opposed to, e.g., a conical chamber, may reduce or avoid the build-up of aerosol precursor at the mouthpiece aperture. For example, a conical chamber can diverge from the aerosol generating portion of the liquid transfer element, which may result in a space between the wall(s) defining the chamber and the liquid transfer element that is larger than would otherwise be the case of a non-diverging (i.e., uniform cross-section) chamber. This larger space may allow for a greater build-up of aerosol precursory, so as to result in a larger propensity for leakage from the device and may also result in a greater propensity for large droplets of aerosol precursor to be entrained in airflow from the device. Thus, the provision of a uniform cross-section chamber may result in a more consistent droplet size in the aerosol delivered by the device. Similarly, when the space between the chamber walls and the aerosol generating portion is minimized, the surface tension of any aerosol precursor between the chamber walls and the aerosol generating portion may be more likely to be sufficient to retain the aerosol precursor in the device.

As the aerosolization chamber extends from the mouthpiece aperture, it may otherwise be considered an outlet (e.g., a mouthpiece outlet) of the device. Optional features will now be set out. These are applicable singly or in any combination with any aspect of the second mode.

The aerosol generating portion of the liquid transfer element may have a larger transverse cross-sectional area (taken at a location adjacent the conveying portion) than a transverse cross-sectional area (taken at a location adjacent the aerosol generating portion) of the conveying portion. In this respect, the aerosol generating portion may define an enlarged portion of the aerosol generator. The aerosol generating portion may have a circular transverse cross-sectional shape. The conveying portion may have a circular transverse cross-sectional shape. In this respect, the aerosol generating portion may have a larger radius than the conveying portion.

Due to the aerosol generating portion being larger than the conveying portion, a transversely (e.g., radially) extending transition surface may be defined between the conveying portion and the aerosol generating portion. The transition surface may define an outward step from the conveying portion to the aerosol generating portion. The transition surface may have a concave profile. Hence, the transition surface may form a smooth continuous transition with an outer circumferential surface of the conveying portion. On the other hand, there may be a (substantially) sharp transition between the transition surface and an outer circumferential surface of the aerosol generating portion. In this respect a leading edge of the aerosol generating portion may be defined between the transition surface and the outer circumferential surface of the aerosol generating portion.

The aerosolization chamber may have a cylindrical shape. For example, the aerosolization chamber may have a circular cylinder shape (i.e., having a circular transverse cross-section) or an elliptical cylinder shape (having an elliptical transverse cross-section). A transverse cross-sectional shape of the aerosol generating portion may correspond to a transverse cross-sectional shape of the aerosolization chamber (i.e., they may both be circular or elliptical). In this way, the aerosol generating portion and a wall defining the aerosolization chamber may be concentrically arranged.

The longitudinal length of the aerosolization chamber may be between 6 mm and 3 mm, for example between 5 mm and 4 mm, e.g., about 4.5 mm.

The aerosol generating portion may be fully received in the aerosolization chamber. A portion of the conveying portion (i.e., a portion adjacent the aerosol generating portion) may be received in the aerosolization chamber. Alternatively, only a portion of the aerosol generating portion (or liquid transfer element) may be received in the aerosolization chamber (i.e., at an upstream end of the aerosolization chamber). Thus, a portion of the aerosolization chamber (e.g., at or adjacent to the mouthpiece aperture and downstream of the aerosol generating portion) may not include the aerosol generating portion.

An airflow path may be defined between a wall defining the aerosolization chamber and the liquid transfer element. Where the aerosolization chamber is cylindrical, the airflow path may be annular. The airflow path may have a constricted region defined by the aerosol generating portion. The transverse/radial distance between the aerosol generating portion and the wall of the aerosolization chamber at the constricted region may be less than 0.5 mm, for example less than 0.4 mm, or, e.g., less than 0.3 mm.

The constricted region may define the narrowest part of the airflow path through the aerosolization chamber. This constriction of the airflow passage increases the velocity of air/vapor passing through the aerosolization chamber. In this respect, the constriction may be referred to as a Venturi aperture. The constriction may have a toroidal shape (i.e., extending about the aerosol generating portion of the liquid transfer element). The toroidal shape may, however, be interrupted by supports (e.g., projections, ribs, etc.) protruding inwardly from wall(s) of the aerosolization chamber to support the aerosol generating portion in the aerosolization chamber.

In addition to increasing the airflow velocity, the constriction reduces the air pressure of the airflow flowing through the constriction (i.e., in the vicinity of the aerosol generating portion). This low pressure and high velocity facilitate the generation of an aerosol from the aerosol precursor held in the aerosol generating portion (i.e., conveyed from the storage chamber by the liquid transfer element). This aerosol is entrained in the airflow passing through the constriction and is discharged from the mouthpiece aperture of the aerosol delivery device.

The airflow path may have an expansion region downstream of the constricted region, in which a cross-sectional area of the airflow path (e.g., gradually) increases in the downstream direction. The expansion region may be defined by a tapered section of the aerosol generating portion. The tapered section may taper inwardly in a direction from the constricted region to a downstream (distal) end of the aerosol generating portion. The taper may have a curved profile (i.e., in the longitudinal direction).

The terms "upstream" and "downstream" are used herein with reference to the direction of airflow through the device during normal use of the device (i.e., by way of inhalation at the mouthpiece aperture).

The transverse/radial distance between the aerosol generating portion and the wall of the aerosolization chamber at the distal/downstream end of the aerosol generating portion may be less than 1 mm, for example less than 0.7 mm, or, e.g., less than 0.5 mm. The transverse/radial distance between the aerosol generating portion and the wall of the aerosolization chamber at the distal/downstream end of the aerosol generating portion may be less than 20% of the diameter of aerosolization chamber, for example less than 17%, or, e.g., less than 15%.

A distal (transversely extending) end surface of the aerosol generating portion (i.e., at the extreme downstream end of the aerosol generating portion) may be being substantially planar. In other words, the aerosol generating portion (and thus the liquid transfer element) may have a flattened or truncated distal end. The combination of the planar/flattened distal end and the aerosolization chamber of constant cross-sectional area may provide a more evenly dispersed spray from the device. For example, such an arrangement may result in a smaller gap between the aerosolization chamber walls and the aerosol generating portion (e.g., compared with an arrangement having a conical outlet and/or a conical aerosol generating portion), which may reduce the presence of large droplets of liquid in the aerosol discharged from the device.

The distal end of the aerosol generating portion may be spaced from the mouthpiece aperture/end surface (e.g., transversely extending end surface of the mouthpiece) in an upstream longitudinal direction. That is, the distal (downstream) end of the aerosol generating portion/liquid transfer element may be recessed with respect to the end surface of the mouthpiece. For example, the distal end may be spaced (in the longitudinal direction) from the end surface of the mouthpiece or mouthpiece aperture by less than 1.5 mm, or less than 1 mm, or, e.g., less than 0.5 mm.

The aerosolization chamber may be defined by a tube extending upstream and longitudinally from the end surface of the mouthpiece. The device may comprise a retaining element for retaining the liquid transfer element in position with respect to the mouthpiece. The retaining element may comprise a mounting portion extending about the tube so as to mount the retaining element to the tube. The retaining element may comprise a collar projecting from the mounting portion and at least partly circumscribing the liquid transfer element (e.g., the conveying portion) so as to retain the liquid transfer element against movement relative to the mouthpiece. The liquid transfer element (e.g., the conveying portion) may comprise one or more recesses for receipt of a portion of the collar so as to facilitate retaining of the liquid transfer element by the collar.

The aerosol delivery device may comprise a flow passage for fluid flow therethrough. The flow passage may extend generally in the longitudinal direction between (and may fluidly connect) an inlet of the aerosol delivery device and the aerosolization chamber. In this respect, a user may draw fluid (e.g., air) into and through the flow passage and aerosolization chamber of the aerosol delivery device by inhaling at the mouthpiece aperture.

The flow passage may comprise one or more deflections. It may comprise a transverse portion proximal the inlet such that there is a deflection between inlet and the transverse portion of the flow passage. The flow passage may then comprise a generally longitudinal portion downstream of the transverse portion. The longitudinal portion may extend within a spacing between a device housing (which may be integral with the mouthpiece) and a tank (discussed further below) defining the storage chamber. The flow passage may then deflect again (e.g., radially) at the upper surface of the tank within the mouthpiece, through the aerosolization chamber, towards the mouthpiece aperture.

The flow passage may be a single (annular) flow passage around the tank, or it may comprise two branches which split around the tank and re-join within the mouthpiece, e.g., proximal the liquid transfer element.

As is mentioned above, the aerosol delivery device may comprise a tank defining the storage chamber for containing the aerosol precursor (which may be, e.g., an e-liquid or a flavor liquid). The aerosol precursor may, for example, comprise a flavorant having a menthol, licorice, chocolate, fruit flavor (including, e.g., citrus, cherry etc.), vanilla, spice (e.g., ginger, cinnamon) and/or tobacco flavor.

The aerosol precursor may be stored in the form of a free liquid. Alternatively, a porous body may be disposed within the storage chamber, which may contain the aerosol precursor.

The tank may at least partially define the flow passage. For example, the flow passage may be defined between an outer surface of the tank and an inner surface of a device housing (which may be integral with the mouthpiece) The aerosol delivery device may comprise an air bleed channel configured to allow the bleeding of air into the storage chamber to replace aerosol precursor that is removed from the storage chamber. The air bleed channel may be in fluid communication with the flow passage, such that (e.g., under certain conditions) air from the flow passage can enter the storage chamber through the air bleed channel.

As will be described further below, the liquid transfer element (i.e., the aerosol generating portion) is configured to generate an aerosol in the aerosolization chamber. The liquid transfer element may do this in such a way that does not use heat to form the aerosol, and therefore in some embodiments may be referred to as a "passive" aerosol generator.

The conveying portion may be elongate and generally cylindrical, and may be at least partially enclosed within one or more internal walls of the aerosol delivery device. The one or more internal walls enclosing the conveying portion may form part of the tank defining the storage chamber. In this respect, the tank may at least partly surround (e.g., may fully surround) the conveying portion. That is, the tank may define a conduit through which the conveying portion passes. Thus, the conveying portion may extend generally longitudinally (e.g., centrally) through a portion of the tank (i.e., through the conduit defined by the tank).

The liquid transfer element (i.e., conveying portion) may extend into the storage chamber so as to be in contact with (e.g., at least partially submerged in) the aerosol precursor. Hence, the liquid transfer element may be configured to convey the aerosol precursor from the storage chamber to the aerosolization chamber via a wicking/capillary action.

The aerosol may be sized to inhibit pulmonary penetration. The aerosol may be formed of particles with a mass median aerodynamic diameter that is greater than or equal to 15 microns, e.g., greater than 30 microns, or greater than 50 microns, or may be greater than 60 microns, or may be greater than 70 microns.

The aerosol may be sized for transmission within at least one of a mammalian oral cavity and a mammalian nasal cavity. The first aerosol may be formed by particles having a maximum mass median aerodynamic diameter that is less than 300 microns, or, e.g., less than 200 microns, or less than 100 microns. Such a range of mass median aerodynamic diameter can produce aerosols which are sufficiently small to be entrained in an airflow caused by a user drawing air through the aerosol delivery device and to enter and extend through the oral and or nasal cavity to activate the taste and/or olfactory receptors. The size of aerosol formed without heating may be typically smaller than that formed by condensation of a vapor.

It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

The above configuration of the aerosol delivery device may be representative of an activated state of the aerosol delivery device. The aerosol delivery device may additionally be configurable in a deactivated state. In the deactivated state, the liquid transfer element may be isolated from the aerosol precursor. This isolation may, for example, be provided by a plug (e.g., formed of silicone). The plug may be located at an end (i.e., upstream end) of the conduit (defined by the tank) so as to provide a barrier between the aerosol precursor in the storage chamber and the conveying portion of the liquid transfer element. Alternatively, the aerosol delivery device may comprise a duck bill valve, a split valve or diaphragm; or a sheet of foil isolating the liquid transfer element from the first aerosol precursor.

In the deactivated state, the air bleed channel may be sealed by a sealing element. The sealing element may, for example, be in the form of a bung or plug (e.g., a silicone bung or plug). At least a portion of the bung may be received in the air bleed channel when the aerosol delivery device is in the deactivated state, so as to block the passage of airflow through the air bleed channel. The sealing element may alternatively be in the form of a pierceable membrane (e.g., formed of a metal foil) extending across the air bleed channel.

The mouthpiece/device housing of the device may be movable relative to the tank defining the storage chamber. The mouthpiece/device housing may be movable relative to the air bleed channel. In particular, movement of the mouthpiece/device housing may be in the longitudinal direction of the aerosol delivery device.

The mouthpiece may comprise an activation member, which may protrude internally (in an upstream direction) from an internal surface of the mouthpiece. When the mouthpiece/device housing is moved longitudinally in an upstream direction, i.e., towards the storage tank, a distal end of the activation member may engage the sealing element so as to move the sealing element (i.e., in the upstream direction) relative to the air bleed channel. This movement of the sealing element may open the air bleed channel, so as to allow airflow therethrough and so as to move the aerosol delivery device to the activated state.

When the sealing element is a bung, the bung may comprise an enlarged end that extends fully across the air bleed channel, and a neck portion that extends only partway across the air bleed channel.

Movement of the bung along the air bleed channel by the activation member may cause the enlarged end of the bung to move into the storage chamber such that only the neck portion remains in the air bleed channel. Thus, airflow may be permitted through the air bleed channel between the neck portion and the walls of the air bleed channel.

When the sealing element is a pierceable membrane, the activation member may pierce the pierceable membrane when moved in the upstream direction. To facilitate such piercing, the activation member may be in the form of a blade, or may be pointed.

The movement of the mouthpiece/device housing may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the aerosol precursor (i.e., so as to be able to convey the aerosol precursor to the aerosol generating portion of the liquid transfer element).

The above components of the aerosol delivery device may collectively be referred to as an (additive) delivery article or (flavor) pod of the aerosol delivery device.

The aerosol delivery device may further comprise a cartomizer. The (additive) delivery article/(flavor) pod may be engageable with the cartomizer, for example, by way of an interference fit, snap-engagement, bayonet locking arrangement, etc. In other embodiments of the second mode, the (additive) delivery article/(flavor) pod and cartomizer may be integrally formed.

The device housing may comprise opposing recesses or apertures for engagement with respective lugs provided on the cartomizer to secure the device housing to the cartomizer. There may be two sets of longitudinally spaced lugs and two sets of longitudinally spaced apertures with only the downstream lugs engaged within the upstream apertures when the device is in its deactivated state. Movement of the mouthpiece/device housing cases engagement of the upstream lugs in the upstream apertures and the downstream lugs in the downstream apertures.

The cartomizer may comprise a vaporizing chamber and a vapor outlet for fluid flow therethrough. The vapor outlet may be fluidly connected to the flow passage of the additive delivery article/flavor pod. The vapor outlet and vaporizing chamber may fluidly connect a cartomizer inlet opening and the inlet of the flow passage. Thus, an airflow may be drawn into and through the cartomizer, and subsequently through the additive delivery article/flavor pod.

The aerosol precursor stored in the storage chamber (and conveyed by the liquid transfer element) may be a first aerosol precursor, and the aerosol formed from the first aerosol precursor may be a first aerosol. The aerosol delivery device (i.e., cartomizer) may comprise a reservoir defined by a container for containing a second aerosol precursor (which may be an e-liquid). The second aerosol precursor may, for example, comprise a base liquid and a physiologically active compound, e.g., nicotine. The base liquid may include an aerosol former such as propylene glycol and/or vegetable glycerin.

At least a portion of the container may be translucent. For example, the container may comprise a window to allow a user to visually assess the quantity of second aerosol precursor in the container. The cartomizer may be referred to as a "clearomizer" if it includes a window. The vapor outlet may extend longitudinally through the container, wherein an outlet wall of the vapor outlet may define the inner wall of the container. In this respect, the container may surround the vapor outlet, such that the container may be generally annular. The aerosol delivery device (i.e., the cartomizer) may comprise a vaporizer. The vaporizer may be located in the vaporizing chamber.

The vaporizer may comprise a wick. The vaporizer may further comprise a heater. The wick may comprise a porous material. A portion of the wick may be exposed to fluid flow in the vaporizing chamber. The wick may also comprise one or more portions in contact with the second aerosol precursor stored in the reservoir. For example, opposing ends of the wick may protrude into the reservoir and a central portion (between the ends) may extend across the vaporizing chamber so as to be exposed to air flow in the vaporizing chamber. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the reservoir) to be heated so as to form a vapor and become entrained in fluid/air flowing through the vaporizing chamber. This vapor may subsequently cool to form an aerosol in the vapor outlet. This aerosol is hereinafter referred to as the second aerosol. This aerosol generation may be referred to as "active" aerosol generation because it makes use of heat to generate the aerosol.

This second aerosol may subsequently flow from the vapor outlet to (and through) the flow passage and aerosolization chamber of the additive delivery article/flavor pod (e.g., when engaged with the cartomizer). Thus, the fluid received through the mouthpiece aperture of the aerosol delivery device may be a combination of the first aerosol and the second aerosol.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The (additive) delivery article ((flavor) pod) and/or cartomizer may be a consumable part of an aerosol delivery system. In this regard, the device may be a termed "a consumable".

In a fifth aspect of the second mode, there is provided an aerosol delivery device comprising: a mouthpiece comprising an end surface at a longitudinal end of the mouthpiece, and a mouthpiece aperture formed in the end surface; an aerosolization chamber extending longitudinally into the device from the mouthpiece aperture; a storage chamber for storing an aerosol precursor; and an elongate porous liquid transfer element comprising: an aerosol generating portion at least partly received in the aerosolization chamber, the aerosol generating portion comprising a transversely extending distal end surface that is substantially planar; and a conveying portion for conveying liquid from the storage chamber to the aerosol generating portion, a transverse cross-sectional area of the conveying portion being smaller than a transverse cross-sectional area of the aerosol generating portion.

The aerosol generating portion may thus define an enlarged portion of the liquid transfer element. A transversely (e.g., radially) extending transition surface of the liquid transfer element may define a step between the conveying portion and the aerosol generating portion. The aerosol delivery device may otherwise be as described above with respect to the fourth aspect of the second mode.

In a sixth aspect of the second mode, there is provided an aerosol delivery system comprising a base unit having a power source, and a device as described above with respect to the fourth or fifth aspects of the second mode.

The device may be engageable with the base unit such that the vaporizer of the device/consumable is connected to the power source of the base unit. For example, the cartomizer may be configured for engagement with the base unit. The cartomizer and the additive delivery article/flavor pod may be a single consumable component of the aerosol delivery system (when integrally formed) or may each define separate consumable components of the aerosol delivery system (when engageable with one another).

The first aerosol precursor and second aerosol precursor may be replenished by replacing a used consumable with an unused consumable.

The base unit and the device/consumable (e.g., the cartomizer of the consumable) may be configured to be physically coupled together. For example, the device/consumable may be at least partially received in a recess of the base unit, such that there is snap engagement between the base unit and the consumable. Alternatively, the base unit and the device/consumable may be physically coupled together by screwing one onto the other, or through a bayonet fitting.

Thus, the device/consumable may comprise one or more engagement portions for engaging with a base unit. In this way, one end of the device/consumable (i.e., the inlet end) may be coupled with the base unit, whilst an opposing end (i.e., the outlet end) of the consumable may define the mouthpiece.

The base unit or the device/consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery. The device/consumable may comprise an electrical interface for interfacing with a corresponding electrical interface of the base unit. One or both of the electrical interfaces may include one or more electrical contacts. Thus, when the base unit is engaged with the consumable, the electrical interface may be configured to transfer electrical power from the power source to a heater of the device/consumable. The electrical interface may also be used to identify the consumable from a list of known types. The electrical interface may additionally or alternatively be used to identify when the device/consumable is connected to the base unit.

The base unit may alternatively or additionally be able to detect information about the consumable via an RFID reader, a barcode or QR code reader. This interface may be able to identify a characteristic (e.g., a type) of the consumable. In this respect, the device/consumable may include any one or more of an RFID chip, a barcode or QR code, or memory within which is an identifier, and which can be interrogated via the interface.

The base unit may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The base unit may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the device or the base unit.

In an alternative embodiment of the second mode, the aerosol delivery device may be a non-consumable device in which one or both of the first and second aerosol precursors of the device may be replenished by re-filling the reservoir or storage chamber of the device (rather than replacing the consumable). In this embodiment, the consumable described above may instead be a non-consumable component that is integral with the base unit. For example, the only consumable portion may be the first and/or second aerosol precursor contained in reservoir and storage chamber of the device. Access to the reservoir and/or storage chamber (for re-filling of the aerosol precursor) may be provided via, e.g., an opening to the reservoir and/or storage chamber that is sealable with a closure (e.g., a cap).

The aerosol delivery device may be a smoking substitute device (e.g., an e-cigarette device). The consumable of the aerosol delivery device be a smoking substitute consumable (e.g., an e-cigarette consumable). The aerosol delivery system may be a smoking substitute system (e.g., an e-cigarette system). In a seventh aspect of the second mode, there is provided a method of using a smoking substitute system as described above with respect to the fifth aspect of the second mode, the method comprising engaging the device/consumable with the base unit so as to connect the vaporizer of the device/consumable with the power source of the base unit.

The method may comprise engaging an additive delivery article/flavor pod of the device/consumable with a cartomizer of the device/consumable, such that a flow passage of the additive delivery article/flavor pod is in fluid communication with the vapor outlet of the cartomizer.

In a variation, the present disclosure may generally relate to an aerosol delivery device having a hinged cap for sealing the aerosol delivery device.

According to an eighth aspect of the second mode, there is provided aerosol delivery device comprising: a passive aerosol generator, for passively generating an aerosol from an aerosol precursor; a mouthpiece, fluidly connected to the passive aerosol generator; a reservoir of aerosol precursor, fluidly connected to the passive aerosol generator; and a hinged cap, which is rotatable relative to the mouthpiece, such that the hinged cap is movable between a sealing configuration in which the hinged cap seals the mouthpiece, and an open configuration in which the hinged cap does not seal the mouthpiece.

By sealing the mouthpiece using the hinged cap, the risk of aerosol precursor leaking when the aerosol delivery device is not in use is reduced. Further, the mouthpiece can be at least partially covered by the cap and so maintained at a higher level of sanitation.

Optional features will now be set out. These are applicable singly or in any combination with any aspect of the second mode.

By passive, it may be meant that the passive aerosol generator is capable of generating an aerosol from the aerosol precursor without the use of electricity or heat.

The hinged cap may be rotatable around an axis which is transversal to a longitudinal axis of the aerosol delivery device. The longitudinal axis of the aerosol delivery device may be one which extends from the mouthpiece towards the reservoir of aerosol precursor, or from the mouthpiece towards a main body of the aerosol delivery device.

The hinged cap may include a first hinge and a second hinge, disposed on opposite sides of the aerosol delivery device. Alternatively, the hinged cap may include only one hinge, located on a single side of the aerosol delivery device. The, or each, hinge may be formed of: a protrusion from an outer housing of the aerosol delivery device; and an arm, attached to the protrusion and rotatable relative thereto. The hinged cap may include a first arm attached to the first hinge, and a second arm attached to the second hinge, wherein the arms extend from their respective hinges to a cap portion, and which increase in width towards the cap portion. The cap portion may sit directly above or on the mouthpiece.

The hinged cap may be formed of a resiliently deformable material. In some examples, the hinged cap may be formed from silicone. In the sealing configuration, the hinged cap may sit over an end portion of the aerosol delivery device. This end portion of the aerosol delivery device may be formed by the mouthpiece.

The mouthpiece may have a cross-sectional profile, and the hinged cap may have a corresponding cross-sectional profile. This can allow the hinged cap to better fit to the mouthpiece in the sealing configuration.

The hinged cap may seal the mouthpiece via an interference fit around the mouthpiece. A portion of the hinged cap may extend into a mouthpiece aperture of the mouthpiece to further seal the mouthpiece.

A portion of the passive aerosol generator may be provided within the mouthpiece.

The passive aerosol generator may include a Venturi aperture, and a porous member may be located within the Venturi aperture and fluidly connected to the reservoir of aerosol precursor.

The aerosol precursor may be flavor aerosol precursor and may be substantially nicotine free.

The aerosol delivery device may be a consumable for a smoking substitute device.

The aerosol delivery device may comprise a vapor flow passage for fluid flow therethrough. The vapor flow passage may extend in a longitudinal direction between (and may fluidly connect) an inlet of the aerosol delivery device to an outlet aperture of the aerosol delivery device. The inlet may define an upstream end of the vapor flow passage, whilst the outlet aperture may define a downstream end of the vapor flow passage. The outlet aperture may be at a mouthpiece of the device and may therefore hereinafter be described as a mouthpiece aperture. In this respect, a user may draw fluid (e.g., air) into and through the vapor flow passage of the aerosol delivery device by inhaling at the mouthpiece aperture. The terms "upstream" and "downstream" are used with reference to the direction of airflow (from inlet to outlet) through the device during normal use of the device (i.e., by way of inhalation at the mouthpiece aperture).

The vapor flow passage may comprise a plurality of passage branches that each define a separate airflow path through the aerosol delivery device. For example, in one embodiment of the second mode, the aerosol delivery device may comprise first and second passage branches that are spaced laterally so as to extend along opposite lateral sides of the aerosol delivery device. The first and second passage branches may branch (e.g., in a transverse/radial direction) proximate to the vapor passage inlet, and may merge (i.e., re-join) proximate to the mouthpiece aperture.

In other embodiments of the second mode, at least a portion of the vapor flow passage may comprise an annular transverse-cross sectional shape.

The aerosol delivery device may comprise a tank defining a storage chamber for containing a first aerosol precursor (e.g., a flavor liquid). The first aerosol precursor may, for example, comprise a flavorant having a menthol, licorice, chocolate, fruit flavor (including, e.g., citrus, cherry etc.), vanilla, spice (e.g., ginger, cinnamon) and/or tobacco flavor. The first aerosol precursor may be stored in the form of a free liquid. Alternatively, a porous body may be disposed within the storage chamber, which may contain the first aerosol precursor.

The tank may at least partially define the vapor flow passage. For example, where the vapor flow passage comprises first and second passage branches, the first and second passage branches may be defined between an outer surface of the tank and an inner surface of a housing of the aerosol delivery device (i.e., a space may be formed between the tank and the housing for flow vapor therethrough). Similarly, where at least a portion of the vapor flow passage is annular, the annular portion of the vapor flow passage may be defined between the tank and the housing.

The aerosol delivery device may comprise an air bleed channel configured to allow the bleeding of air into the storage chamber to replace (first) aerosol precursor that is removed from the storage chamber. The air bleed channel may be in fluid communication with the vapor flow passage, such that (e.g., under certain conditions) air from the vapor flow passage can enter the storage chamber through the air bleed channel.

The aerosol delivery device may comprise an aerosol generator in the form of a porous liquid transfer element (i.e., formed of a porous material). As will be described further below, the liquid transfer element may be configured to generate an aerosol in the vapor flow passage. The liquid transfer element, however, may do this in such a way that does not use heat to form the aerosol, and therefore in some embodiments may be referred to as a "passive" aerosol generator.

The liquid transfer element may comprise a conveying portion and an aerosol generating portion. The conveying portion may be elongate and generally cylindrical, and may be at least partially enclosed within one or more internal walls of the aerosol delivery device. The one or more internal walls enclosing the conveying portion may form part of the tank defining the storage chamber. In this respect, the tank may at least partly surround (e.g., may fully surround) the conveying portion of the liquid transfer element. That is, the tank may define a conduit through which the conveying portion passes. Thus, the conveying portion may extend generally longitudinally (e.g., centrally) through a portion of the tank (i.e., through the conduit defined by the tank).

The liquid transfer element may be supported in the aerosol delivery device by the mouthpiece. That is, the mouthpiece may comprise a holder for holding (and gripping) the liquid transfer element in position within the aerosol delivery device.

The aerosol generating portion of the liquid transfer element may be disposed at a downstream end of the conveying portion and may thus define a downstream longitudinal end of the liquid transfer element. The aerosol generating portion may be at least partly located in the vapor flow passage so as to be exposed to airflow within the vapor flow passage. In particular, the aerosol generating portion of the liquid transfer element may extend into an aerosolization chamber forming part of the vapor flow passage. The aerosolization chamber may be located proximate to (and in fluid communication with) the mouthpiece aperture of the device and may define a portion of the vapor flow passage at the first and second passage branches of the vapor flow passage merge. Airflow through the flow passage may pass across or through the aerosol generating portion of the liquid transfer element prior to being discharged through the mouthpiece aperture.

The aerosol generating portion may define an enlarged (e.g., radially enlarged) portion of the liquid transfer element. For example, the aerosol generating portion may be bulb-shaped or bullet-shaped, and may comprise a portion which is wider than the conveying portion. The aerosol generating portion may taper (inwardly) to a tip at a downstream end of the aerosol generating portion (i.e., proximate the outlet/mouthpiece aperture). The aerosol-generating portion may have a flattened downstream end surface. The liquid transfer element may extend into the storage chamber so as to be in contact with (e.g., at least partially submerged in) the first aerosol precursor. In this way, the liquid transfer element may be configured to convey (e.g., via a wicking/capillary action) the first aerosol precursor from the storage chamber to the aerosolization chamber. As will be described further below, this may allow the first aerosol precursor to form an aerosol and be entrained in an airflow passing through aerosolization chamber (i.e., for subsequent receipt in a user's mouth).

The vapor flow passage may be constricted (i.e., narrowed) at the aerosolization chamber. For example, the presence of the aerosol generating portion in the vapor flow passage may create a constricted or narrowed portion of the vapor flow passage (because the aerosol generating portion extends partway across the vapor flow passage). In this respect, the narrowest portion of the vapor flow passage may be at aerosolization chamber (adjacent to the aerosol generating portion of the liquid transfer element). This constriction of the vapor flow passage increases the velocity of air/vapor passing through the aerosolization chamber. In this respect, the constriction may be referred to as a Venturi aperture. The constriction may have a toroidal shape (i.e., extending about the aerosol generating portion of the liquid transfer element). The toroidal shape may, however, be interrupted by supports (e.g., projections, ribs, etc.) protruding inwardly from wall(s) of the vapor flow passage to support the aerosol generating portion in the aerosolization chamber. In addition to increasing the airflow velocity, the constriction reduces the air pressure of the airflow flowing through the constriction (i.e., in the vicinity of the aerosol generating portion). This low pressure and high velocity facilitate the generation of an aerosol from the first aerosol precursor held in the aerosol generating portion (i.e., transferred from the storage chamber by the liquid transfer element). This aerosol, which is hereinafter referred to as the first aerosol, is entrained in the airflow passing through the constriction and is discharged from the mouthpiece aperture of the aerosol delivery device.

The first aerosol may be sized to inhibit pulmonary penetration. The first aerosol may be formed of particles with a mass median aerodynamic diameter that is greater than or equal to 15 microns, e.g., greater than 30 microns, or greater than 50 microns, or may be greater than 60 microns, or may be greater than 70 microns. The first aerosol may be sized for transmission within at least one of a mammalian oral cavity and a mammalian nasal cavity. The first aerosol may be formed by particles having a maximum mass median aerodynamic diameter that is less than 300 microns, or, e.g., less than 200 microns, or less than 100 microns. Such a range of mass median aerodynamic diameter can produce aerosols which are sufficiently small to be entrained in an airflow caused by a user drawing air through the aerosol delivery device and to enter and extend through the oral and or nasal cavity to activate the taste and/or olfactory receptors.

The size of aerosol formed without heating may be typically smaller than that formed by condensation of a vapor.

It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

The above configuration of the aerosol delivery device may be representative of an activated state of the aerosol delivery device. The aerosol delivery device may additionally be configurable in a deactivated state. In the deactivated state, the liquid transfer element may be isolated from the first aerosol precursor. This isolation may, for example, be provided by a plug (e.g., formed of silicon). The plug may be located at an end (i.e., upstream end) of the conduit (defined by the tank) so as to provide a barrier between the first aerosol precursor in the storage chamber and the conveying portion of the liquid transfer element. Alternatively, the aerosol delivery device may comprise a duck bill valve, a split valve or diaphragm; or a sheet of foil isolating the liquid transfer element from the first aerosol precursor.

In the deactivated state, the air bleed channel may be sealed by a sealing element. The sealing element may, for example, be in the form of a bung or plug (e.g., a silicone bung or plug). At least a portion of the bung may be received in the air bleed channel when the aerosol delivery device is in the deactivated state, so as to block the passage of airflow through the air bleed channel. The sealing element may alternatively be in the form of a pierceable membrane (e.g., formed of a metal foil) extending across the air bleed channel.

The aerosol delivery device may comprise a terminal component (e.g., the mouthpiece) that is movable relative to the tank defining the storage chamber. The terminal component/mouthpiece may be movable relative to the air bleed channel. In particular, movement of the terminal component may be in the longitudinal direction of the aerosol delivery device.

The terminal component/mouthpiece may comprise an activation member, which may protrude internally from an internal surface of terminal component/mouthpiece. When the terminal component/mouthpiece is moved longitudinally in an upstream direction, i.e., towards the storage tank, a distal end of the activation member may engage the sealing element so as to move the sealing element (i.e., in the upstream direction) relative to the air bleed channel. This movement of the sealing element may open the air bleed channel, so as to allow airflow therethrough and so as to move the aerosol delivery device to the activated state.

Movement of the terminal component may be achieved through rotation of the hinged cap. That is, the hinged cap may be mechanically linked to the terminal component such that the movement of the hinged cap from the sealed configuration to the open configuration causes the terminal component to activate the aerosol delivery device.

When the sealing element is a bung, the bung may comprise an enlarged end that extends fully across the air bleed channel, and a neck portion that extends only partway across the air bleed channel. Movement of the bung along the air bleed channel by the activation member may cause the enlarged end of the bung to move into the storage chamber such that only the neck portion remains in the air bleed channel. Thus, airflow may be permitted through the air bleed channel between the neck portion and the walls of the air bleed channel.

When the sealing element is a pierceable membrane, the activation member may pierce the pierceable membrane when moved in the upstream direction. To facilitate such piercing, the activation member may be in the form of a blade, or may be pointed.

The movement of the terminal component (e.g., the mouthpiece) may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the first aerosol precursor (i.e., so as to be able to convey the first aerosol precursor to the aerosol generating portion of the liquid transfer element).

The above components of the aerosol delivery device may form a consumable portion of the aerosol delivery device (also referred to herein as an aerosol delivery system), and may collectively be referred to as an additive delivery article or flavor pod of the aerosol delivery device. The aerosol delivery device may further comprise a cartomizer. The additive delivery article/flavor pod may be engageable with the cartomizer, for example, by way of an interference fit, snap-engagement, bayonet locking arrangement, etc. In other embodiments of the second mode, the additive delivery article/flavor pod and cartomizer may be integrally formed (e.g., defining a single consumable article).

The cartomizer may comprise a vaporizing chamber and a vaporizer outlet for fluid flow therethrough. The vaporizer outlet may be fluidly connected to the vapor flow passage of the additive delivery article/flavor pod. The vaporizer outlet and vaporizing chamber may fluidly connect a cartomizer inlet opening and the inlet of the vapor flow passage. Thus, an airflow may be drawn into and through the cartomizer, and subsequently through the additive delivery article/flavor pod.

The aerosol delivery device may comprise a reservoir defined by a container for containing a second aerosol precursor (which may be an e-liquid). The second aerosol precursor may, for example, comprise a base liquid and a physiologically active compound, e.g., nicotine. The base liquid may include an aerosol former such as propylene glycol and/or vegetable glycerin.

At least a portion of the container may be translucent. For example, the container may comprise a window to allow a user to visually assess the quantity of second aerosol precursor in the container. The cartomizer may be referred to as a "clearomizer" if it includes a window. The vaporizer outlet may extend longitudinally through the container, wherein an outlet wall of the vaporizer outlet may define the inner wall of the container. In this respect, the container may surround the vaporizer outlet, such that the container may be generally annular.

The aerosol delivery device may comprise a vaporizer. The vaporizer may be located in the vaporizing chamber.

The vaporizer may comprise a wick. The vaporizer may further comprise a heater. The wick may comprise a porous material. A portion of the wick may be exposed to fluid flow in the vaporizing chamber. The wick may also comprise one or more portions in contact with the second aerosol precursor stored in the reservoir. For example, opposing ends of the wick may protrude into the reservoir and a central portion (between the ends) may extend across the vaporizing chamber so as to be exposed to air flow in the vaporizing chamber. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid/air flowing through the vaporizing chamber. This vapor may subsequently cool to form an aerosol in the vaporizer outlet. This aerosol is hereinafter referred to as the second aerosol. This aerosol generation may be referred to as "active" aerosol generation because it makes use of heat to generate the aerosol.

This second aerosol may subsequently flow from the vaporizer outlet to (and through) the vapor flow passage of the additive delivery article/flavor pod (e.g., when engaged with the cartomizer). Thus, the fluid received through the mouthpiece aperture of the aerosol delivery device may be a combination of the first aerosol and the second aerosol.

The second aerosol generated is sized for pulmonary penetration (i.e., to deliver an active ingredient such as nicotine to the user's lungs). The second aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The second aerosol may also be referred to as a vapor.

The cartomizer may be a consumable part of the aerosol delivery device. For example, the cartomizer may be configured for engagement with a base unit. The cartomizer and the additive delivery article/flavor pod may be a single consumable component of the aerosol delivery device (when integrally formed) or may each define separate consumable components of the aerosol delivery device (when engageable with one another).

Thus, the cartomizer and additive delivery article/flavor pod (whether integral or separable) may define, and will be referred to herein as, a consumable of the aerosol delivery device. The first aerosol precursor and second aerosol precursor may be replenished by replacing a used consumable with an unused consumable. It should be appreciated that some of the features described herein as being part of the consumable may alternatively form part of a base unit for engagement with the consumable.

The base unit and the consumable (e.g., the cartomizer of the consumable) may be configured to be physically coupled together. For example, the consumable may be at least partially received in a recess of the base unit, such that there is snap engagement between the base unit and the consumable.

Alternatively, the base unit and the consumable may be physically coupled together by screwing one onto the other, or through a bayonet fitting.

Thus, the consumable may comprise one or more engagement portions for engaging with a base unit. In this way, one end of the consumable (i.e., the inlet end) may be coupled with the base unit, whilst an opposing end (i.e., the outlet end) of the consumable may define the mouthpiece.

The base unit or the consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery. The consumable may comprise an electrical interface for interfacing with a corresponding electrical interface of the base unit. One or both of the electrical interfaces may include one or more electrical contacts. Thus, when the base unit is engaged with the consumable, the electrical interface may be configured to transfer electrical power from the power source to a heater of the consumable. The electrical interface may also be used to identify the consumable from a list of known types. The electrical interface may additionally or alternatively be used to identify when the consumable is connected to the base unit.

The base unit may alternatively or additionally be able to detect information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier, and which can be interrogated via the interface.

The consumable or base unit may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The consumable or base unit may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the consumable (e.g., the cartomizer or additive delivery article/flavor pod) or the base unit.

In an alternative embodiment of the second mode, the aerosol delivery device may be a non-consumable device in which one or both of the first and second aerosol precursors of the device may be replenished by re-filling the reservoir or storage chamber of the device (rather than replacing the consumable). In this embodiment, the consumable described above may instead be a non-consumable component that is integral with the base unit. Thus, the device may comprise the features of the base unit described above. For example, the only consumable portion may be first and/or second aerosol precursor contained in reservoir and storage chamber of the device. Access to the reservoir and/or storage chamber (for re-filling of the aerosol precursor) may be provided via, e.g., an opening to the reservoir and/or storage chamber that is sealable with a closure (e.g., a cap).

The aerosol delivery device may be a smoking substitute device (e.g., an e-cigarette device). The consumable of the aerosol delivery device be a smoking substitute consumable (e.g., an e-cigarette consumable). In a ninth aspect of the second mode, there is provided a smoking substitute system comprising a base unit having a power source, and a consumable as described above with respect to the eighth aspect of the second mode, the consumable being engageable with the base unit such that a vaporizer of the consumable is connected to the power source of the base unit. The consumable may comprise a cartomizer and an additive delivery article/flavor pod, each as described above with respect to the eighth aspect of the second mode. The cartomizer and additive delivery article/flavor pod may be integrally formed, or may be separate, but engageable with one another.

In a tenth aspect of the second mode, there is provided a method of using a smoking substitute system as described above with respect to the ninth aspect of the second mode, the method comprising engaging the consumable with the base unit so as to connect the vaporizer of the consumable with the power source of the base unit.

The method may comprise engaging an additive delivery article/flavor pod of the consumable with a cartomizer of the consumable, such that a vapor flow passage of the additive delivery article/flavor pod is in fluid communication with the vaporizer outlet of the cartomizer.

The disclosure includes the combination of the aspects and preferred features described except where such a combination is clearly impermissible or expressly avoided.

Third Mode: An Aerosol Delivery Device Configured to Reduce Leakage by Including an Absorbent Member to Absorb Condensed e-Liquid Vapor.

Generally, a third mode of the present disclosure relates to an aerosol delivery device configured to reduce leakage by including an absorbent member to absorb condensed e-liquid vapor.

According to a first aspect of the third mode, there is provided aerosol delivery device comprising: a container defining a reservoir for storing a liquid aerosol precursor; a vaporization chamber for vaporizing the liquid aerosol precursor; a vapor outlet extending from the vaporizing chamber to a vapor flow passage, the vapor flow passage being in fluid communication with a mouthpiece aperture; and an absorbent member for absorbing condensed vapor within the vapor flow passage, wherein there is a deflection between the vapor outlet and the vapor flow passage and wherein the absorbent member is provided proximal the deflection.

Vapor is generated within the vaporization chamber and is drawn through the vapor outlet into the vapor flow passage. The vapor typically slows at any deflections within the vapor flow passage and condensate will form on inner surfaces of the device in the vicinity of the deflection(s). By providing an absorbent member in the vicinity of the deflection, any condensate can be collected and retained within the absorbent member to avoid its leakage from the device.

Optional features will now be set out. These are applicable singly or in any combination with any aspect of the third mode.

In some embodiments of the third mode, the absorbent member is a planar pad. The absorbent member (e.g., the planar pad) may extend transversely within the device, i.e., may extend within the device perpendicular to the longitudinal axis of the device. The absorbent member may extend (e.g., transversely) across the entire transverse dimension (width) of the device.

The absorbent member (e.g., pad) may be positioned within the device upstream of the deflection and/or upstream of the vapor flow passage.

The terms "upstream" and "downstream" are used with reference to the direction of airflow through the device during normal use of the device (i.e., by way of inhalation at the mouthpiece aperture).

In some embodiments of the third mode, the vapor outlet may extend in a substantially longitudinal direction, e.g., it may be aligned with the longitudinal axis of the device. In such embodiments of the third mode, the absorbent member may extend within the device substantially perpendicularly to the vapor outlet. It may comprise an aperture, e.g., a central/axial aperture allowing fluid communication between the vapor outlet and the vapor flow passage through the aperture.

The vapor flow passage may comprise a transverse portion proximal the vapor outlet such that the deflection is provided between the vapor outlet and the transverse portion of the vapor flow passage. The absorbent member/pad may extend in parallel alignment within the transverse portion of the vapor flow passage. In this way, condensate within the transverse vapor flow passage may be collected and retained within the absorbent member/pad.

The vaporizing chamber, vaporizer outlet and container/reservoir may together form part of a cartomizer. The vaporizer outlet and vaporizing chamber may fluidly connect a cartomizer inlet opening and the vapor flow passage. Thus, an airflow may be drawn into and through the cartomizer.

The aerosol delivery device/cartomizer comprises a reservoir defined by a container for containing the aerosol precursor (which may be an e-liquid). The aerosol precursor may, for example, comprise a base liquid and a physiologically active compound, e.g., nicotine. The base liquid may include an aerosol former such as propylene glycol and/or vegetable glycerin.

At least a portion of the container may be translucent. For example, the container may comprise a window to allow a user to visually assess the quantity of aerosol precursor in the container. The cartomizer may be referred to as a "clearomizer" if it includes a window. The vaporizer outlet may extend longitudinally through the container, wherein an outlet wall of the vaporizer outlet may define the inner wall of the container. In this respect, the container may surround the vaporizer outlet, such that the container may be generally annular.

The aerosol delivery device (i.e., the cartomizer) may comprise a vaporizer. The vaporizer may be located in the vaporizing chamber.

The vaporizer may comprise a wick. The vaporizer may further comprise a heater. The wick may comprise a porous material. A portion of the wick may be exposed to fluid flow in the vaporizing chamber. The wick may also comprise one or more portions in contact with the aerosol precursor stored in the reservoir. For example, opposing ends of the wick may protrude into the reservoir and a central portion (between the ends) may extend across the vaporizing chamber so as to be exposed to air flow in the vaporizing chamber. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the reservoir) to be heated so as to form a vapor and become entrained in fluid/air flowing through the vaporizing chamber. This vapor may subsequently cool to form an aerosol in the vaporizer outlet. This aerosol generation may be referred to as "active" aerosol generation because it makes use of heat to generate the aerosol.

This aerosol may subsequently flow from the vaporizer outlet into the vapor flow passage.

The aerosol generated is sized for pulmonary penetration (i.e., to deliver an active ingredient such as nicotine to the user's lungs). The aerosol is formed of particles having a mass median aerodynamic diameter of less than or equal to 10 microns, preferably less than 8 microns, more preferably less than 5 microns, yet more preferably less than 1 micron. Such sized aerosols tend to penetrate into a human user's pulmonary system, with smaller aerosols generally penetrating the lungs more easily. The aerosol may also be referred to as a vapor.

The aerosol delivery device may further comprise a delivery article/pod, e.g., an additive delivery article/flavor pod which may be engageable with the cartomizer, for example, by way of an interference fit, snap-engagement, bayonet locking arrangement, etc. In other embodiments of the third mode, the (additive) delivery article/(flavor) pod and cartomizer may be integrally formed.

The (additive) delivery article/(flavor) pod may comprise a tank defining a storage chamber for containing a further aerosol precursor (e.g., a flavor liquid). The further aerosol precursor may, for example, comprise a flavorant having a menthol, licorice, chocolate, fruit flavor (including, e.g., citrus, cherry etc.), vanilla, spice (e.g., ginger, cinnamon) and/or tobacco flavor.

The further aerosol precursor may be stored in the form of a free liquid. Alternatively, a porous body may be disposed within the storage chamber, which may contain the further aerosol precursor.

The vapor flow passage may extend through a device housing to the mouthpiece. The tank may at least partially define the vapor flow passage. For example, the vapor flow passage may be defined between an outer surface of the tank and an inner surface of the device housing. The device housing may be integral with the mouthpiece.

The aerosol delivery device may comprise an air bleed channel configured to allow the bleeding of air into the storage chamber to replace (further) aerosol precursor that is removed from the storage chamber.

The air bleed channel may be in fluid communication with the vapor flow passage, such that (e.g., under certain conditions) air from the vapor flow passage can enter the storage chamber through the air bleed channel.

The aerosol delivery device comprises a vapor flow passage for fluid flow therethrough. The vapor flow passage may extend generally in a longitudinal direction from an upstream end at the vapor outlet (in the cartomizer) and the mouthpiece aperture may define a downstream end of the vapor flow passage (in the (additive) delivery article/(flavor) pod). A user may draw fluid (e.g., air) into and through the cartomizer and vapor flow passage of the aerosol delivery device by inhaling at the mouthpiece aperture.

The vapor flow passage may comprise one or more deflections. As discussed above, it may comprise a transverse portion proximal the vapor outlet such that there is a deflection between the vapor outlet and the transverse portion of the vapor flow passage. The absorbent pad may be provided proximal this deflection.

The vapor flow passage may then deflect into a generally longitudinal portion downstream of the transverse portion. The longitudinal portion may extend between the device housing and the tank. The vapor flow passage may then deflect again (e.g., radially) at an upper (downstream) surface of the tank within the mouthpiece, towards the mouthpiece aperture.

The vapor flow passage may be a single (annular) flow passage around the tank, or it may comprise two branches which split around the tank and re-join within the mouthpiece.

The aerosol delivery device (i.e., the (additive) delivery article/(flavor) pod) may further comprise an aerosol generator in the form of a porous liquid transfer element (i.e., formed of a porous material). As will be described further below, the liquid transfer element may be configured to generate a further aerosol in the vapor flow passage. The liquid transfer element, however, may do this in such a way that does not use heat to form the aerosol, and therefore in some embodiments may be referred to as a "passive" aerosol generator. The liquid transfer element may comprise a conveying portion and an aerosol generating portion. The conveying portion may be elongate and generally cylindrical, and may be at least partially enclosed within one or more internal walls of the aerosol delivery device. The one or more internal walls enclosing the conveying portion may form part of the tank defining the storage chamber. In this respect, the tank may at least partly surround (e.g., may fully surround) the conveying portion of the liquid transfer element. That is, the tank may define a conduit through which the conveying portion passes. Thus, the conveying portion may extend generally longitudinally (e.g., centrally) through a portion of the tank (i.e., through the conduit defined by the tank).

The liquid transfer element may be supported in the aerosol delivery device (i.e., in the (additive) delivery article/(flavor) pod) by the mouthpiece. That is, the mouthpiece may comprise a collar for holding (and gripping) the liquid transfer element in position within the aerosol delivery device.

The aerosol generating portion of the liquid transfer element may be disposed at a downstream end of the conveying portion and may thus define a downstream longitudinal end of the liquid transfer element. The aerosol generating portion may be at least partly located in the vapor flow passage so as to be exposed to airflow within the vapor flow passage. In particular, the aerosol generating portion of the liquid transfer element may extend into an aerosolization chamber forming part of the vapor flow passage. The aerosolization chamber may be located proximate to (and in fluid communication with) the mouthpiece aperture of the device and may define a portion of the vapor flow passage. Airflow through the flow passage may pass across or through the aerosol generating portion of the liquid transfer element within the aerosolization chamber prior to being discharged through the mouthpiece aperture. The aerosol generating portion may define an enlarged (e.g., radially enlarged) portion of the liquid transfer element. For example, the aerosol generating portion may be bulb-shaped or bullet-shaped, and may comprise a portion which is wider than the conveying portion. The aerosol generating portion may taper (inwardly) to a tip at a downstream end of the aerosol generating portion (i.e., proximate the outlet/mouthpiece aperture). The aerosol-generating portion may have a flattened downstream end surface.

The liquid transfer element may extend into the storage chamber so as to be in contact with (e.g., at least partially submerged in) the further aerosol precursor. In this way, the liquid transfer element may be configured to convey (e.g., via a wicking/capillary action) the further aerosol precursor from the storage chamber to the aerosolization chamber. As will be described further below, this may allow the further aerosol precursor to form an aerosol and be entrained in an airflow passing through the aerosolization chamber (i.e., for subsequent receipt in a user's mouth). Thus, the fluid received through the mouthpiece aperture of the aerosol delivery device may be a combination of the aerosol and the further aerosol.

The vapor flow passage may be constricted (i.e., narrowed) at the aerosolization chamber. For example, the presence of the aerosol generating portion in the vapor flow passage may create a constricted or narrowed portion of the vapor flow passage (because the aerosol generating portion extends partway across the vapor flow passage). In this respect, the narrowest portion of the vapor flow passage may be at aerosolization chamber (adjacent to the aerosol generating portion of the liquid transfer element). This constriction of the vapor flow passage increases the velocity of air/vapor passing through the aerosolization chamber. In this respect, the constriction may be referred to as a Venturi aperture. The constriction may have a toroidal shape (i.e., extending about the aerosol generating portion of the liquid transfer element). The toroidal shape may, however, be interrupted by supports (e.g., projections, ribs, etc.) protruding inwardly from wall(s) of the vapor flow passage to support the aerosol generating portion in the aerosolization chamber.

In addition to increasing the airflow velocity, the constriction reduces the air pressure of the airflow flowing through the constriction (i.e., in the vicinity of the aerosol generating portion). This low pressure and high velocity facilitate the generation of an aerosol from the further aerosol precursor held in the aerosol generating portion (i.e., transferred from the storage chamber by the liquid transfer element). This aerosol, which is hereinafter referred to as the further aerosol, is entrained in the airflow passing through the constriction and is discharged from the mouthpiece aperture of the aerosol delivery device.

The further aerosol may be sized to inhibit pulmonary penetration. The further aerosol may be formed of particles with a mass median aerodynamic diameter that is greater than or equal to 15 microns, e.g., greater than 30 microns, or greater than 50 microns, or may be greater than 60 microns, or may be greater than 70 microns.

The further aerosol may be sized for transmission within at least one of a mammalian oral cavity and a mammalian nasal cavity. The further aerosol may be formed by particles having a maximum mass median aerodynamic diameter that is less than 300 microns, or, e.g., less than 200 microns, or less than 100 microns. Such a range of mass median aerodynamic diameter can produce aerosols which are sufficiently small to be entrained in an airflow caused by a user drawing air through the aerosol delivery device and to enter and extend through the oral and or nasal cavity to activate the taste and/or olfactory receptors. The size of aerosol formed without heating may be typically smaller than that formed by condensation of a vapor.

It is noted that the mass median aerodynamic diameter is a statistical measurement of the size of the particles/droplets in an aerosol. That is, the mass median aerodynamic diameter quantifies the size of the droplets that together form the aerosol. The mass median aerodynamic diameter may be defined as the diameter at which 50% of the particles/droplets by mass in the aerosol are larger than the mass median aerodynamic diameter and 50% of the particles/droplets by mass in the aerosol are smaller than the mass median aerodynamic diameter. The "size of the aerosol", as may be used herein, refers to the size of the particles/droplets that are comprised in the particular aerosol.

The above configuration of the aerosol delivery device may be representative of an activated state of the aerosol delivery device. The aerosol delivery device may additionally be configurable in a deactivated state. In the deactivated state, the liquid transfer element may be isolated from the further aerosol precursor. This isolation may, for example, be provided by a plug (e.g., formed of silicon). The plug may be located at an end (i.e., upstream end) of the conduit (defined by the tank) so as to provide a barrier between the further aerosol precursor in the storage chamber and the conveying portion of the liquid transfer element. Alternatively, the aerosol delivery device may comprise a duck bill valve, a split valve or diaphragm; or a sheet of foil isolating the liquid transfer element from the further aerosol precursor.

In the deactivated state, the air bleed channel may be sealed by a sealing element. The sealing element may, for example, be in the form of a bung or plug (e.g., a silicone bung or plug). At least a portion of the bung may be received in the air bleed channel when the aerosol delivery device is in the deactivated state, so as to block the passage of airflow through the air bleed channel. The sealing element may alternatively be in the form of a pierceable membrane (e.g., formed of a metal foil) extending across the air bleed channel.

The aerosol delivery device may comprise a mouthpiece/device housing that is movable relative to the tank defining the storage chamber. The mouthpiece/device housing may be movable relative to the air bleed channel. In particular, movement of the mouthpiece/device housing may be in the longitudinal direction of the aerosol delivery device.

The mouthpiece may comprise an activation member, which may protrude internally from an internal surface of the mouthpiece. When the mouthpiece/device housing is moved longitudinally in an upstream direction, i.e., towards the storage tank, a distal end of the activation member may engage the sealing element so as to move the sealing element (i.e., in the upstream direction) relative to the air bleed channel. This movement of the sealing element may open the air bleed channel, so as to allow airflow therethrough and so as to move the aerosol delivery device to the activated state.

When the sealing element is a bung, the bung may comprise an enlarged end that extends fully across the air bleed channel, and a neck portion that extends only partway across the air bleed channel.

Movement of the bung along the air bleed channel by the activation member may cause the enlarged end of the bung to move into the storage chamber such that only the neck portion remains in the air bleed channel. Thus, airflow may be permitted through the air bleed channel between the neck portion and the walls of the air bleed channel.

When the sealing element is a pierceable membrane, the activation member may pierce the pierceable membrane when moved in the upstream direction. To facilitate such piercing, the activation member may be in the form of a blade, or may be pointed.

The movement of the mouthpiece/device housing may also cause longitudinal upstream movement of the liquid transfer element through the conduit defined by the tank. The conveying portion of the liquid transfer element may engage the plug (or duck bill valve, split valve, etc.) so as to disengage the plug from the end of the conduit. Removal of the plug in this way means that the conveying portion comes into contact with the further aerosol precursor (i.e., so as to be able to convey the further aerosol precursor to the aerosol generating portion of the liquid transfer element).

The device housing may comprise at opposing apertures for engagement with respective lugs provided on the cartomizer, e.g., on the container to secure the device housing to the cartomizer. There may be two sets of longitudinally spaced lugs and two sets of longitudinally spaced apertures with only the downstream lugs engaged within the upstream apertures when the device is in its deactivated state. Movement of the mouthpiece/device housing cases engagement of the upstream lugs in the upstream apertures and the downstream lugs in the downstream apertures.

The (additive) delivery article ((flavor) pod) and/or cartomizer may be a consumable part of an aerosol delivery system. In this regard, the device may be a termed "a consumable".

Accordingly, in a second aspect of the third mode, there is provided an aerosol delivery system comprising a base unit having a power source, and a device as described above with respect to the first aspect of the third mode. The device may be engageable with the base unit such that the vaporizer of the device/consumable is connected to the power source of the base unit.

For example, the cartomizer may be configured for engagement with the base unit. The cartomizer and the (additive) delivery article/(flavor) pod may be a single consumable component of the aerosol delivery system (when integrally formed) or may each define separate consumable components of the aerosol delivery system (when engageable with one another).

The aerosol precursor(s) may be replenished by replacing a used consumable with an unused consumable.

The base unit and the device/consumable (e.g., the cartomizer of the consumable) may be configured to be physically coupled together. For example, the device/consumable may be at least partially received in a recess of the base unit, such that there is snap engagement between the base unit and the consumable. Alternatively, the base unit and the device/consumable may be physically coupled together by screwing one onto the other, or through a bayonet fitting.

Thus, the device/consumable may comprise one or more engagement portions for engaging with a base unit. In this way, one end of the device/consumable (i.e., the inlet end) may be coupled with the base unit, whilst an opposing end (i.e., the outlet end) of the consumable may define the mouthpiece.

The base unit or the device/consumable may comprise a power source or be connectable to a power source. The power source may be electrically connected (or connectable) to the heater. The power source may be a battery (e.g., a rechargeable battery). An external electrical connector in the form of, e.g., a USB port may be provided for recharging this battery. The device/consumable (e.g., the cartomizer) may comprise an electrical interface for interfacing with a corresponding electrical interface of the base unit. One or both of the electrical interfaces may include one or more electrical contacts. Thus, when the base unit is engaged with the consumable/cartomizer, the electrical interface may be configured to transfer electrical power from the power source to a heater of the device/consumable/cartomizer. The electrical interface may also be used to identify the consumable from a list of known types. The electrical interface may additionally or alternatively be used to identify when the device/consumable/cartomizer is connected to the base unit.

The base unit may alternatively or additionally be able to detect information about the consumable via an RFID reader, a barcode or QR code reader. This interface may be able to identify a characteristic (e.g., a type) of the consumable. In this respect, the device/consumable may include any one or more of an RFID chip, a barcode or QR code, or memory within which is an identifier, and which can be interrogated via the interface.

The base unit may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The base unit may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the device or the base unit.

In an alternative embodiment of the third mode, the aerosol delivery device may be a non-consumable device in which one or both of the aerosol precursors of the device may be replenished by re-filling the reservoir or storage chamber of the device (rather than replacing the consumable). In this embodiment, the consumable described above may instead be a non-consumable component that is integral with the base unit. For example, the only consumable portion may be the aerosol precursor(s) contained in reservoir and storage chamber of the device. Access to the reservoir and/or storage chamber (for re-filling of the aerosol precursors) may be provided via, e.g., an opening to the reservoir and/or storage chamber that is sealable with a closure (e.g., a cap).

The aerosol delivery device may be a smoking substitute device (e.g., an e-cigarette device). The consumable of the aerosol delivery device be a smoking substitute consumable (e.g., an e-cigarette consumable). The aerosol delivery system may be a smoking substitute system (e.g., an e-cigarette system).

In a third aspect of the third mode, there is provided a method of using a smoking substitute system as described above with respect to the second aspect of the third mode, the method comprising engaging the device/consumable with the base unit so as to connect the vaporizer of the device/consumable with the power source of the base unit.

The method may comprise engaging an additive delivery article/flavor pod of the device/consumable with a cartomizer of the device/consumable, such that a vapor flow passage of the additive delivery article/flavor pod is in fluid communication with the vaporizer outlet of the cartomizer.

The disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE INVENTION

Aspects and embodiments of the present disclosure will now be discussed with reference to the accompanying figures. Further aspects and embodiments will be apparent to those skilled in the art.

First Mode: An Aerosol Delivery Device in which Aerosol Precursor from a Liquid Transfer Element Forms an Obstruction in an Air Bleed Channel to Reduce Flow Through the Air Bleed Channel.

Figure 1A:
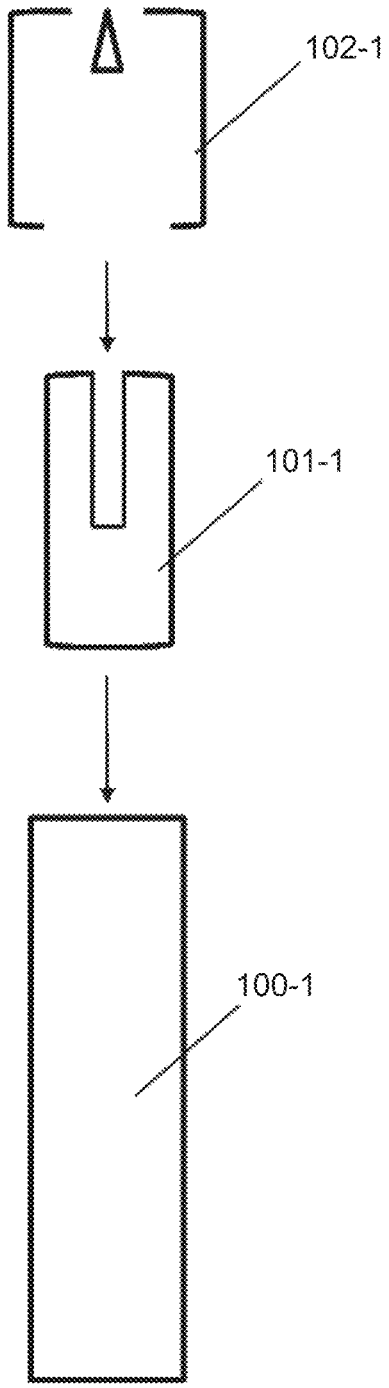
FIG. 1A and FIG. 1B is a schematic drawing of an aerosol delivery device according to a first embodiment of a first mode.
Figure 1B:
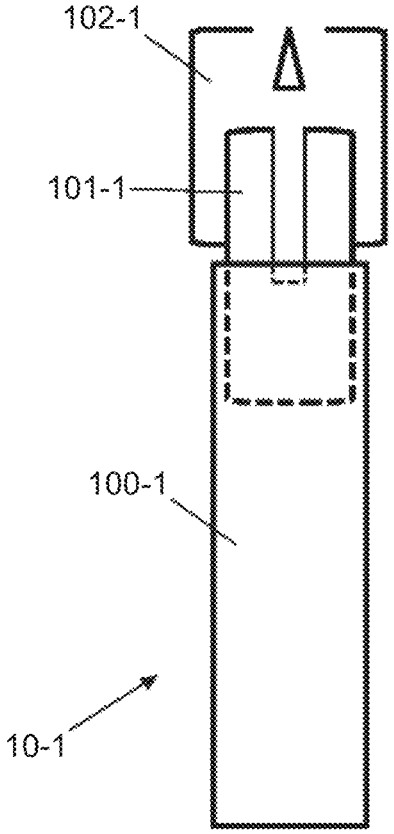

Referring to FIG. 1A and FIG. 1B, there is shown a schematic view of an aerosol delivery device, according to a first embodiment of a first mode, in the form of a smoking substitute device 10-1. In this example, the smoking substitute device 10-1 comprises a cartomizer 101-1 and an additive delivery article in the form of a flavor pod 102-1 connected to a base unit 100-1. In this example, the base unit 100-1 includes elements of the smoking substitute device 10-1 such as a battery, an electronic controller, and a pressure transducer (not shown). The cartomizer 101-1 may engage with the base unit 100-1 via a push-fit engagement, a screw-thread engagement, or a bayonet fit, for example. A cartomizer may also be referred to as a "pod".

The flavor pod 102-1 is configured to engage with the cartomizer 101-1 and thus with the base unit 100-1. The flavor pod 102-1 may engage with the cartomizer 101-1 via a push-fit engagement, a screw-thread engagement, or a bayonet fit, for example. FIG. 1B illustrates the cartomizer 101-1 engaged with the base unit 100-1, and the flavor pod 102-1 engaged with the cartomizer 101-1. As will be appreciated, in this example, the cartomizer 101-1 and the flavor pod 102-1 are distinct elements.

As will be appreciated from the following description, in other embodiments the cartomizer 101-1 and the flavor pod 102-1 may be combined into a single component that implements the combined functionality of the cartomizer 101-1 and flavor pod 102-1. Such a single component may also be referred to as an aerosol delivery device. In other examples, the cartomizer may be absent, with only a flavor pod 102-1 present.

Figure 2A:
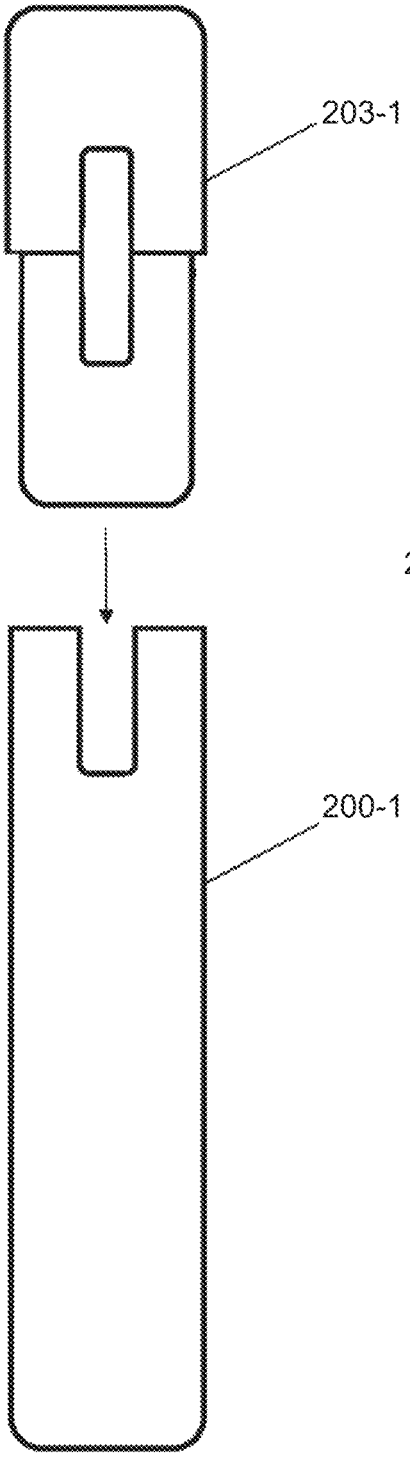
FIG. 2A and FIG. 2B is a schematic drawing of an aerosol delivery device according to a second embodiment of the first mode.
Figure 2B:
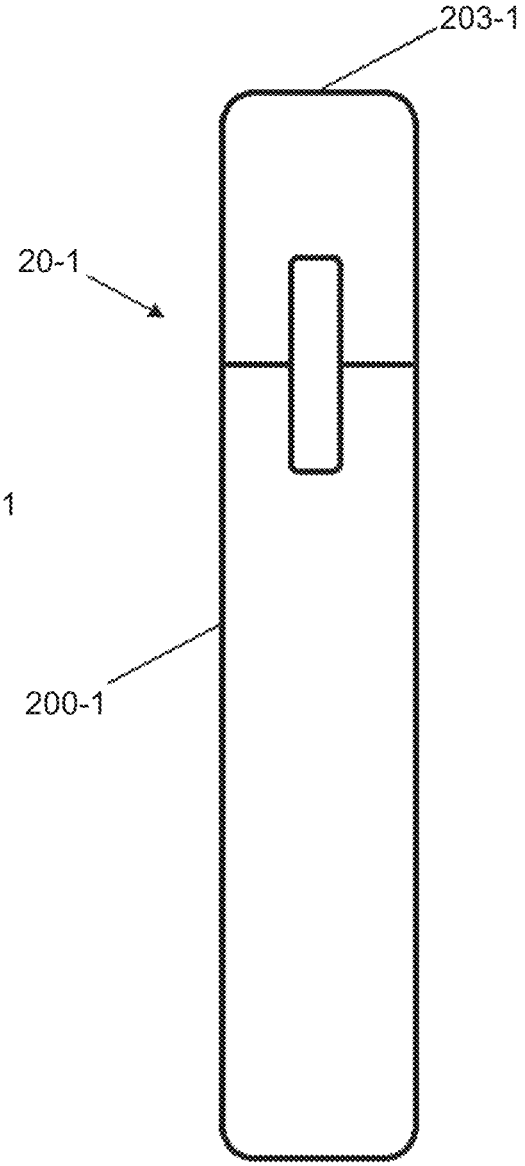

As is set forth above, reference to a "consumable" component may mean that the component is intended to be used once until exhausted, and then disposed of as waste or returned to a manufacturer for reprocessing. Referring to FIG. 2A and FIG. 2B, there is shown a smoking substitute device 20-1, according to a second embodiment of the first mode, comprising a base unit 200-1 and a consumable 203-1. The consumable 203-1 combines the functionality of the cartomizer 101-1 and the flavor pod 102-1. In FIG. 2A, the consumable 203-1 and the base unit 200-1 are shown separated from one another. In FIG. 2B, the consumable 203-1 and the base unit 200-1 are engaged with each other to form the smoking substitute device 20-1.

Figure 3A:
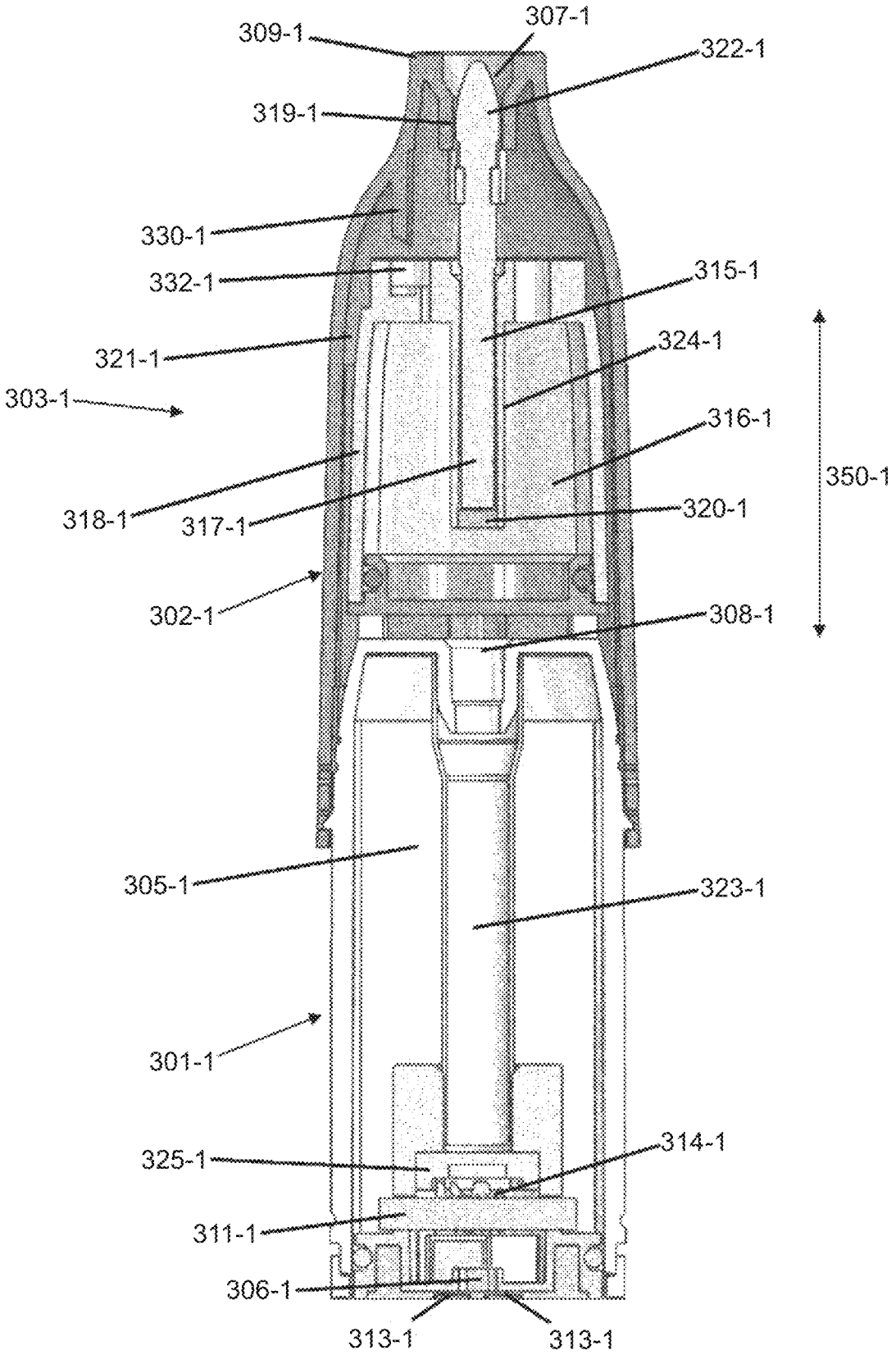
FIG. 3A is a cross-sectional view of a consumable according to a third embodiment of the first mode in a deactivated state.

Referring to FIG. 3A, there is shown a consumable 303-1, according to a third embodiment of the first mode, engageable with a base unit (not shown) via a push-fit engagement. The consumable 303-1 is shown in a deactivated state. The consumable 303-1 may be considered to have two portions—a cartomizer portion 301-1 and flavor pod portion 302-1 (i.e., additive delivery device), both of which are located within a single consumable component 303-1 (as in FIG. 2A and FIG. 2B). It should, however, be appreciated that in a variation, the cartomizer portion 301-1 and flavor pod portion 302-1 may be separate (but engageable) components.

The consumable 303-1 includes an upstream cartomizer inlet opening 306-1 and a downstream mouthpiece aperture 307-1 (i.e., defining an outlet of the consumable 303-1). In other examples a plurality of inlets and/or outlets are included. Between, and fluidly connecting, the inlet opening 306-1 and the mouthpiece aperture 307-1 there is an airflow passage 308-1. This airflow passage 308-1 is formed (in a downstream flow direction) of a vaporizing chamber 325-1 of the cartomizer, a vapor outlet 323-1 (also of the cartomizer) and a downstream vapor flow passage 321-1 of the flavor pod portion 302-1. The mouthpiece aperture 307-1 is located at the mouthpiece 309-1 of the consumable 303-1.

As above, the consumable 303-1 includes a flavor pod portion 302-1. The flavor pod portion 302-1 is configured to generate a first (flavor) aerosol for output from the mouthpiece aperture 307-1. The flavor pod portion 302-1 of the consumable 303-1 includes a liquid transfer element 315-1. This liquid transfer element 315-1 acts as a passive aerosol generator (i.e., an aerosol generator which does not use heat to form the aerosol, also referred to as a "first aerosol generator" herein), and is formed of a porous material. The liquid transfer element 315-1 comprises a conveying portion 317-1 and an aerosol generating portion 322-1, which is located in the vapor flow passage 321-1. In this example, the aerosol generating portion 322-1 is a porous nib.

When activated, as discussed in more detail below, a storage chamber 316-1 (defined by a tank 318-1) for storing a first aerosol precursor (i.e., a liquid comprising a flavorant) is fluidly connected to the liquid transfer element 315-1. The first aerosol precursor, in this embodiment, is stored in a porous body within the storage chamber 316-1 (but may be a free liquid). In the activated state, the liquid transfer element 315-1 is in contact with the first aerosol precursor stored in the storage chamber 316-1 by way of contact with the porous body/free liquid.

The liquid transfer element 315-1 comprises an aerosol generating portion 322-1 and a conveying portion 317-1. The aerosol generating portion 322-1 is located at a downstream end (top of FIG. 3A) of the liquid transfer element 315-1, whilst the conveying portion 317-1 forms the remainder of the liquid transfer element 315-1. The conveying portion 317-1 is elongate and substantially cylindrical. The aerosol generating portion 322-1 is bulb/bullet-shaped, and comprises a portion which is wider (has a greater radius) than the conveying portion 317-1. The aerosol generating portion 322-1 tapers to a tip at a downstream end of the liquid transfer element 315-1. In other examples the liquid transfer element 315-1 comprises a conveying portion but not an aerosol generating portion, and the conveying portion is configured to transfer liquid to a separate aerosol generator.

The liquid transfer element 315-1 extends into and through the storage chamber 316-1, such that the conveying portion 317-1 is in contact with the contents of the storage chamber 316-1. In particular, an inner wall of the tank 318-1 defines a conduit 324-1, through which the liquid transfer element 315-1 extends. The liquid transfer element 315-1 and the conduit 324-1 are located in a substantially central position within the storage chamber 216-1 and are substantially parallel to a central longitudinal axis of the consumable 303-1.

The porous nature of the liquid transfer element 315-1 means that first aerosol precursor in the storage chamber 316-1 is drawn into the liquid transfer element 315-1. As the first aerosol precursor in the liquid transfer element 315-1 is depleted in use, further aerosol precursor is drawn from the storage chamber 316-1 into the liquid transfer element 315-1 via a wicking action.

Before activation, the storage chamber 316-1 is fluidly isolated from the liquid transfer element 315-1 by a barrier arrangement. In this example, the isolation is achieved via a plug 320-1 (preferably formed from silicone) located at one end of a conduit 324-1 surrounding the liquid transfer element 315-1. In other examples, the plug may be replaced by any one of: a duck bill valve; a split valve or diaphragm; or a sheet of foil.

The storage chamber 316-1 further includes an air bleed channel 332-1, which in the deactivated state is sealed by a pierceable membrane (preferably made from foil). Activation (or piercing) member 330-1, which projects inwardly from the mouthpiece 309-1, and may take the form of a blade, pierces the pierceable membrane and opens the air bleed channel 332-1 when the consumable is moved to the activated state (as is discussed in more detail below).

The aerosol generating portion 322-1 is located within the vapor flow passage 321-1 that extends through the flavor pod portion 302-1. The aerosol generating portion 322-1, by occupying a portion of the vapor flow passage 321-1, constricts or narrows the vapor flow passage 321-1. This constricted or narrowed portion of the vapor flow passage 321-1 defines an aerosolization chamber 319-1 of the consumable 303-1. The aerosolization chamber 319-1, which is adjacent the aerosol generating portion 322-1, is the narrowest portion of the vapor flow passage 321-1. The constriction of the vapor flow passage 321-1 at the aerosolization chamber 319-1 results in increased air velocity and a corresponding reduction in air pressure of the air flowing therethrough and thus may be referred to as a Venturi aperture. The aerosolization chamber 319-1 is generally toroidal in shape (extending circumferentially about the aerosol generating portion 322-1), but this toroidal shape may include one or more interruptions where supports extend inwardly to contact the aerosol generating portion 322-1 and to support the aerosol generating portion 322-1 within the aerosolization chamber 319-1. The cartomizer portion 301-1 of the consumable 303-1 includes a reservoir 305-1 (defined by a container) for storing a second aerosol precursor (i.e., e-liquid, which may contain nicotine). A wick 311-1 extends into the reservoir so as to be in contact with (i.e., partially submerged in) the second aerosol precursor. The wick 311-1 is formed from a porous wicking material (e.g., a polymer) that draws the second aerosol precursor from the reservoir 305-1 into a central region of the wick 311-1 that is located in the vaporizing chamber 325-1. A heater 314-1 is a configured to heat the central region of the wick 311-1. The heater 314-1 includes a resistive heating filament that is coiled around the central region of the wick 311-1. The wick 311-1 and the heater 314-1 generally define a vaporizer, and together with the reservoir 305-1 act as an active aerosol generator. The vaporizer (i.e., wick 311-1 and heater 314-1) and aerosol generating portion 322-1 are both at least partially located within the airflow passage 308-1, with the aerosol generating portion 322-1 being downstream of the vaporizer.

Figure 3B:
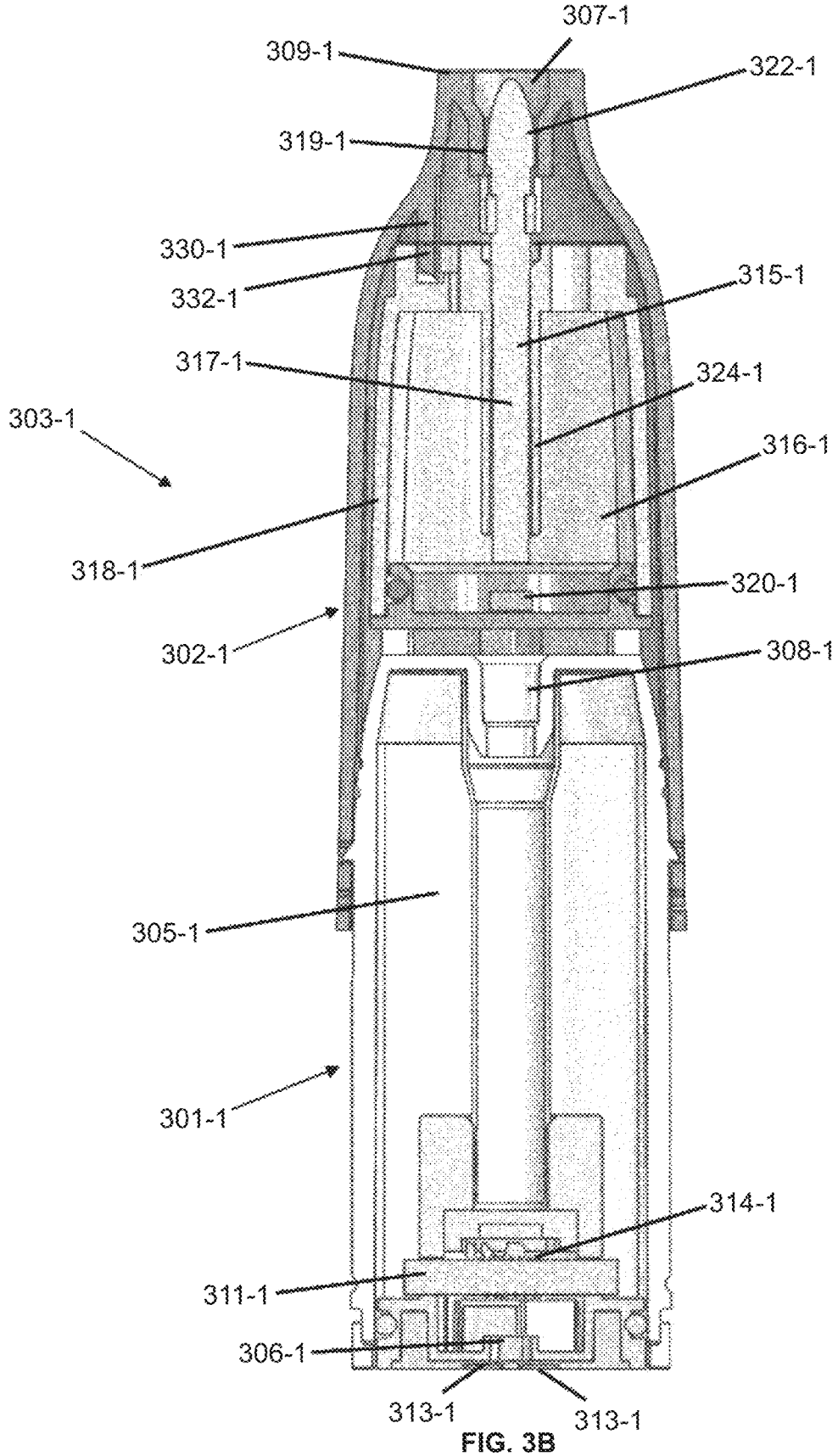
FIG. 3B is a cross-sectional view of the consumable of FIG. 3A in an activated state.

So that the consumable 303-1 may be supplied with electrical power for activation of the heater 314-1, the consumable 303-1 includes a pair of consumable electrical contacts 313-1. The consumable electrical contacts 313-1 are configured for electrical connection to a corresponding pair of electrical supply contacts in the base unit (not shown). The consumable electrical contacts 313-1 are electrically connected to the electrical supply contacts (not shown) when the consumable 303-1 is engaged with the base unit. The base unit includes an electrical power source, for example a battery. FIG. 3B shows the consumable 303-1 of FIG. 3A in an activated state. To transition from the deactivated state to the activated state, mouthpiece 309-1 is moved along a central longitudinal axis 350-1 in an upstream direction towards cartomizer portion 301-1. The mouthpiece 309-1 is fixed by a collar to the conveying portion 317-1 of the liquid transfer element 315-1 and therefore liquid transfer element 315-1 moves with the mouthpiece 309-1. The mouthpiece 309-1 and liquid transfer element 315-1 are moved relative to the tank 318-1.

When the mouthpiece 309-1 is moved upstream, activation/piercing member 330-1 contacts and pierces a sealing element in the form of a pierceable membrane extending across the air bleed channel 332-1 thereby fluidly connecting the vapor flow passage 321-1 the storage chamber 316-1. This allows air from the vapor flow passage 321-1 to enter the storage chamber 316-1 as aerosol precursor is removed from the storage chamber 316-1 by the liquid transfer element 315-1.

In addition to piercing of the membrane by the piercing member 330-1, liquid transfer element 315-1 pushes on, and moves, barrier element 320-1 (in the form of plug 320-1) out of the conduit 324-1 which then allows liquid transfer element 315-1 to come into contact with the first aerosol precursor stored in the storage chamber 316-1. The plug 320-1 may then be unconstrained within the storage chamber, or may be pushed by liquid transfer element 315-1 into a holding location.

Once activated, and in use, a user draws (or "sucks", "pulls", or "puffs") on the mouthpiece 309-1 of the consumable 303-1, which causes a drop in air pressure at the mouthpiece aperture 307-1, thereby generating air flow through the inlet opening 306-1, along the airflow passage 308-1, out of the mouthpiece aperture 307-1 and into the user's mouth. When the heater 314-1 is activated by passing an electric current through the heating filament in response to the user drawing on the mouthpiece 309-1 (the drawing of air may be detected by a pressure transducer), the e-liquid located in the wick 311-1 adjacent to the heating filament is heated and vaporized to form a vapor in the vaporizing chamber 325-1. The vapor condenses to form the second aerosol within the vaporizer outlet 323-1. The second aerosol is entrained in an airflow along the vapor flow passage 321-1 to the mouthpiece aperture 307-1 for inhalation by the user when the user draws on the mouthpiece 309-1.

The base unit supplies electrical current to the consumable electrical contacts (not shown). This causes an electric current flow through the heating filament of the heater 314-1 and the heating filament heats up. As described, the heating of the heating filament causes vaporization of the e-liquid in the wick 311-1 to form the second aerosol.

As the air flows through the vapor flow passage 321-1, it encounters the aerosol generating portion 322-1. The constriction of the vapor flow passage 321-1, at the aerosolization chamber 319-1, results in an increase in air velocity and corresponding decrease in air pressure in the airflow in the vicinity of the porous aerosol generating portion 322-1. The corresponding low pressure and high air velocity region causes the generation of the first (flavor) aerosol from the porous surface of the aerosol generating portion 322-1 of the liquid transfer element 315-1. The first (flavor) aerosol becomes entrained in the airflow and ultimately is output from the mouthpiece aperture 307-1 of the consumable 303-1 and into the user's mouth.

The first aerosol is sized to inhibit pulmonary penetration. The first aerosol is formed of particles with a mass median aerodynamic diameter that is greater than 70 microns. The first aerosol is sized for transmission within at least one of a mammalian oral cavity and a mammalian nasal cavity. The first aerosol is formed by particles having a maximum mass median aerodynamic diameter that is less than 100 microns. Such a range of mass median aerodynamic diameter will produce aerosols which are sufficiently small to be entrained in an airflow caused by a user drawing air through the flavor element and to enter and extend through the oral and or nasal cavity to activate the taste and/or olfactory receptors.

The second aerosol generated is sized for pulmonary penetration (i.e., to deliver an active ingredient such as nicotine to the user's lungs). The second aerosol is formed of particles having a mass median aerodynamic diameter of less than 1 micron. Such sized aerosols tend to penetrate into a human user's pulmonary system, with smaller aerosols generally penetrating the lungs more easily. The second aerosol may also be referred to as a vapor.

The size of aerosol formed without heating is typically smaller than that formed by condensation of a vapor.

Figure 3C:
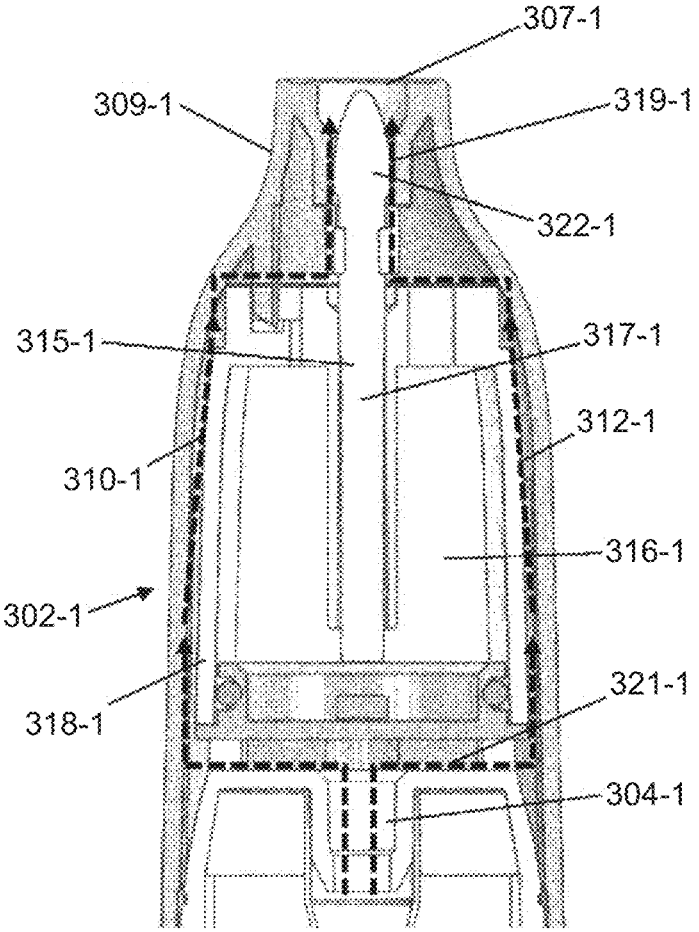
FIG. 3C is a cross-sectional schematic view of the flavor pod portion of the consumable of the third embodiment of the first mode.

FIG. 3C illustrates the flow of vapor through the flavor pod portion 302-1 of FIG. 3A and FIG. 3B. The flavor pod portion 302-1 is shown in the activated state. The cartomizer is not shown, but it should be appreciated that the flavor pod portions 302-1 is engaged with the cartomizer 301-1 of FIG. 3A and FIG. 3B. In other embodiments, however, the consumable 303-1 may not comprise a cartomizer portion, and may provide only flavor to the user.

As is provided above, the flavor pod portion 302-1 comprises an upstream (i.e., upstream with respect to flow of air in use) vapor passage inlet 304-1 and a downstream (i.e., downstream with respect to flow of air in use) outlet in the form of a mouthpiece aperture 307-1. Between, and fluidly connecting the vapor passage inlet 304-1 and the mouthpiece aperture 307-1, is a vapor flow passage 321-1. The vapor flow passage 321-1 comprises a first passage branch 310-1 and a second passage branch 312-1, each of the first passage branch 310-1 and the second passage branch 312-1 fluidly connecting the vapor passage inlet 304-1 and the mouthpiece aperture 307-1. In other examples the vapor flow passage 321-1 may have an annular shape.

The first and second passage branches 310-1, 312-1 are generally located on opposite sides of the liquid transfer element 315-1. Additionally, the first and second passage branches 310-1, 312-1 are located on opposite sides of the storage chamber 316-1. The first and second passage branches 310-1, 312-1 branch in a transverse (i.e., radially) outward direction (with respect to a central longitudinal axis of the consumable 303-1) downstream of the vapor passage inlet 304-1 to reach respective opposite sides of the storage chamber 316-1.

The aerosol generating portion 322-1 is located in the vapor flow passage 321-1 downstream of the first and second passage branches 310-1, 312-1. The first and second passage branches 310-1, 312-1 turn in a transverse and radially inward direction to merge at the liquid transfer element 315-1, and at a point upstream of the aerosol generating portion 322-1.

The aerosolization chamber 319-1 is thus downstream of the point at which the first and second passage branches 310-1, 312-1 merge, but upstream of the mouthpiece aperture 307-1. A transition region, between the aerosolization chamber 319-1 and the mouthpiece aperture 307-1 flares outwardly in the downstream direction, such that a diameter of the mouthpiece aperture 307-1 is greater than a diameter of the aerosolization chamber 319-1.

In use, when a user draws on the mouthpiece 309-1, air flow is generated through the airflow passage 308-1. Air (comprising the second aerosol from the cartomizer portion 301-1 as explained above with respect to FIG. 3A) flows through the vapor passage inlet 304-1 before the air flow splits to flow through the first and second passage branches 310-1, 312-1. Further downstream, the first and second passage branches 310-1, 312-1 provide inward airflow towards the liquid transfer element 315-1 and the aerosol generating portion 322-1.

As air flows past the aerosol generating portion 322-1 in the aerosolization chamber 319-1, the velocity of the air increases, resulting in a drop in air pressure. As a result, the first aerosol precursor held in the aerosol generating portion 322-1 becomes entrained in the air so as to form the first aerosol. The first aerosol has the particle size and other properties described above with respect to FIG. 3A.

Figure 3D:
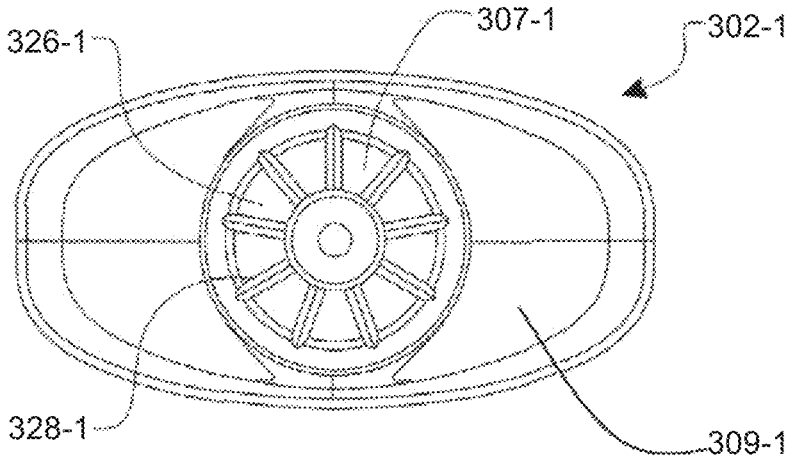
FIG. 3D and FIG. 3E are respective top and perspective views of a mouthpiece of the third embodiment of the first mode.
Figure 3E:
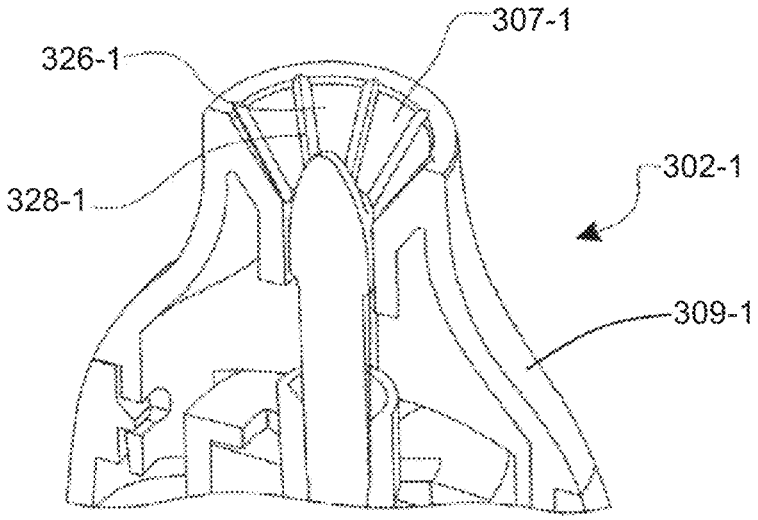

As the first aerosol precursor becomes entrained within the air, the liquid transfer element 315-1 transfers further first aerosol precursor from the storage chamber 316-1 to the aerosol generating portion 322-1. More specifically, the liquid transfer element wicks the first aerosol precursor from the storage chamber 316-1 to the aerosol generating portion 322-1. FIG. 3D and FIG. 3E show further views of the flavor pod portion 302-1 which highlight features of the mouthpiece 309-1. Many of the reference numerals of FIG. 3C are omitted from FIG. 3D and FIG. 3E for clarity.

An uneven inner (transition) surface 326-1 is located between the mouthpiece aperture 307-1 and the aerosolization chamber 319-1. In the present example, the inner surface 326-1 has the form of a substantially frustoconical surface, but includes grooves or channels 328-1 to make the inner surface 326-1 somewhat uneven. In other examples, the inner surface 326-1 may have another form (for example, the form a substantially cylindrical surface), and may include any type of protrusion or groove to make the inner surface uneven.

The inner surface 326-1 is angled with respect to an axial direction (i.e., relative to a central axis extending from a base of the consumable to the mouthpiece) such that the diameter of the passage 321-1 proximate the mouthpiece aperture 307-1 increases in the downstream direction. The inner surface 326-1 is downstream of the aerosolization chamber 319-1 of the vapor flow passage 321-1.

The grooves 328-1 are generally V-shaped in cross-sectional profile, and extend in the axial direction for the full length of the inner surface 326-1. Each groove 328-1 is formed from a pair of surfaces angled at between 30 and 90 degrees (e.g., 60 degrees) relative to each other. The grooves 328-1 have a depth (measured normal to the inner surface 326-1) of at least 0.2 mm (e.g., at least 0.4 mm). The grooves 328-1 have a depth of less than 0.8 mm (e.g., less than 0.6 mm). The grooves have a depth of substantially 0.5 mm. The inner surface 326-1 comprises 9 grooves 328-1, but may comprise more or less grooves.

The grooves 328-1 are spaced apart from each other by substantially 1 mm at the downstream end of the inner surface 326-1. In other examples, the spacing at the downstream end of grooves or protrusions may be selected such that it is equal to or less than the mass median diameter (as described above) of particles in the first aerosol.

The inner surface 326-1 comprises a smooth polished surface between the grooves 328-1. Polishing the surface in this way may provide improved aerodynamic properties. However, in other examples, the inner surface 426-1 may be textured. In such examples, the texture of the surface may provide the uneven surface, and no grooves may be required.

In use, the uneven nature of the inner surface 326-1 may make it easier for droplets to form on the inner surface 326-1, preventing large droplets from entering the user's mouth. The grooves 328-1 may help to channel the large droplets back into the consumable.

Figure 4A:
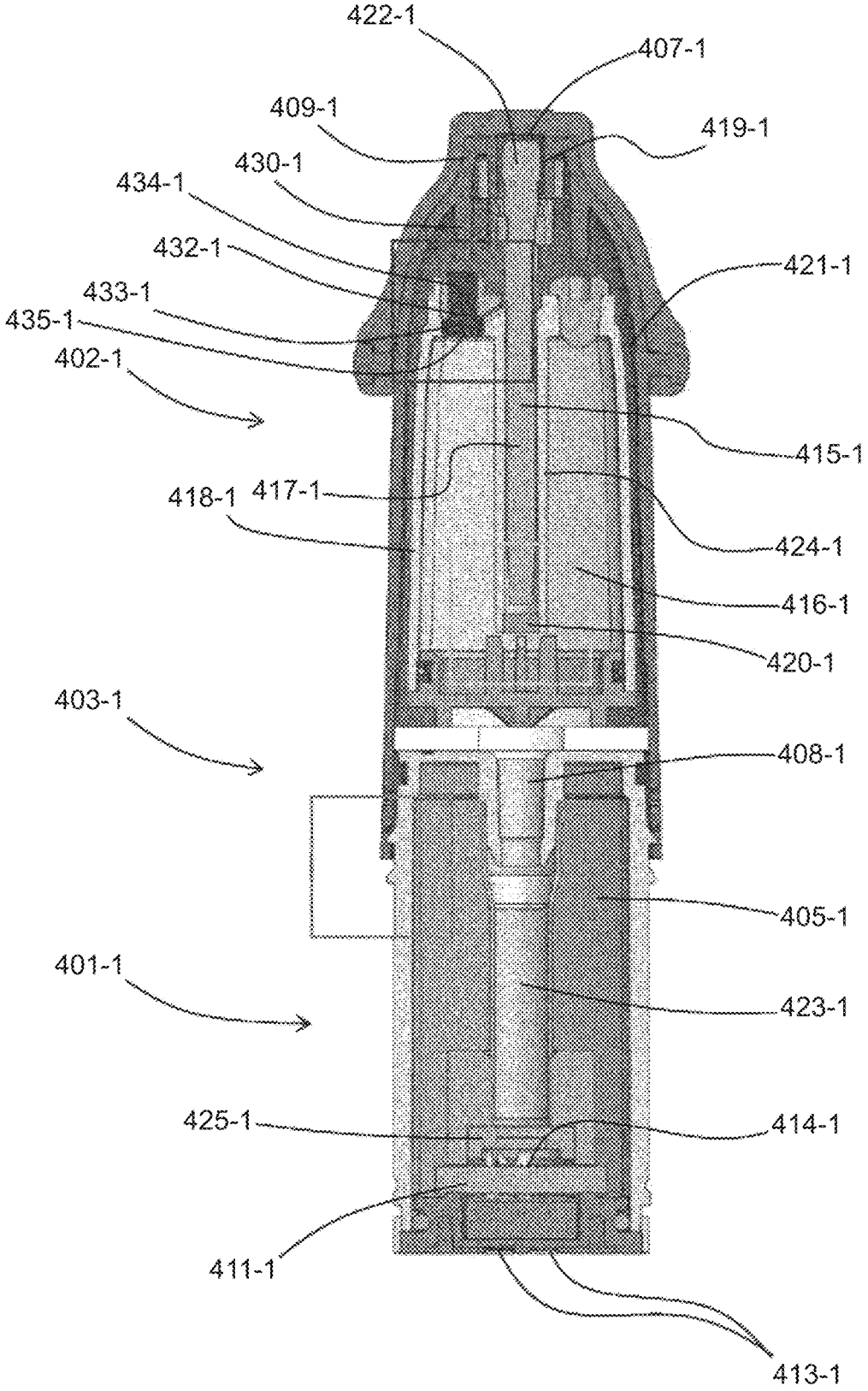
FIG. 4A is a cross-sectional view of a consumable according to a fourth embodiment of the first mode in a deactivated state.
Figure 4B:
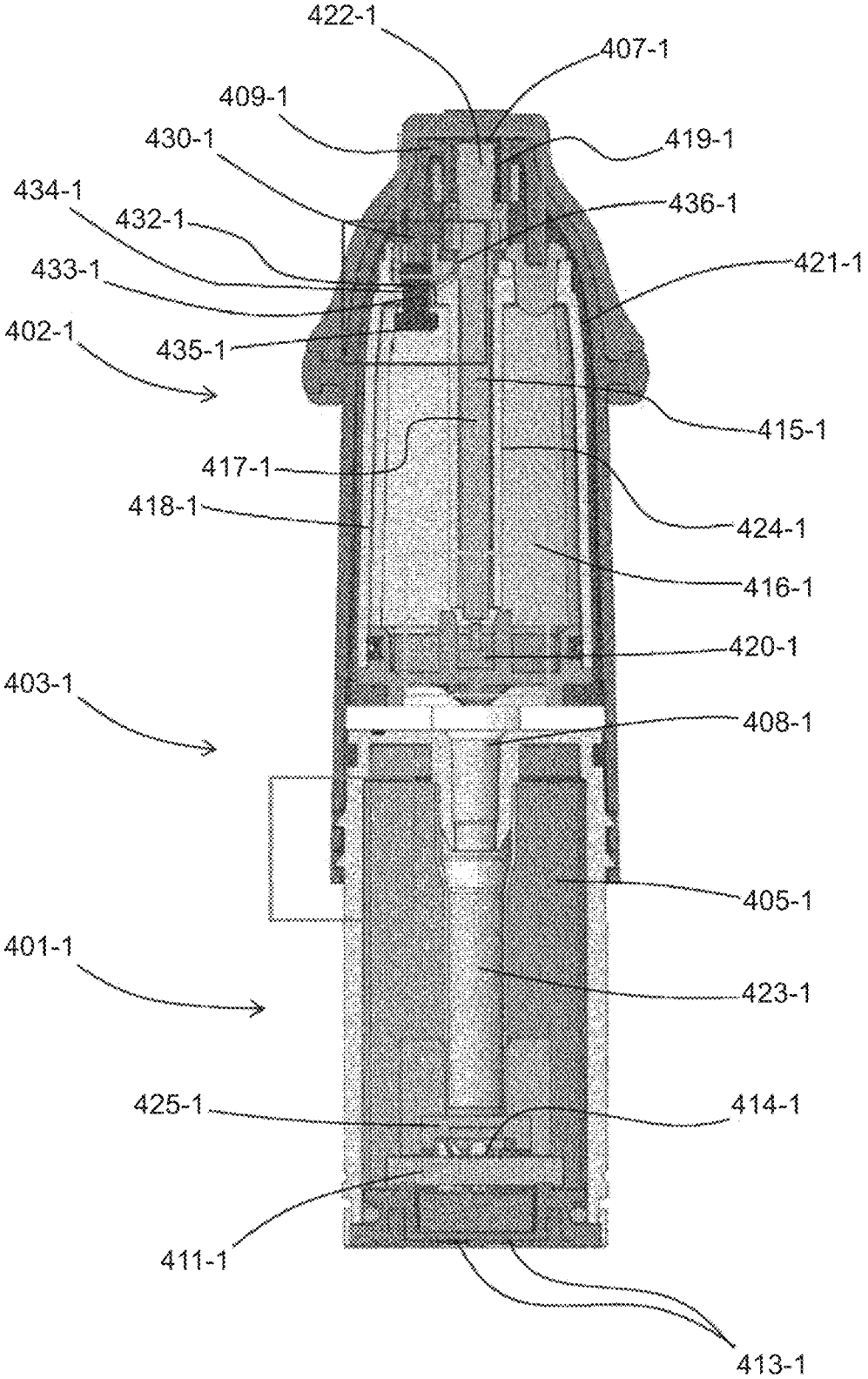
FIG. 4B is a cross-sectional view of a consumable according to the fourth embodiment of the first mode in an activated state.

FIG. 4A and FIG. 4B illustrate a consumable 404-1 of an aerosol delivery device, according to a fourth embodiment of the first mode. This embodiment includes many of the same features of the embodiment described above and shown in FIG. 3A to FIG. 3E and, for that reason, corresponding reference numerals have been used (albeit with a unit increase of the first digit to represent the further embodiment). The description of those features has not been repeated here. FIG. 4A shows the consumable 404-1 in a deactivated state and FIG. 4B shows the consumable 404-1 in an activated state. Unlike the previously described embodiment, the presently illustrated embodiment comprises a different mechanism for opening the air bleed channel 432-1 upon activation of the consumable 403-1. In this embodiment, when in the deactivated state (FIG. 4A) the air bleed channel 432-1 is blocked by a silicone bung 433-1 sealing element received in the air bleed channel 432-1. In particular, a body 434-1 of the bung 433-1 is received in the air bleed channel 432-1, but does not fully obstruct the air bleed channel 432-1. That is, a portion of the air bleed channel 432-1 remains unobstructed by the body 434-1 of the bung 433-1. However, an enlarged portion, in this example an enlarged head 435-1 of the bung 433-1, which is located in the storage chamber 416-1, extends fully across the entrance to the air bleed channel 432-1 so as to obstruct the channel 432-1.

When the mouthpiece 409-1 is moved in the upstream longitudinal direction to activate the consumable 403-1, an elongate activation member (extending inwardly from the mouthpiece 409-1) engages the body 434-1 of the bung 433-1 and pushes the bung 433-1 in the upstream direction (see FIG. 4B). This moves the enlarged head 435-1 of the bung 433-1 away from the entrance of the air bleed channel 432-1 such that the head 435-1 no longer obstructs the air bleed channel 432-1. This allows air to pass from the vapor flow passage 421-1 and into the storage chamber 416-1 (which, in turn, allows for flow of the first aerosol precursor from the storage chamber 416-1). It should be noted that the bung sealing element shown in FIG. 4A and FIG. 4B could be used in place of the pierceable membrane in FIG. 3A and FIG. 3B and vice versa.

Additionally, unlike in the example described in FIG. 3A to FIG. 3E, an external opening 436-1 (i.e., the opening outside the storage 416-1) of the air bleed channel 432-1 is located adjacent to the liquid transfer element 415-1. The liquid transfer element 415-1 defines a portion of the air bleed channel 432-1. The external opening 436-1 has a diameter of 0.5 mm.

The external opening 436-1 and the liquid transfer element 415-1 are positioned such that a meniscus forms between them in use, the meniscus providing an obstruction which closes the air bleed channel 432-1. The air bleed channel 432-1 being closed prevents further liquid being transferred through the liquid transfer element 415-1 until the user draws on the device again, reducing leakage. Additionally, the obstruction may prevent leakage of liquid through the air bleed channel 432-1.

When the user draws on the device, the aerosol generating portion 422-1 forms an aerosol from aerosol precursor liquid, which causes the amount of aerosol precursor liquid in the liquid transfer element 415-1 to reduce. The liquid transfer element 415-1 then absorbs further aerosol precursor liquid from the storage 416-1, which causes the liquid forming the obstruction to be pulled from the air bleed channel 432-1 and into the storage 416-1. This temporarily opens the air bleed channel 432-1 and permits air to enter the storage 416-1 to reduce the pressure difference between the storage and the external environment. Once the liquid transfer element 415-1 reaches a certain level of saturation with liquid, the obstruction forms again, closing the air bleed channel 432-1.

In other examples the external opening 436-1 is not directly adjacent to the liquid transfer element 415-1, but is sufficiently close for the obstruction to form.

The air bleed channel 432-1 follows a tortuous path. At the external opening 436-1 the air bleed channel 432-1 extends parallel to a longitudinal axis of the smoking substitute device in a longitudinal direction. The air bleed channel 432-1 turns away from the longitudinal direction towards a radially outward direction, before turning towards the longitudinal direction again.

The aerosol generating portion 422-1 of the liquid transfer element shown in the FIG. 4A and FIG. 4B has a flattened upper (downstream) surface. Such a liquid transfer element could be used in the embodiment shown in FIG. 3A and FIG. 3B.

Second Mode: An Aerosol Delivery Device Comprising a Terminal Housing Having Two Possible Orientations in which it can be Seated on the Upstream Device Components.

Figure 5A:
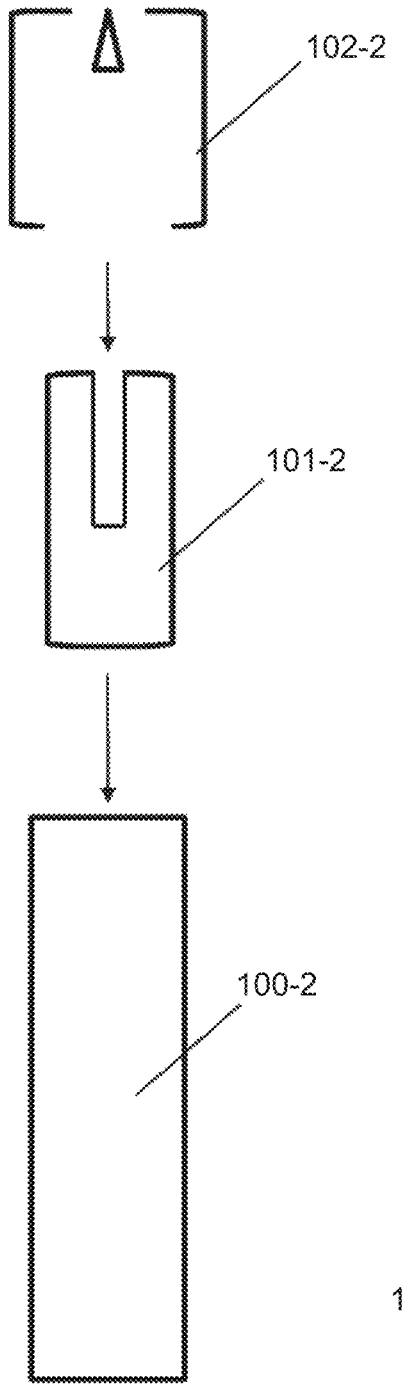
FIG. 5A and FIG. 5B is a schematic drawing of an aerosol delivery system according to a first embodiment of a second mode.
Figure 5B:
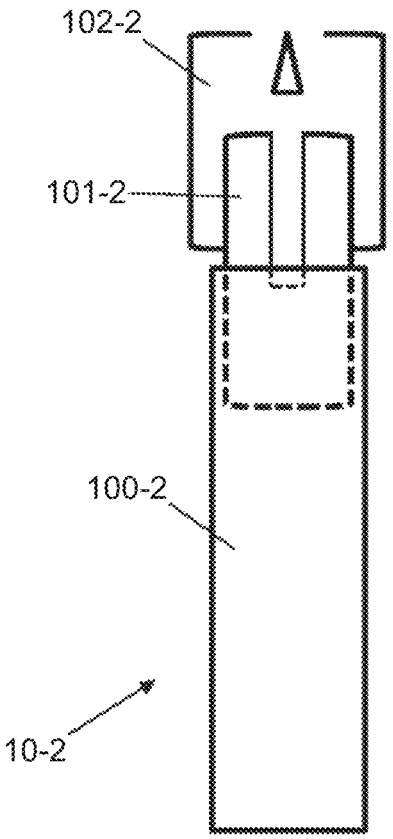

Referring to FIG. 5A and FIG. 5B, there is shown a schematic view of an aerosol delivery system, according to a first embodiment of a second mode, in the form of a smoking substitute system 10-2. In this example, the smoking substitute system 10-2 comprises a cartomizer 101-2 and an additive delivery article in the form of a flavor pod 102-2 connected to a base unit 100-2. In this example, the base unit 100-2 includes elements of the smoking substitute system 10-2 such as a battery, an electronic controller, and a pressure transducer (not shown). The cartomizer 101-2 may engage with the base unit 100-2 via a push-fit engagement, a screw-thread engagement, or a bayonet fit, for example. A cartomizer may also be referred to as a "pod".

The flavor pod 102-2 is configured to engage with the cartomizer 101-2 and thus with the base unit 100-2. The flavor pod 102-2 may engage with the cartomizer 101-2 via a push-fit engagement, a screw-thread engagement, or a bayonet fit, for example. FIG. 5B illustrates the cartomizer 101-2 engaged with the base unit 100-2, and the flavor pod 102-2 engaged with the cartomizer 101-2. As will be appreciated, in this example, the cartomizer 101-2 and the flavor pod 102-2 are distinct elements.

As will be appreciated from the following description, in other embodiments the cartomizer 101-2 and the flavor pod 102-2 may be combined into a single component that implements the combined functionality of the cartomizer 101-2 and flavor pod 102-2. Such a single component may also be referred to as an aerosol delivery device. In other examples, the cartomizer may be absent, with only a flavor pod 102-2 present.

As is set forth above, reference to a "consumable" component may mean that the component is intended to be used once until exhausted, and then disposed of as waste or returned to a manufacturer for reprocessing.

Figure 6A:
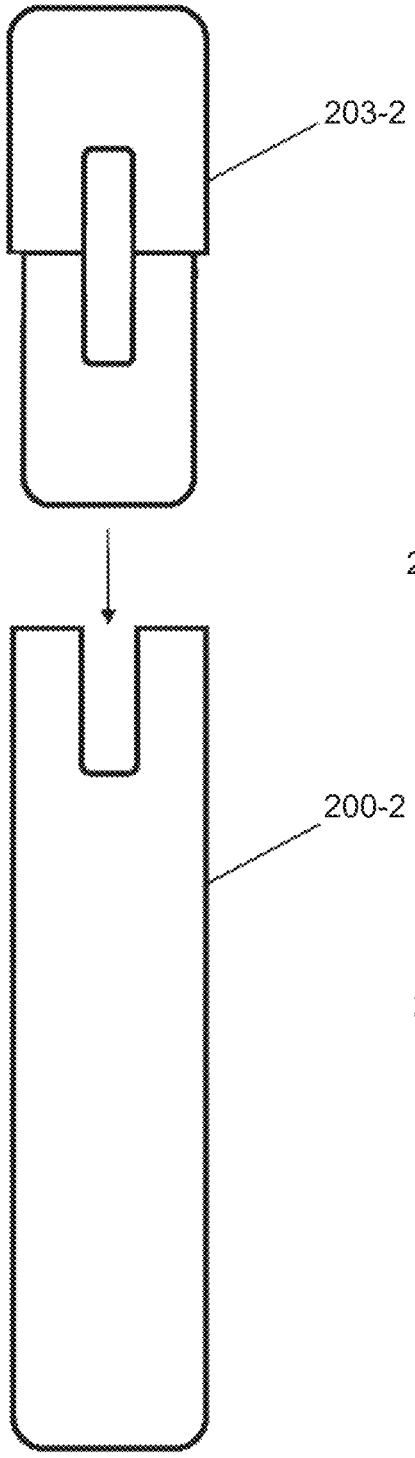
FIG. 6A and FIG. 6B is a schematic drawing of an aerosol delivery system according to a second embodiment of the second mode.
Figure 6B:
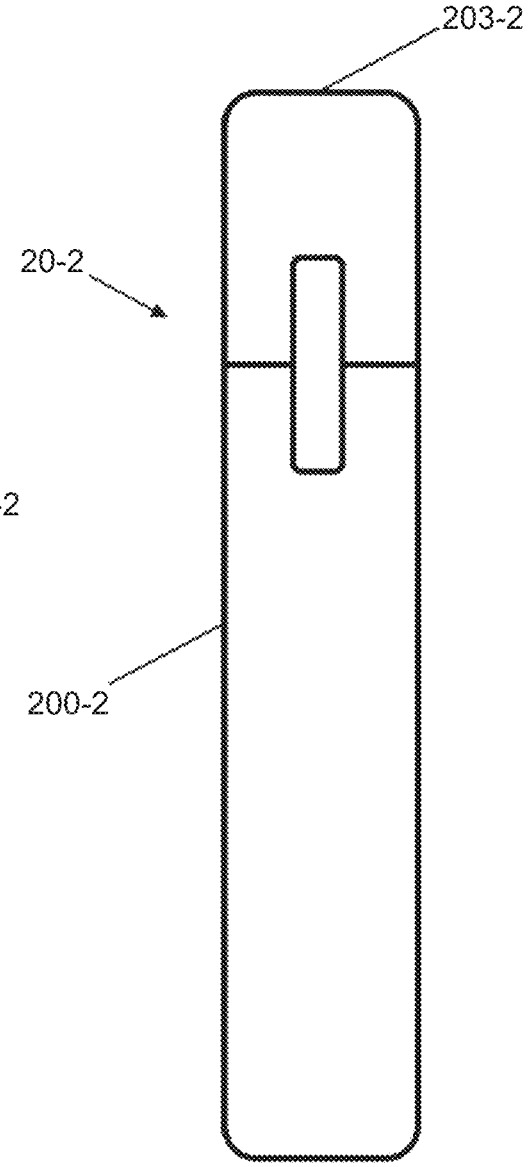

Referring to FIG. 6A and FIG. 6B, there is shown a smoking substitute system 20-2, according to a second embodiment of the second mode, comprising a base unit 200-2 and a consumable 203-2. The consumable 203-2 combines the functionality of the cartomizer 101-2 and the flavor pod 102-2. In FIG. 6A, the consumable 203-2 and the base unit 200-2 are shown separated from one another. In FIG. 6B, the consumable 203-2 and the base unit 200-2 are engaged with each other to form the smoking substitute system 20-2.

Figure 7A:
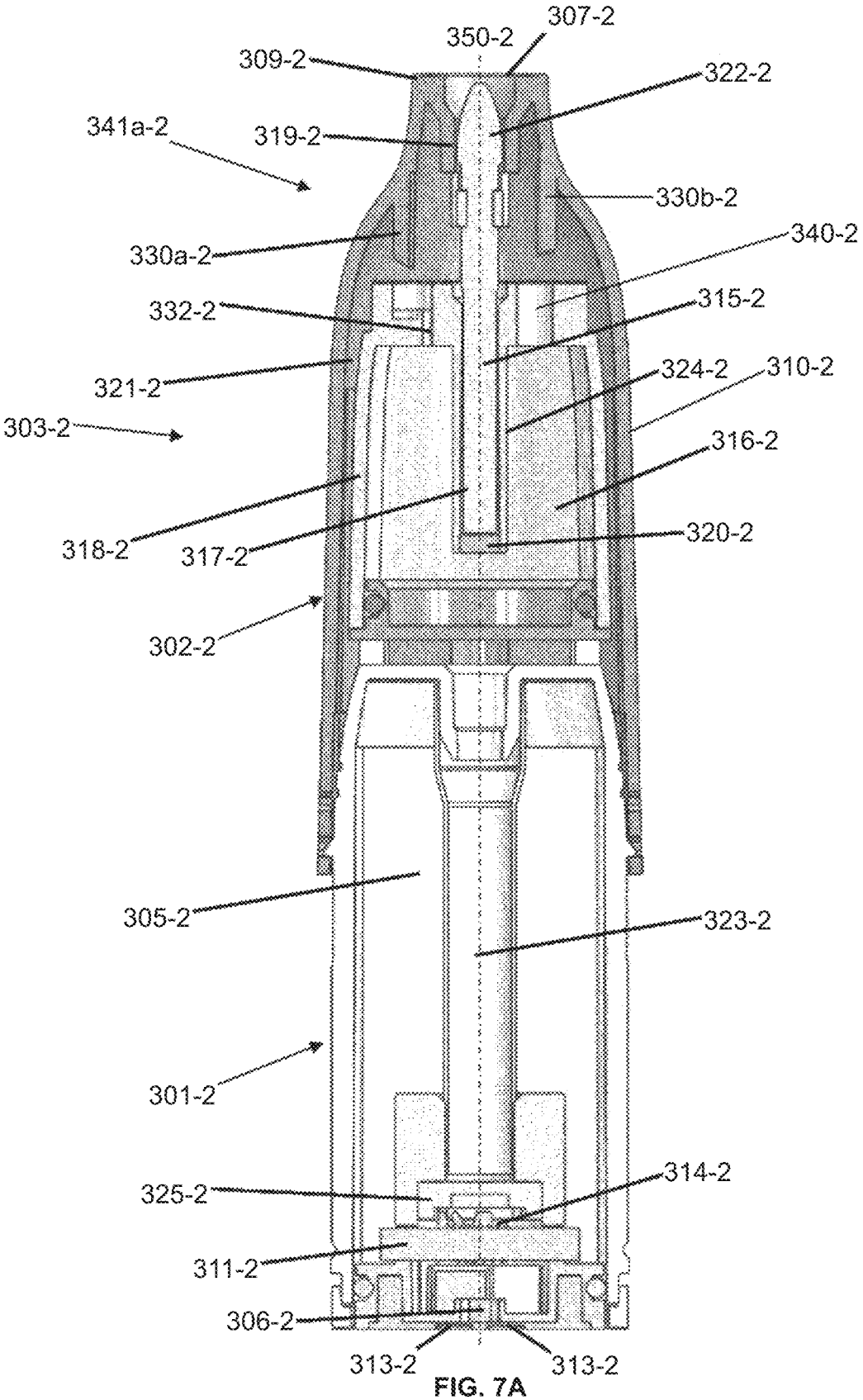
FIG. 7A is a cross-sectional view of a consumable according to a third embodiment of the second mode in a deactivated state.

Referring to FIG. 7A, there is shown a consumable 303-2 engageable with a base unit (not shown) via a push-fit engagement, according to a third embodiment of the second mode. The consumable 303-2 is shown in a deactivated state. The consumable 303-2 may be considered to have two portions—a cartomizer portion 301-2 and flavor pod portion 302-2 (i.e., additive delivery article), both of which are located within a single consumable component 303-2 (as in FIG. 6A and FIG. 6B). It should, however, be appreciated that in a variation, the cartomizer portion 301-2 and flavor pod portion 302-2 may be separate (but engageable) components.

The consumable 303-2 includes an upstream cartomizer inlet opening 306-2 and a downstream mouthpiece aperture 307-2 (i.e., defining an outlet of the consumable 303-2) provided in a mouthpiece portion 309-2 of a terminal element 341-2. In other examples a plurality of inlets and/or outlets are included. Between, and fluidly connecting, the inlet opening 306-2 and the mouthpiece aperture 307-2 there is an airflow path (or passage) comprising (in a downstream flow direction) a vaporizing chamber 325-2 of the cartomizer, a vapor outlet 323-2 (also of the cartomizer) and a downstream flow passage 321-2 (which will hereinafter be referred to as the vapor flow passage) of the flavor pod portion 302-2.

As above, the consumable 303-2 includes a flavor pod portion 302-2. The flavor pod portion 302-2 is configured to generate a first (flavored) aerosol for output from the mouthpiece aperture 307-2. The flavor pod portion 302-2 of the consumable 303-2 includes a liquid transfer element 315-2. This liquid transfer element 315-2 acts as a passive aerosol generator (i.e., an aerosol generator which does not use heat to form the aerosol), and is formed of a porous material. The liquid transfer element 315-2 comprises a conveying portion 317-2 and an aerosol generating portion 322-2, which is located in the vapor flow passage 321-2. In this example, the aerosol generating portion 322-2 is a porous nib.

When activated, as discussed in more detail below, a storage chamber 316-2 (defined by a tank 318-2) for storing an aerosol precursor (i.e., a liquid comprising a flavorant) is fluidly connected to the liquid transfer element 315-2. The flavored aerosol precursor, in this embodiment, is stored in a porous body within the storage chamber 316-2 (but may be a free liquid). In the activated state, the liquid transfer element 315-2 is in contact with the flavored aerosol precursor stored in the storage chamber 316-2 by way of contact with the porous body/free liquid.

The liquid transfer element 315-2 comprises an aerosol generating portion 322-2 and a conveying portion 317-2. The aerosol generating portion 322-2 is located at a downstream end (top of FIG. 7A) of the liquid transfer element 315-2, whilst the conveying portion 317-2 forms the remainder of the liquid transfer element 315-2. The conveying portion 317-2 is elongate and substantially cylindrical. The aerosol generating portion 322-2 is bulb/bullet-shaped, and comprises a portion which is wider (has a greater radius) than the conveying portion 317-2. The aerosol generating portion 322-2 tapers to a tip at a downstream end of the liquid transfer element 315-2.

The liquid transfer element 315-2 extends into and through the storage chamber 316-2, such that the conveying portion 317-2 is in contact with the contents of the storage chamber 316-2. In particular, an inner wall of the tank 318-2 defines a conduit 324-2, through which the liquid transfer element 315-2 extends. The liquid transfer element 315-2 and the conduit 324-2 are located in a substantially central position within the storage chamber 316-2 and are substantially parallel to a central longitudinal axis of the consumable 303-2.

The porous nature of the liquid transfer element 315-2 means that first (flavored) aerosol precursor in the storage chamber 316-2 is drawn into the liquid transfer element 315-2. As the flavored aerosol precursor in the liquid transfer element 315-2 is depleted in use, further flavored aerosol precursor is drawn from the storage chamber 316-2 into the liquid transfer element 315-2 via a wicking action.

Before activation, the storage chamber 316-2 is fluidly isolated from the liquid transfer element 315-2. In this example, the isolation is achieved via a plug 320-2 (preferably formed from silicone) located at one end of a conduit 324-2 surrounding the liquid transfer element 315-2. In other examples, the plug may be replaced by any one of: a duck bill valve; a split valve or diaphragm; or a sheet of foil.

The storage chamber 316-2 further includes an air bleed channel 332-2, which in the deactivated state is sealed by a sealing element comprising a pierceable membrane (preferably made from foil). A first activation (or piercing) member **330*a*-2, which projects inwardly from an inner surface of the mouthpiece portion 309-2, and may take the form of a blade, pierces the pierceable membrane and opens the air bleed channel 332-2** when the consumable is moved to the activated state (as is discussed in more detail below).

The mouthpiece portion 309-2 of the terminal element 341-2 further comprises a second activation member **330*b*-2. Both activation members 330*a*-2, 330*b*-2 extend symmetrically (i.e., evenly spaced) on either side of the mouthpiece aperture 209-2 and either side of the liquid transfer element 315-2. The two activation members extend generally longitudinally parallel to the liquid transfer element and parallel to the central longitudinal axis 350-2** of the device.

In the first orientation of the terminal element 341-2 shown in FIG. 7A, the first activation member **330*a*-2 is longitudinally aligned with the sealing element. The second activation member 330*b*-2 is longitudinally aligned with a filling port 340-2** which is blocked by a plug (not shown).

The device may alternatively be assembled with the terminal element 240-2 rotated through 180 degrees so that the second activation member **330*b*-2 is longitudinally aligned with the sealing element and the first activation member 330*a*-2 is longitudinally aligned with the filling port 340-2**.

The aerosol generating portion 322-2 of the liquid transfer element 315-2 is located within the vapor flow passage 321-2 that extends through the flavor pod portion 302-2. The aerosol generating portion 322-2, by occupying a portion of the vapor flow passage 321-2, constricts or narrows the vapor flow passage 321-2. This constricted or narrowed portion of the vapor flow passage 321-2 defines an aerosolization chamber 319-2 of the consumable 303-2. The aerosolization chamber 319-2, which is adjacent the aerosol generating portion 322-2, is the narrowest portion of the vapor flow passage 321-2. The constriction of the vapor flow passage 321-2 at the aerosolization chamber 319-2 results in increased air velocity and a corresponding reduction in air pressure of the air flowing therethrough and thus may be referred to as a Venturi aperture. The aerosolization chamber 319-2 is generally toroidal in shape (extending circumferentially about the aerosol generating portion 322-2), but this toroidal shape may include one or more interruptions where supports extend inwardly to contact the aerosol generating portion 322-2 and to support the aerosol generating portion 322-2 within the aerosolization chamber 319-2.

The cartomizer portion 301-2 of the consumable 303-2 includes a reservoir 305-2 (defined by a container) for storing a second (e-liquid) aerosol precursor (which may contain nicotine). A wick 311-2 extends into the reservoir so as to be in contact with (i.e., partially submerged in) the e-liquid aerosol precursor. The wick 311-2 is formed from a porous wicking material (e.g., a polymer) that draws the e-liquid aerosol precursor from the reservoir 305-2 into a central region of the wick 311-2 that is located in the vaporizing chamber 325-2.

A heater 314-2 is a configured to heat the central region of the wick 311-2. The heater 314-2 includes a resistive heating filament that is coiled around the central region of the wick 311-2. The wick 311-2 and the heater 314-2 generally define a vaporizer, and together with the reservoir 305-2 act as an active aerosol generator. The vaporizer (i.e., wick 311-2 and heater 314-2) and aerosol generating portion 322-2 are both at least partially located within the airflow passage, with the aerosol generating portion 322-2 being downstream of the vaporizer. So that the consumable 303-2 may be supplied with electrical power for activation of the heater 314-2, the consumable 303-2 includes a pair of consumable electrical contacts 313-2. The consumable electrical contacts 313-2 are configured for electrical connection to a corresponding pair of electrical supply contacts in the base unit (not shown). The consumable electrical contacts 313-2 are electrically connected to the electrical supply contacts (not shown) when the consumable 303-2 is engaged with the base unit. The base unit includes an electrical power source, for example a battery.

Figure 7B:
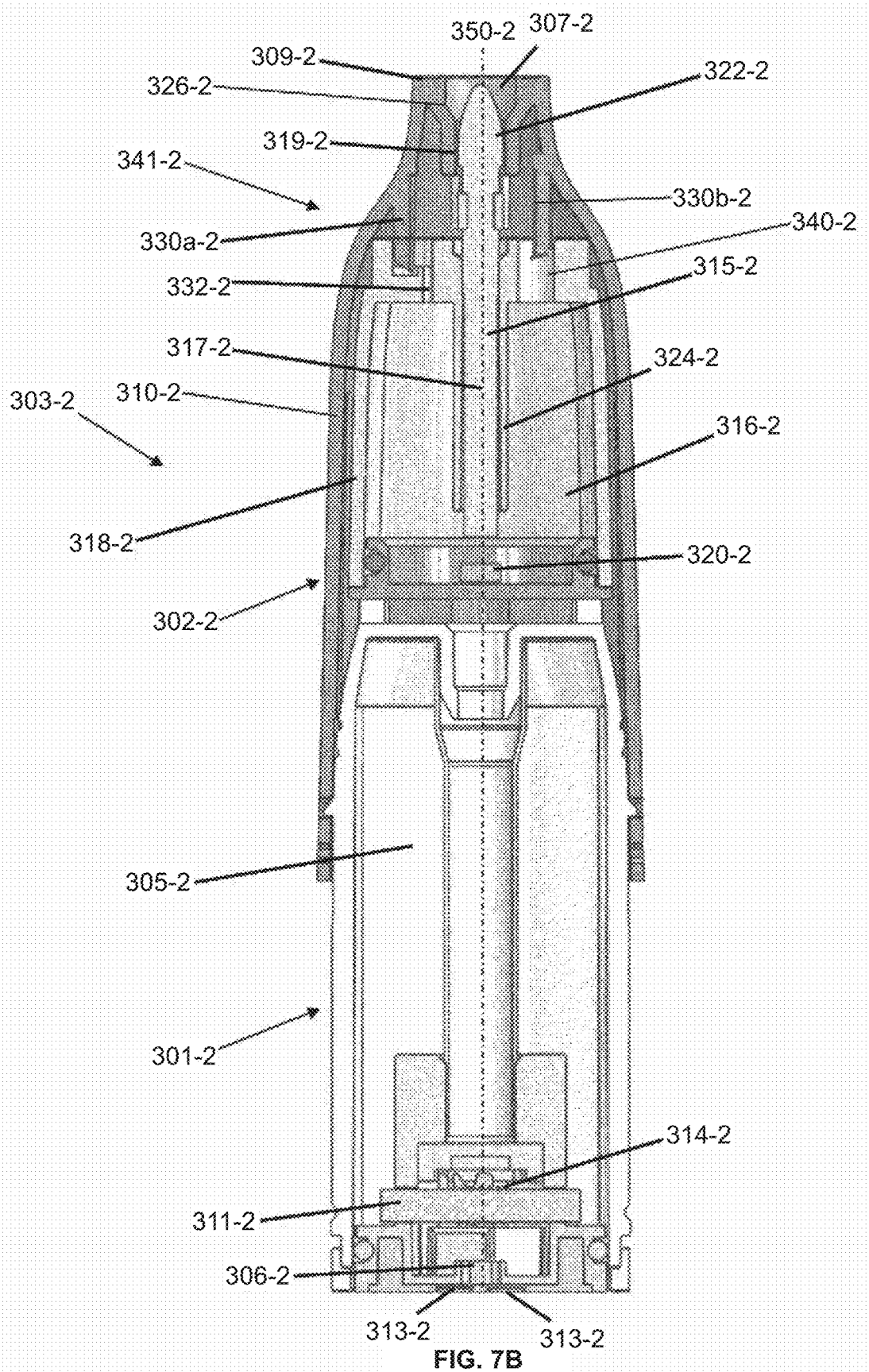
FIG. 7B is a cross-sectional view of the consumable of FIG. 7A in an activated state.

FIG. 7B shows the consumable 303-2 of FIG. 7A in an activated state. To transition from the deactivated state to the activated state, terminal element 341-2 is moved along the central longitudinal axis 350-2 in an upstream direction towards cartomizer portion 301-2. The mouthpiece portion 309-2 of the terminal element 341-2 is fixed by a collar 308-2 to the conveying portion 317-2 of the liquid transfer element 315-2 and therefore liquid transfer element 315-2 moves with the mouthpiece 309-2. The mouthpiece 309-2 and liquid transfer element 315-2 are moved relative to the tank 318-2. When the mouthpiece 309-2 is moved upstream, first activation/piercing member **330*a*-2 contacts and pierces the sealing element in the form of a pierceable membrane extending across the air bleed channel 332-2 thereby fluidly connecting the vapor flow passage 321-2 the storage chamber 316-2. This allows air from the vapor flow passage 321-2 to enter the storage chamber 316-2 as aerosol precursor is removed from the storage chamber 316-2 by the liquid transfer element 315-2. In addition to piercing of the membrane by the activation member 330-2, liquid transfer element 315-2 pushes on, and moves, plug 320-2 out of the conduit 324-2 which then allows liquid transfer element 315-2 to come into contact with the flavored aerosol precursor stored in the storage chamber 316-2. The plug 320-2 may then be unconstrained within the storage chamber, or may be pushed by liquid transfer element 315-2 into a holding location. As the terminal element 341-2 is moved upstream, the second activation member is received within the plug (not shown) sealing the filling port 340-2**.

Of course, when the device is assembled with the terminal element 341-2 in the second orientation, in the activated state, the second activation member **330*b*-2 pierces the sealing element membrane and the first activation member 330*a*-2 is received within the filling port 340-2. Once activated, and in use, a user draws (or "sucks", "pulls", or "puffs") on the mouthpiece portion 309-2 of the consumable 303-2, which causes a drop in air pressure at the mouthpiece aperture 307-2, thereby generating air flow through the inlet opening 306-2, along the airflow path including the vapor passage, out of the mouthpiece aperture 307-2** and into the user's mouth.

When the heater 314-2 is activated by passing an electric current through the heating filament in response to the user drawing on the mouthpiece portion 309-2 (the drawing of air may be detected by a pressure transducer), the e-liquid located in the wick 311-2 adjacent to the heating filament is heated and vaporized to form a vapor in the vaporizing chamber 325-2. The vapor condenses to form the e-liquid aerosol within the vapor outlet 323-2. The e-liquid aerosol is entrained in an airflow along the vapor flow passage 321-2 to the mouthpiece aperture 307-2 for inhalation by the user when the user draws on the mouthpiece portion 309-2.

The base unit supplies electrical current to the consumable electrical contacts (not shown). This causes an electric current flow through the heating filament of the heater 314-2 and the heating filament heats up. As described, the heating of the heating filament causes vaporization of the e-liquid in the wick 311-2 to form the e-liquid aerosol. As the air flows through the vapor flow passage 321-2, it encounters the aerosol generating portion 322-2. The constriction of the vapor flow passage 321-2, at the aerosolization chamber 319-2, results in an increase in air velocity and corresponding decrease in air pressure in the airflow in the vicinity of the porous aerosol generating portion 322-2. The corresponding low pressure and high air velocity region causes the generation of the flavored aerosol from the porous surface of the aerosol generating portion 322-2 of the liquid transfer element 315-2. The flavored aerosol becomes entrained in the airflow and ultimately is output from the mouthpiece aperture 307-2 of the consumable 303-2 and into the user's mouth.

The flavored aerosol is sized to inhibit pulmonary penetration. The flavored aerosol is formed of particles with a mass median aerodynamic diameter that is greater than 70 microns. The flavored aerosol is sized for transmission within at least one of a mammalian oral cavity and a mammalian nasal cavity. The flavored aerosol is formed by particles having a maximum mass median aerodynamic diameter that is less than 100 microns. Such a range of mass median aerodynamic diameter will produce aerosols which are sufficiently small to be entrained in an airflow caused by a user drawing air through the device and to enter and extend through the oral and or nasal cavity to activate the taste and/or olfactory receptors.

The e-liquid aerosol generated is sized for pulmonary penetration (i.e., to deliver an active ingredient such as nicotine to the user's lungs). The e-liquid aerosol is formed of particles having a mass median aerodynamic diameter of less than 1 micron. Such sized aerosols tend to penetrate into a human user's pulmonary system, with smaller aerosols generally penetrating the lungs more easily. The e-liquid aerosol may also be referred to as a vapor.

The size of aerosol formed without heating is typically smaller than that formed by condensation of a vapor.

Figure 7C:
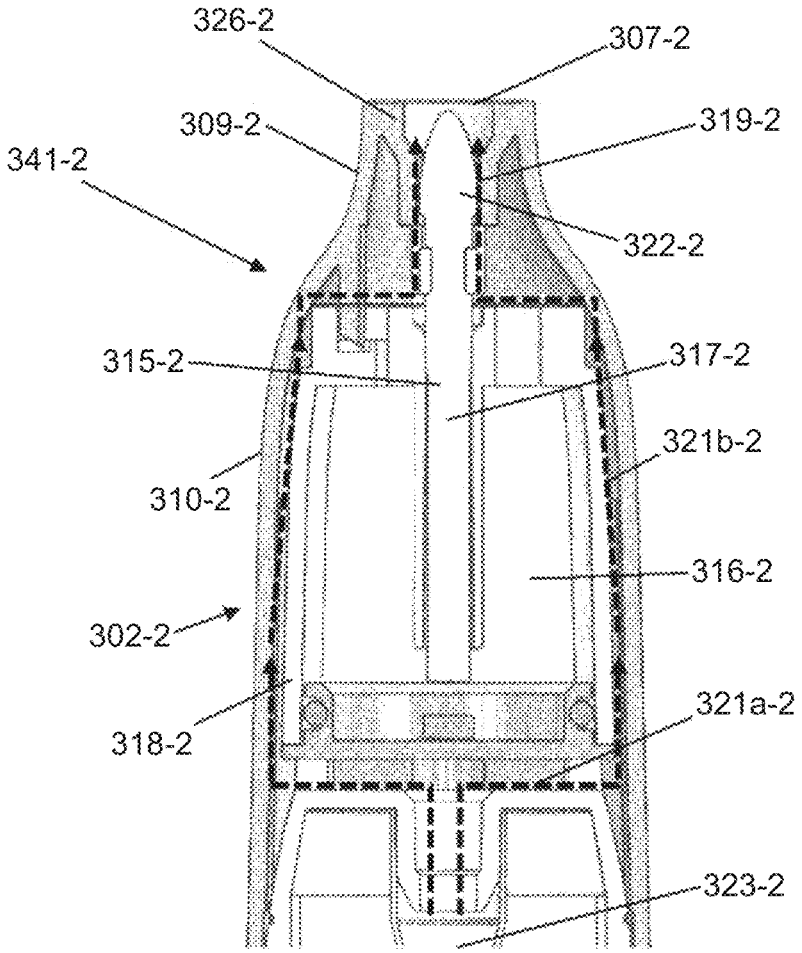
FIG. 7C is a cross-sectional schematic view of the flavor pod portion of the consumable of the third embodiment of the second mode.

FIG. 7C illustrates the flow of vapor through the flavor pod portion 302-2 of FIG. 7A and FIG. 7B (although the second activation member **330*b*-2 is omitted). The flavor pod portion 302-2 is shown in the activated state with the terminal housing in its first orientation. The cartomizer is not shown, but it should be appreciated that the flavor pod portions 302-2 is engaged with the cartomizer 301-2 of FIG. 7A and FIG. 7B. In other embodiments, however, the consumable 303-2** may not comprise a cartomizer portion, and may provide only flavor to the user.

As is provided above, the flavor pod portion 302-2 comprises an upstream (i.e., upstream with respect to flow of air in use) vapor passage inlet 304-2 (in fluid communication with the vapor outlet 323-2) and a downstream (i.e., downstream with respect to flow of air in use) outlet in the form of a mouthpiece aperture 307-2. Between, and fluidly connecting the vapor passage inlet 304-2 and the mouthpiece aperture 307-2, is a vapor flow passage 321-2.

The vapor flow passage 321-2 comprises a transverse portion **321*a*-2. The airflow path through the device deflects at the vapor passage inlet 304-2, i.e., there is a deflection between the vapor outlet 323-2 and the transverse portion 321*a*-2 of the vapor flow passage 321-2. The vapor flow passage 321-2 then deflects again from the transverse portion 321*a*-2 to a longitudinal portion 321*b*-2 which extends generally longitudinally between a device housing 310-2 (which forms part of the terminal element 341-2 and which is integral with the mouthpiece portion 309-2) and the tank 318-2. The vapor flow passage deflects again at the upper surface of the tank 318-2 within the mouthpiece portion 309-2, through the aerosolization chamber 319-2, towards the mouthpiece aperture 307-2. Within the mouthpiece portion 309-2, flow around the first and second activation members 330*a*-2, 330*b*-2 is symmetrical. The vapor flow passage 321-2 may be a single (annular) flow passage around the tank 318-2 or it may comprise two branches which split around the tank 318-2 and re-join within the mouthpiece portion 309-2 proximal the liquid transfer element 315-2**.

A transition surface 326-2, between the aerosolization chamber 319-2 and the mouthpiece aperture 307-2 flares outwardly in the downstream direction, such that a diameter of the mouthpiece aperture 307-2 is greater than a diameter of the aerosolization chamber 319-2.

In use, when a user draws on the mouthpiece portion 309-2, air flow is generated through the air flow path through the device. Air (comprising the e-liquid aerosol from the cartomizer portion 301-2 as explained above with respect to FIG. 7A) flows through the vapor outlet 323-2 and into the vapor passage 321-2. Further downstream, as air flows past the aerosol generating portion 322-2 in the aerosolization chamber 319-2, the velocity of the air increases, resulting in a drop in air pressure. As a result, the flavored aerosol precursor held in the aerosol generating portion 322-2 becomes entrained in the air so as to form the flavored aerosol. The flavored aerosol has the particle size and other properties described above with respect to FIG. 7A.

As the flavored aerosol precursor becomes entrained within the air, the liquid transfer element 315-2 transfers further flavored aerosol precursor from the storage chamber 316-2 to the aerosol generating portion 322-2. More specifically, the liquid transfer element wicks the flavored aerosol precursor from the storage chamber 316-2 to the aerosol generating portion 322-2.

Figure 7D:
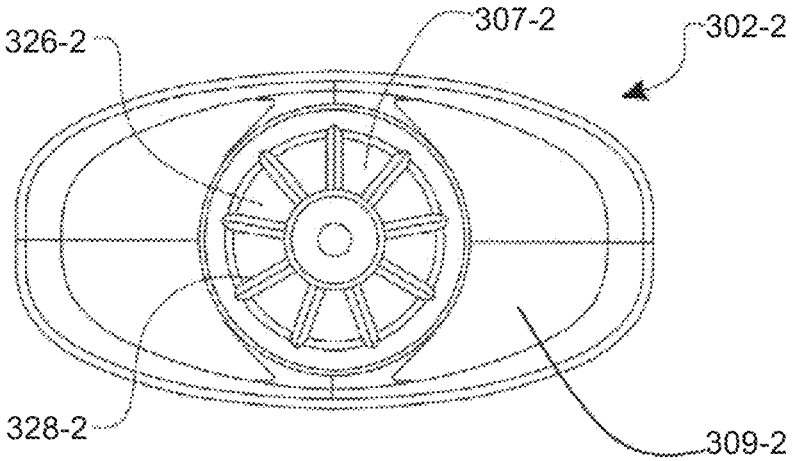
FIG. 7D and FIG. 7E are respective top and perspective views of a mouthpiece of the third embodiment of the second mode.
Figure 7E:
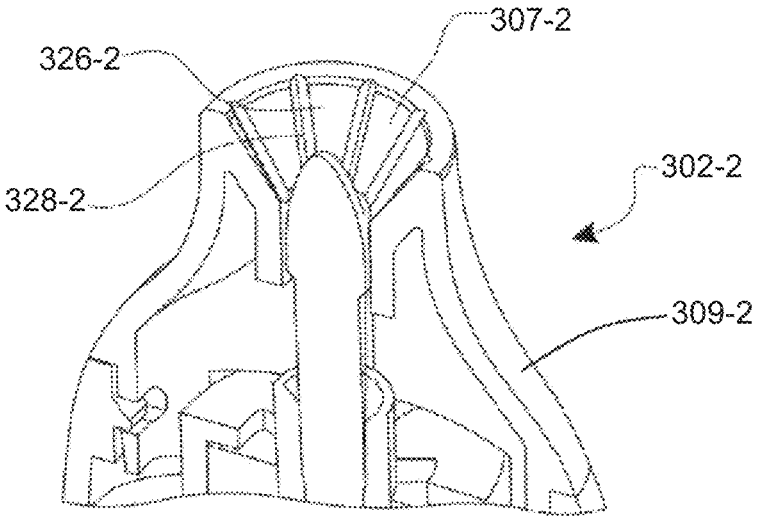

FIG. 7D and FIG. 7E show further views of the flavor pod portion 302-2 which highlight features of the mouthpiece portion 309-2. Many of the reference numerals of FIG. 7C are omitted from FIG. 7D and FIG. 7E for clarity. The activation members are also omitted.

An uneven inner (transition) surface 326-2 is located between the mouthpiece aperture 307-2 and the aerosolization chamber 319-2. In the present example, the inner surface 326-2 has the form of a substantially frustoconical surface, but includes grooves or channels 328-2 to make the inner surface 326-2 somewhat uneven. In other examples, the inner surface 326-2 may have another form (for example, the form a substantially cylindrical surface), and may include any type of protrusion or groove to make the inner surface uneven.

The inner surface 326-2 is angled with respect to an axial direction (i.e., relative to a central axis extending from a base of the consumable to the mouthpiece) such that the diameter of the passage 321-2 proximate the mouthpiece aperture 307-2 increases in the downstream direction. The inner surface 326-2 is downstream of the aerosolization chamber 319-2 of the vapor flow passage 321-2.

The grooves 328-2 are generally V-shaped in cross-sectional profile, and extend in the axial direction for the full length of the inner surface 326-2. Each groove 328-2 is formed from a pair of surfaces angled at between 30 and 90 degrees (e.g., 60 degrees) relative to each other. The grooves 328-2 have a depth (measured normal to the inner surface 326-2) of at least 0.2 mm (e.g., at least 0.4 mm). The grooves 328-2 have a depth of less than 0.8 mm (e.g., less than 0.6 mm). The grooves have a depth of substantially 0.5 mm. The inner surface 326-2 comprises 9 grooves 328-2, but may comprise more or less grooves.

The grooves 328-2 are spaced apart from each other by substantially 1 mm at the downstream end of the inner surface 326-2. In other examples, the spacing at the downstream end of grooves or protrusions may be selected such that it is equal to or less than the mass median diameter (as described above) of particles in the flavored aerosol.

The inner surface 326-2 comprises a smooth polished surface between the grooves 328-2. Polishing the surface in this way may provide improved aerodynamic properties. However, in other examples, the inner surface 426-2 may be textured. In such examples, the texture of the surface may provide the uneven surface, and no grooves may be required. In use, the uneven nature of the inner surface 326-2 may make it easier for droplets to form on the inner surface 326-2, preventing large droplets from entering the user's mouth. The grooves 328-2 may help to channel the large droplets back into the consumable.

Figure 9A:
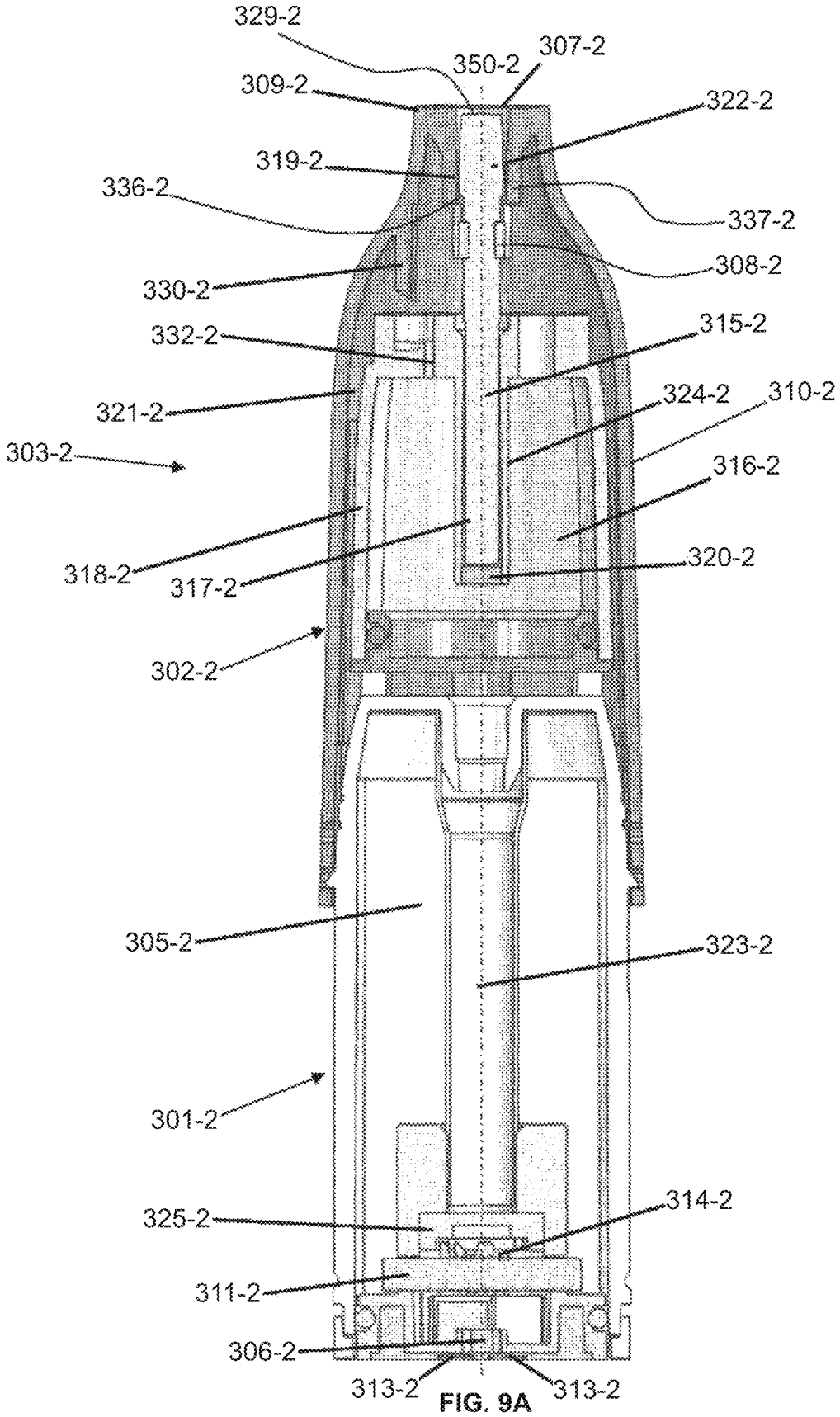
FIG. 9A is a cross-sectional view of a consumable that is a variation of the third embodiment of the second mode in a deactivated state.
Figure 9B:
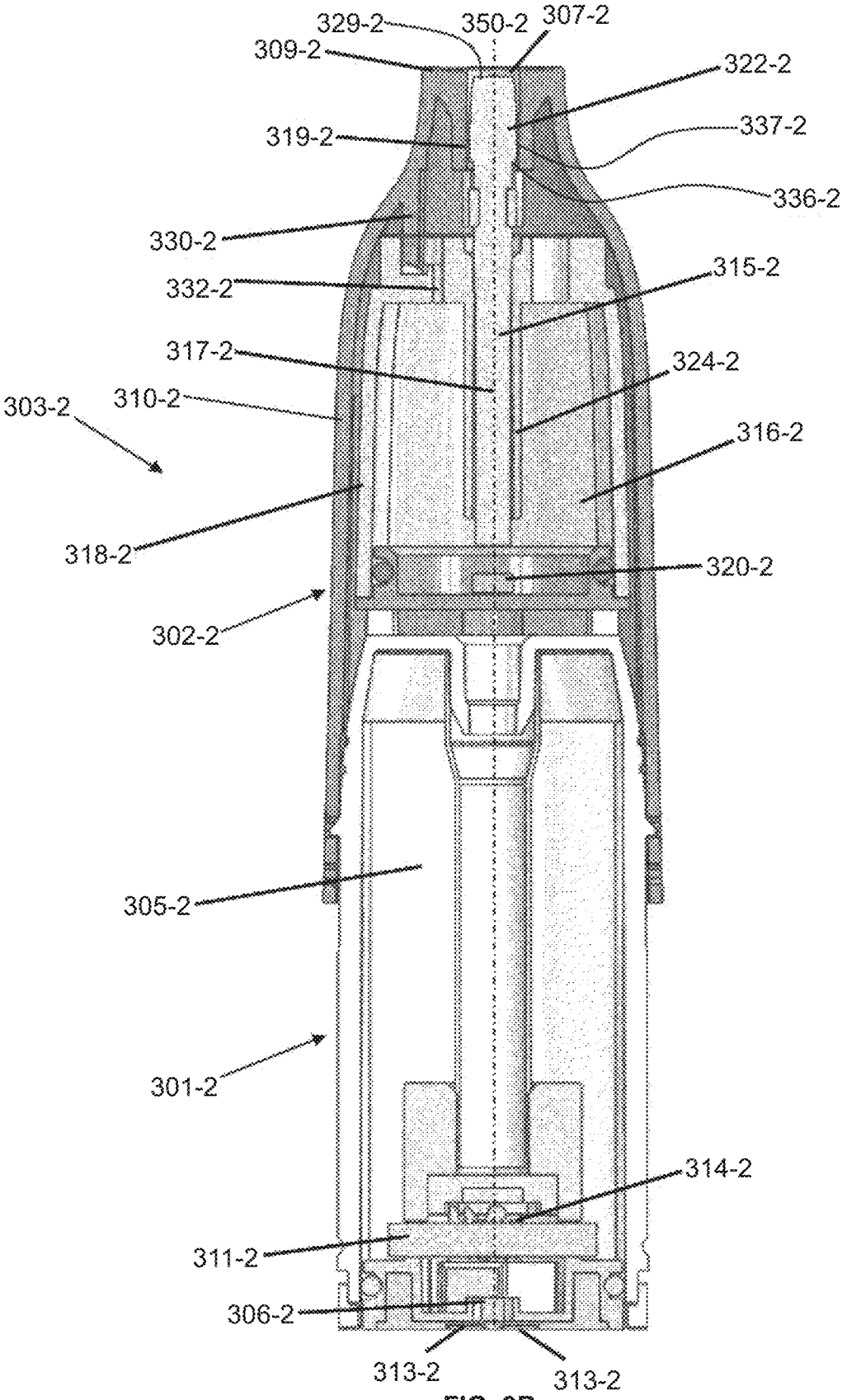
FIG. 9B is a cross-sectional view of the consumable of FIG. 9A in an activated state.
Figure 9C:
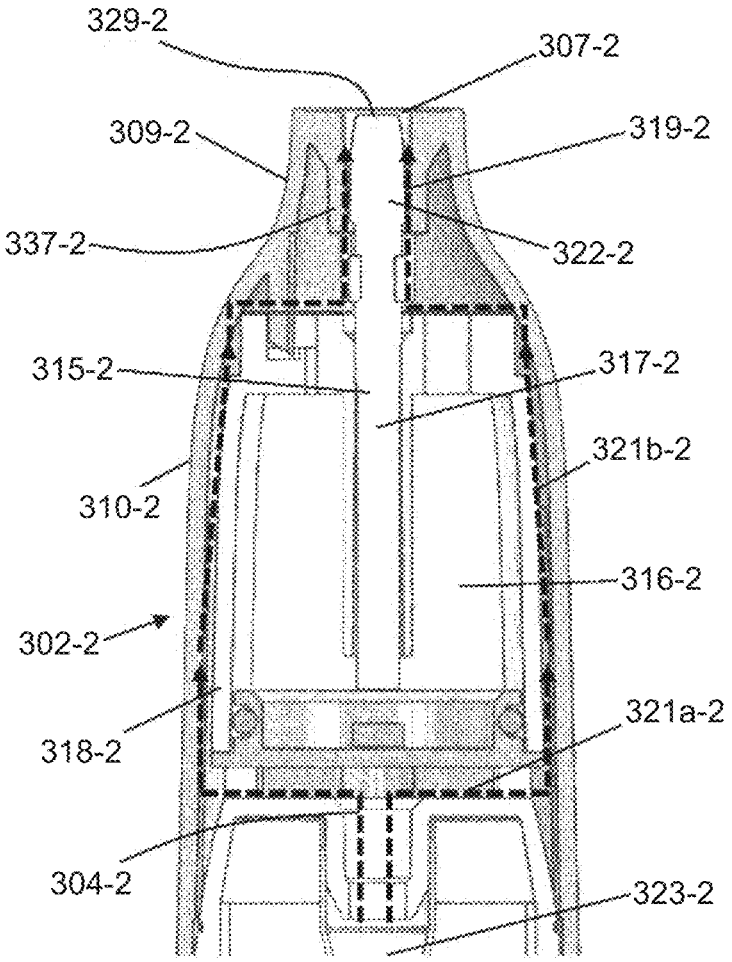
FIG. 9C is a cross-sectional schematic view of the flavor pod portion of the consumable of the variation of the third embodiment of the second mode.

FIG. 9A to FIG. 9C illustrate a variation of the third embodiment of the second mode shown in FIG. 7A to FIG. 7E and thus the same reference numerals have been used for corresponding features. Referring to FIG. 9A, there is shown a consumable 303-2 engageable with a base unit (not shown) via a push-fit engagement. The consumable 303-2 is shown in a deactivated state. The consumable 303-2 may be considered to have two portions—a cartomizer portion 301-2 and flavor pod portion 302-2 (i.e., additive delivery article), both of which are located within a single consumable component 303-2 (as in FIG. 6A and FIG. 6B). It should, however, be appreciated that in a variation, the cartomizer portion 301-2 and flavor pod portion 302-2 may be separate (but engageable) components.

The consumable 303-2 includes an upstream cartomizer inlet opening 306-2 and a downstream mouthpiece aperture 307-2 (i.e., defining an outlet of the consumable 303-2). In other examples a plurality of inlets and/or outlets are included. Between, and fluidly connecting, the inlet opening 306-2 and the mouthpiece aperture 307-2 there is an airflow passage comprising (in a downstream flow direction) a vaporizing chamber 325-2 of the cartomizer, a vapor outlet 323-2 (also of the cartomizer), a downstream flow passage 321-2 (hereinafter referred to as the vapor flow passage) of the flavor pod portion 302-2, and an aerosolization chamber 319-2 (also of the flavor pod portion 302-2). The mouthpiece aperture 307-2 is located at the mouthpiece 309-2 (or mouthpiece portion) of the consumable 303-2.

The aerosolization chamber 319-2 extends longitudinally in an upstream direction from the mouthpiece aperture 307-2. The aerosolization chamber 319-2 is cylindrical (having a circular cross-sectional shape) such that a transverse cross-sectional area of the aerosolization chamber 319-2 is uniform along a longitudinal length of the aerosolization chamber 319-2. The aerosolization chamber 319-2 is defined by a tube 337-2 that extend longitudinally from a longitudinal end surface of the device.

The consumable 303-2 includes a flavor pod portion 302-2. The flavor pod portion 302-2 is configured to generate a first (flavored) aerosol for output from the mouthpiece aperture 307-2. The flavor pod portion 302-2 of the consumable 303-2 includes a liquid transfer element 315-2. This liquid transfer element 315-2 acts as a passive aerosol generator (i.e., an aerosol generator which does not use heat to form the aerosol), and is formed of a porous material. The liquid transfer element 315-2 comprises a conveying portion 317-2 and an aerosol generating portion 322-2, which is located in aerosolization chamber 319-2. In this example, the aerosol generating portion 322-2 is a porous nib. When activated, as discussed in more detail below, a storage chamber 316-2 (defined by a tank 318-2) for storing a first aerosol precursor (i.e., a liquid comprising a flavorant) is fluidly connected to the liquid transfer element 315-2. The flavored aerosol precursor, in this embodiment, is stored in a porous body within the storage chamber 316-2 (but may be a free liquid). In the activated state, the liquid transfer element 315-2 is in contact with the flavored aerosol precursor stored in the storage chamber 316-2 by way of contact with the porous body/free liquid.

The liquid transfer element 315-2 comprises an aerosol generating portion 322-2 and a conveying portion 317-2. The aerosol generating portion 322-2 is located at a downstream end (top of FIG. 9A) of the liquid transfer element 315-2, whilst the conveying portion 317-2 forms the remainder of the liquid transfer element 315-2. The conveying portion 317-2 is elongate and substantially cylindrical.

A distal (i.e., downstream) transversely extending end surface 329-2 of the aerosol generating portion 322-2 is planar, such that the aerosol generating portion 322-2 has a somewhat truncated bulb or bullet-shape. The aerosol generating portion 322-2 is wider (has a greater radius) than the conveying portion 317-2. As is apparent from FIG. 8C (which will be discussed further below) the greater radius of the aerosol generating portion 322-2 means that a transverse transition surface 336-2, in the form of a step, is defined between the downstream end of the conveying portion 317-2 and the upstream end of the aerosol generating portion 322-2.

The liquid transfer element 315-2 extends into and through the storage chamber 316-2, such that the conveying portion 317-2 is in contact with the contents of the storage chamber 316-2. In particular, an inner wall of the tank 318-2 defines a conduit 324-2, through which the liquid transfer element 315-2 extends. The liquid transfer element 315-2 and the conduit 324-2 are located in a substantially central position within the storage chamber 316-2 and are substantially parallel to a central longitudinal axis of the consumable 303-2.

The porous nature of the liquid transfer element 315-2 means that first (flavored) aerosol precursor in the storage chamber 316-2 is drawn into the liquid transfer element 315-2. As the flavored aerosol precursor in the liquid transfer element 315-2 is depleted in use, further flavored aerosol precursor is drawn from the storage chamber 316-2 into the liquid transfer element 315-2 via a wicking action.

Before activation, the storage chamber 316-2 is fluidly isolated from the liquid transfer element 315-2. In this example, the isolation is achieved via a plug 320-2 (preferably formed from silicone) located at one end of a conduit 324-2 surrounding the liquid transfer element 315-2. In other examples, the plug may be replaced by any one of: a duck bill valve; a split valve or diaphragm; or a sheet of foil. The storage chamber 316-2 further includes an air bleed channel 332-2, which in the deactivated state is sealed by a sealing element comprising a pierceable membrane (preferably made from foil). Activation (or piercing) member 330-2, which projects inwardly from the mouthpiece 309-2, and may take the form of a blade, pierces the pierceable membrane and opens the air bleed channel 332-2 when the consumable is moved to the activated state (as is discussed in more detail below). The liquid transfer element 315-2 (i.e., the aerosol generating portion 322-2) is located within the aerosolization chamber 319-2, such that an airflow path is defined between the liquid transfer element 315-2 an inner surface of the tube 337-2 defining the aerosolization chamber 319-2. This airflow path comprises a constricted region which is defined by the aerosol generating portion 322-2. This constriction results in increased air velocity and a corresponding reduction in air pressure of the air flowing along the airflow path and thus the constricted region may be referred to as a Venturi aperture. Although not shown, in some embodiments, one or more supports may extend inwardly from the wall defining the aerosolization chamber 319-2 (e.g., tube 337-2) to contact the aerosol generating portion 322-2 and to support the aerosol generating portion 322-2 within the aerosolization chamber 319-2.

The cartomizer portion 301-2 of the consumable 303-2 includes a reservoir 305-2 (defined by a container) for storing a second (e-liquid) aerosol precursor (which may contain nicotine). A wick 311-2 extends into the reservoir so as to be in contact with (i.e., partially submerged in) the e-liquid aerosol precursor. The wick 311-2 is formed from a porous wicking material (e.g., a polymer) that draws the e-liquid aerosol precursor from the reservoir 305-2 into a central region of the wick 311-2 that is located in the vaporizing chamber 325-2.

A heater 314-2 is a configured to heat the central region of the wick 311-2. The heater 314-2 includes a resistive heating filament that is coiled around the central region of the wick 311-2. The wick 311-2 and the heater 314-2 generally define a vaporizer, and together with the reservoir 305-2 act as an active aerosol generator. The vaporizer (i.e., wick 311-2 and heater 314-2) and aerosol generating portion 322-2 are both at least partially located within the airflow passage, with the aerosol generating portion 322-2 being downstream of the vaporizer. So that the consumable 303-2 may be supplied with electrical power for activation of the heater 314-2, the consumable 303-2 includes a pair of consumable electrical contacts 313-2. The consumable electrical contacts 313-2 are configured for electrical connection to a corresponding pair of electrical supply contacts in the base unit (not shown). The consumable electrical contacts 313-2 are electrically connected to the electrical supply contacts (not shown) when the consumable 303-2 is engaged with the base unit. The base unit includes an electrical power source, for example a battery.

FIG. 9B shows the consumable 303-2 of FIG. 9A in an activated state. To transition from the deactivated state to the activated state, mouthpiece 309-2 is moved along a central longitudinal axis 350-2 in an upstream direction towards cartomizer portion 301-2. The mouthpiece 309-2 is fixed by a collar 308-2 to the conveying portion 317-2 of the liquid transfer element 315-2 and therefore liquid transfer element 315-2 moves with the mouthpiece 309-2. The mouthpiece 309-2 and liquid transfer element 315-2 are moved relative to the tank 318-2. When the mouthpiece 309-2 is moved upstream, activation/piercing member 330-2 contacts and pierces a sealing element in the form of a pierceable membrane extending across the air bleed channel 332-2 thereby fluidly connecting the vapor flow passage 321-2 the storage chamber 316-2. This allows air from the vapor flow passage 321-2 to enter the storage chamber 316-2 as aerosol precursor is removed from the storage chamber 316-2 by the liquid transfer element 315-2. In addition to piercing of the membrane by the piercing member 330-2, liquid transfer element 315-2 pushes on, and moves, plug 320-2 out of the conduit 324-2 which then allows liquid transfer element 315-2 to come into contact with the flavored aerosol precursor stored in the storage chamber 316-2. The plug 320-2 may then be unconstrained within the storage chamber, or may be pushed by liquid transfer element 315-2 into a holding location. Once activated, and in use, a user draws (or "sucks", "pulls", or "puffs") on the mouthpiece 309-2 of the consumable 303-2, which causes a drop in air pressure at the mouthpiece aperture 307-2, thereby generating air flow through the inlet opening 306-2, along the airflow passage, out of the mouthpiece aperture 307-2 and into the user's mouth.

When the heater 314-2 is activated by passing an electric current through the heating filament in response to the user drawing on the mouthpiece 309-2 (the drawing of air may be detected by a pressure transducer), the e-liquid located in the wick 311-2 adjacent to the heating filament is heated and vaporized to form a vapor in the vaporizing chamber 325-2. The vapor condenses to form the e-liquid aerosol within the vapor outlet 323-2. The e-liquid aerosol is entrained in an airflow along the vapor flow passage 321-2, through the aerosolization chamber 319-2, to the mouthpiece aperture 307-2 for inhalation by the user when the user draws on the mouthpiece 309-2.

The base unit supplies electrical current to the consumable electrical contacts (not shown). This causes an electric current flow through the heating filament of the heater 314-2 and the heating filament heats up. As described, the heating of the heating filament causes vaporization of the e-liquid in the wick 311-2 to form the e-liquid aerosol. As the air flows through the aerosolization chamber 319-2, the constricted region of the air path results in an increase in air velocity and corresponding decrease in air pressure in the airflow in the vicinity of the porous aerosol generating portion 322-2. The corresponding low pressure and high air velocity region causes the generation of the flavored aerosol from the porous surface of the aerosol generating portion 322-2 of the liquid transfer element 315-2. The flavored aerosol becomes entrained in the airflow and ultimately is output from the mouthpiece aperture 307-2 of the consumable 303-2 and into the user's mouth.

The flavored aerosol is sized to inhibit pulmonary penetration. The flavored aerosol is formed of particles with a mass median aerodynamic diameter that is greater than 70 microns. The flavored aerosol is sized for transmission within at least one of a mammalian oral cavity and a mammalian nasal cavity. The flavored aerosol is formed by particles having a maximum mass median aerodynamic diameter that is less than 100 microns. Such a range of mass median aerodynamic diameter will produce aerosols which are sufficiently small to be entrained in an airflow caused by a user drawing air through the device and to enter and extend through the oral and or nasal cavity to activate the taste and/or olfactory receptors.

The e-liquid aerosol generated is sized for pulmonary penetration (i.e., to deliver an active ingredient such as nicotine to the user's lungs). The e-liquid aerosol is formed of particles having a mass median aerodynamic diameter of less than 1 micron. Such sized aerosols tend to penetrate into a human user's pulmonary system, with smaller aerosols generally penetrating the lungs more easily. The e-liquid aerosol may also be referred to as a vapor.

The size of aerosol formed without heating is typically smaller than that formed by condensation of a vapor.

FIG. 9C illustrates the flow of vapor through the flavor pod portion 302-2 of FIG. 9A and FIG. 9B. The flavor pod portion 302-2 is shown in the activated state. The cartomizer is not shown, but it should be appreciated that the flavor pod portions 302-2 is engaged with the cartomizer 301-2 of FIG. 9A and FIG. 9B. In other embodiments, however, the consumable 303-2 may not comprise a cartomizer portion, and may provide only flavor to the user.

As is provided above, the flavor pod portion 302-2 comprises an upstream (i.e., upstream with respect to flow of air in use) vapor passage inlet 304-2 (in fluid communication with the vapor outlet 323-2) and a downstream (i.e., downstream with respect to flow of air in use) outlet in the form of a mouthpiece aperture 307-2. Between, and fluidly connecting the vapor passage inlet 304-2 and the mouthpiece aperture 307-2, is a vapor flow passage 321-2 and aerosolization chamber 319-2.

The vapor flow passage 321-2 comprises a transverse portion 321*a*-2. The airflow path through the device deflects at the vapor passage inlet 304-2, i.e., there is a deflection between the vapor outlet 323-2 and the transverse portion 321*a*-2 of the vapor flow passage 321-2.

The vapor flow passage 321-2 then deflects again from the transverse portion 321*a*-2 to a longitudinal portion 321*b*-2 which extends generally longitudinally between a device housing 310-2 (which is integral with the mouthpiece 309-2) and the tank 318-2. The vapor flow passage 321-2 deflects again at the upper surface of the tank 318-2 within the mouthpiece 309-2 such that airflow/vapor is directed through the aerosolization chamber 319-2, towards the mouthpiece aperture 307-2.

The vapor flow passage 321-2 may be a single (annular) flow passage around the tank 318-2 or it may comprise two branches which split around the tank 318-2 and re-join within the mouthpiece 309-2 proximal the liquid transfer element 315-2.

In use, when a user draws on the mouthpiece 309-2, air flow is generated through the air flow passage through the device. Air (comprising the e-liquid aerosol from the cartomizer portion 301-2 as explained above with respect to FIG. 9A) flows through the vapor outlet 323-2 and into the vapor passage 321-2. Further downstream, as air flows past the aerosol generating portion 322-2 in the aerosolization chamber 319-2, the velocity of the air increases, resulting in a drop in air pressure. As a result, the flavored aerosol precursor held in the aerosol generating portion 322-2 becomes entrained in the air so as to form the flavored aerosol. The flavored aerosol has the particle size and other properties described above with respect to FIG. 9A.

As the flavored aerosol precursor becomes entrained within the air, the liquid transfer element 315-2 transfers further flavored aerosol precursor from the storage chamber 316-2 to the aerosol generating portion 322-2. More specifically, the liquid transfer element wicks the flavored aerosol precursor from the storage chamber 316-2 to the aerosol generating portion 322-2.

Figure 8A:
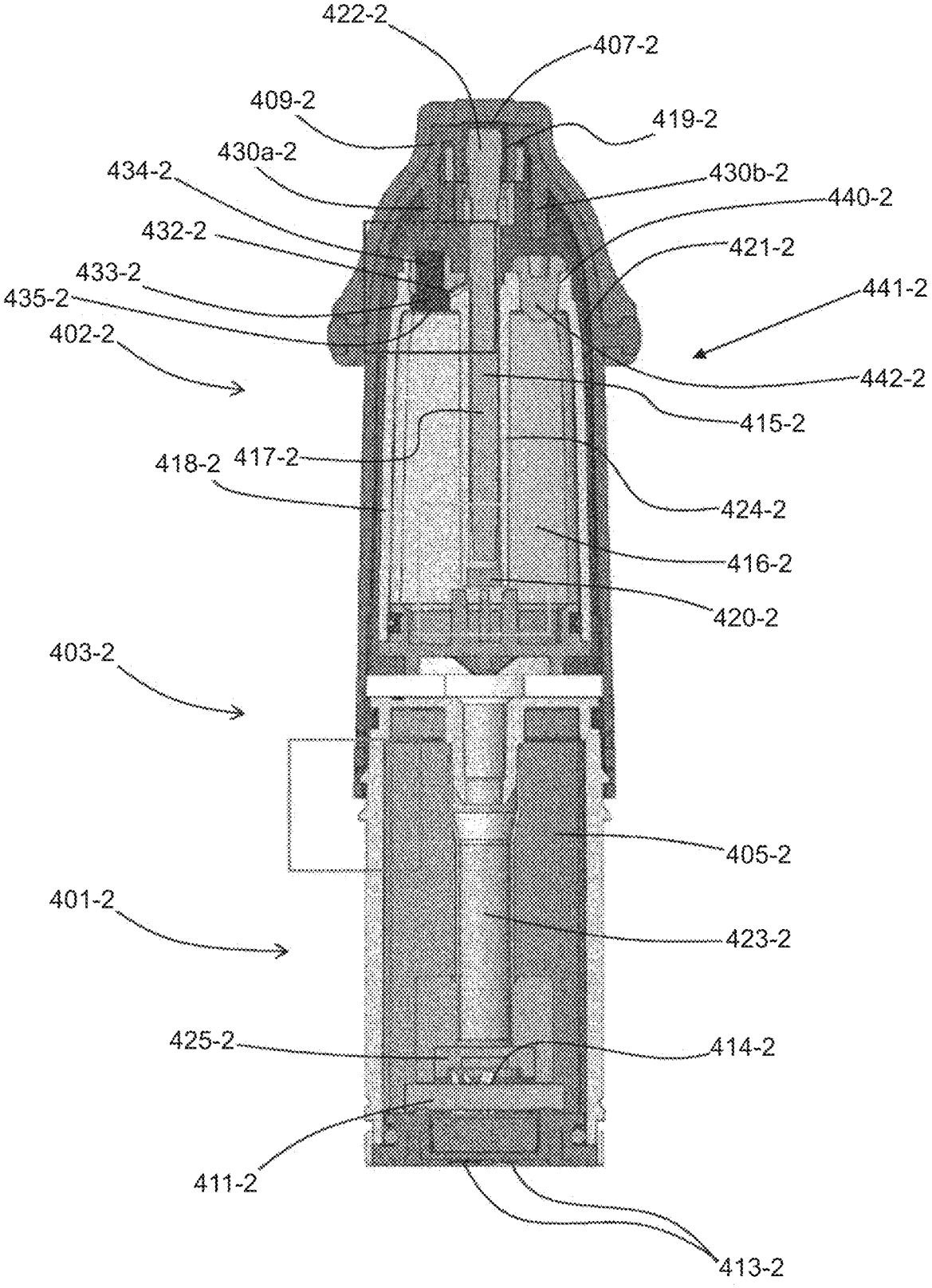
FIG. 8A is a cross-sectional view of a consumable according to a fourth embodiment of the second mode in a deactivated state.
Figure 8B:
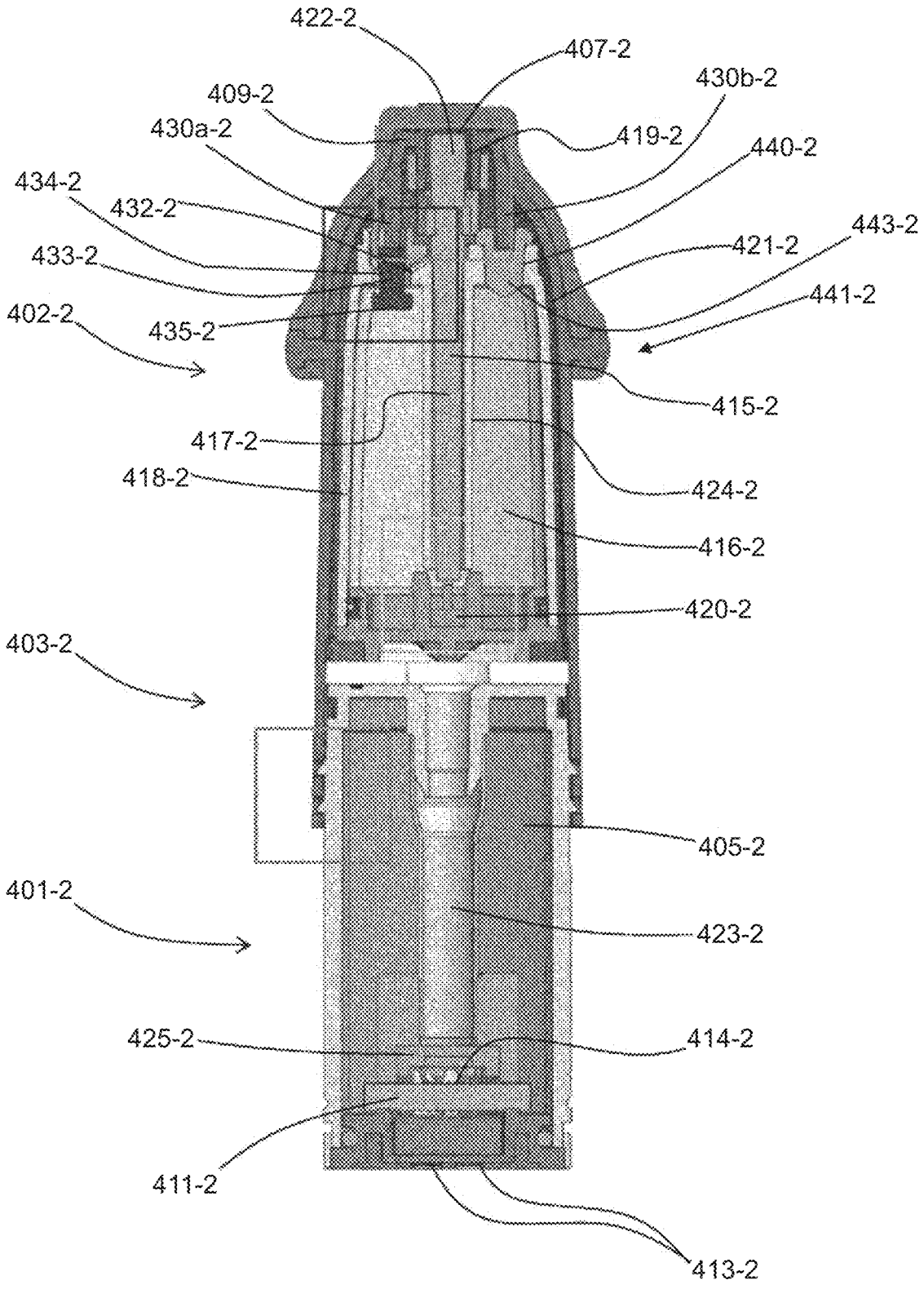
FIG. 8B is a cross-sectional view of a consumable according to the fourth embodiment of the second mode in an activated state.
Figure 8C:
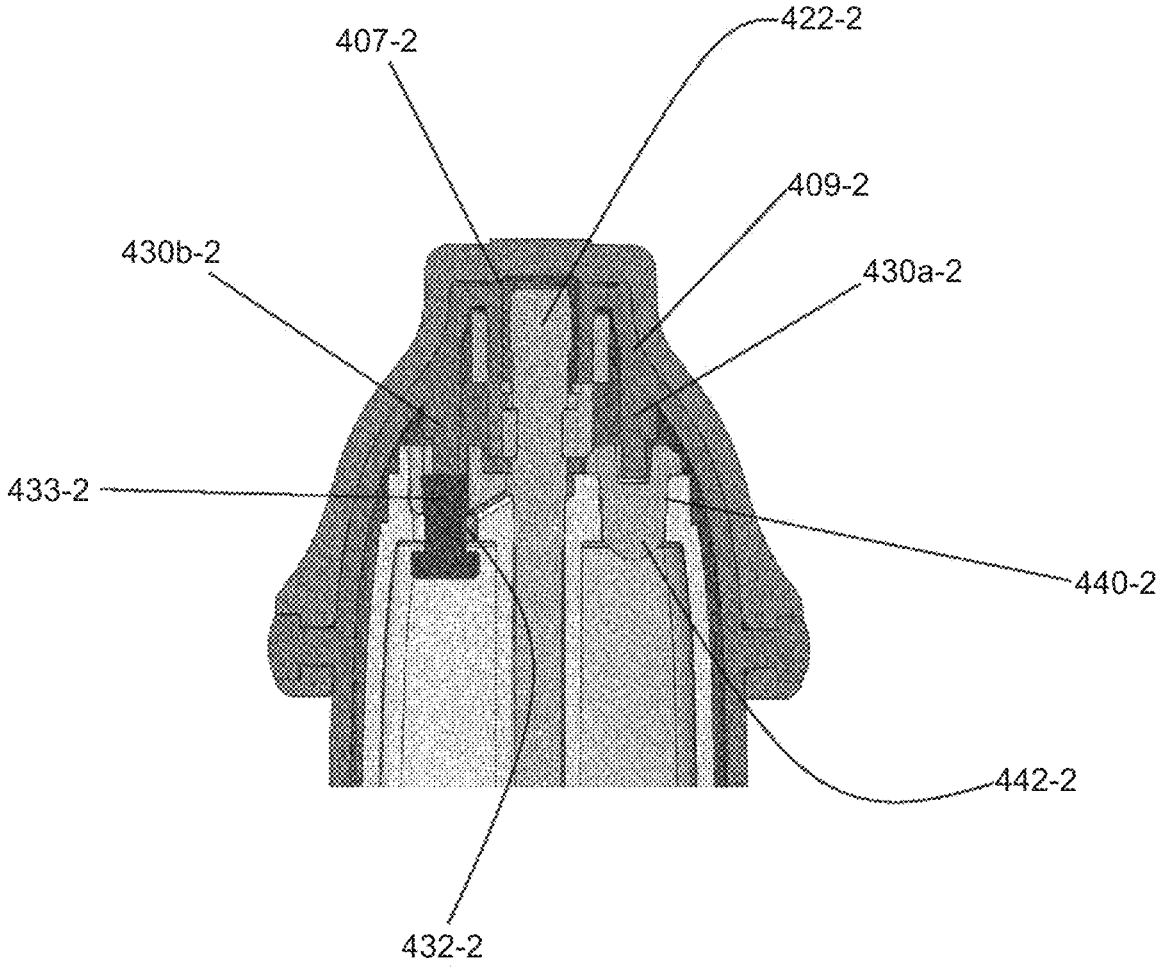
FIG. 8C shows an enlarged view of the mouthpiece portion of the fourth embodiment of the second mode.

FIG. 8A, FIG. 8B, and FIG. 8C illustrate a consumable 404-2 of an aerosol delivery device, according to a fourth embodiment of the second mode. This embodiment includes many of the same features of the embodiment described above and shown in FIG. 7A to FIG. 7E and FIG. 9A to FIG. 9C and, for that reason, corresponding reference numerals have been used (albeit with a unit increase of the first digit to represent the further embodiment). The description of those features has not been repeated here. FIG. 8A shows the consumable 404-2 in a deactivated state (with the terminal element 341-2 in its first orientation) and FIG. 8B shows the consumable 404-2 in an activated state (with the terminal element 341-2 in its first orientation). FIG. 8C shows an enlarged view of the mouthpiece portion 409-2 in the activated state with the terminal element in its second orientation, i.e., with the terminal housing 441-2 rotated by 180 degrees.

Unlike the previously described embodiment, the presently illustrated embodiment comprises a different mechanism for opening the air bleed channel 432-2 upon activation of the consumable 403-2. In this embodiment, when in the deactivated state (FIG. 8A) the air bleed channel 432-2 is obstructed by a silicone bung 433-2 sealing element received in the air bleed channel 432-2. In particular, a body 434-2 of the bung 433-2 is received in the air bleed channel 432-2, but does not fully obstruct the air bleed channel 432-2. That is, a portion of the air bleed channel 432-2 remains unobstructed by the body 434-2 of the bung 433-2. However, an enlarged head 435-2 of the bung 433-2, which is located in the storage chamber 416-2, extends fully across the entrance to the air bleed channel 432-2 so as to obstruct the channel 432-2. When the terminal element 441-2 or the mouthpiece portion 409-2 (alternatively referred to as the mouthpiece 409-2) is moved in the upstream longitudinal direction to activate the consumable 403-2, an elongate first activation member 430*a*-2 (extending inwardly from an inner surface of the mouthpiece portion 409-2) engages the body 434-2 of the bung 433-2 and pushes the bung 433-2 in the upstream direction (see FIG. 8B). This moves the enlarged head 435-2 of the bung 433-2 away from the entrance of the air bleed channel 432-2 such that the head 435-2 no longer obstructs the air bleed channel 432-2. This allows air to pass from the vapor flow passage 421-2 and into the storage chamber 416-2 (which, in turn, allows for flow of the flavored aerosol precursor from the storage chamber 416-2).

It should be noted that the bung sealing element shown in FIG. 8A and FIG. 8B could be used in place of the pierceable membrane in FIG. 7A and FIG. 7B and vice versa.

The second activation member 430*b*-2 is received within a bore provided in a bung 442-2 sealing the filling port 440-2. Of course, when the device is assembled with the terminal element 441-2 in its second orientation, the first activation member 430*a*-2 is received within the bore provided in the bung 442-2 sealing the filling port 440-2 and the second activation member 430*b*-2 moves the silicone bung 433-2 within the air bleed channel 432-2 as shown in FIG. 8C.

The aerosol generating portion 422-2 of the liquid transfer element shown in the FIG. 8A and FIG. 8B has a flattened (or planar) upper (downstream) surface. Such a liquid transfer element could be used in the embodiment shown in FIG. 7A and FIG. 7B.

Figure 10:
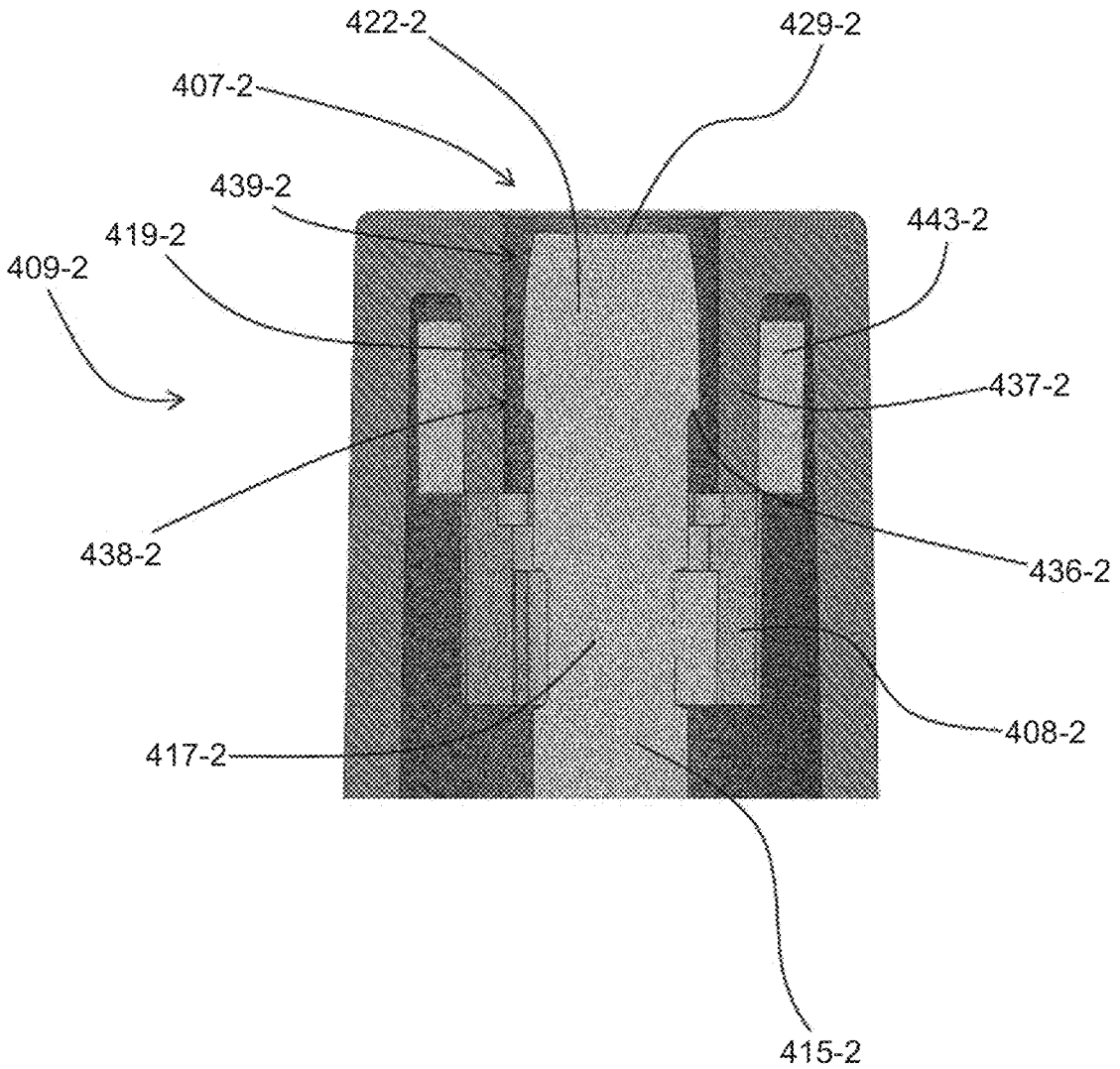
FIG. 10 is a detailed cross-sectional view of the mouthpiece of a consumable that is a variation of the fourth embodiment of the second mode.

FIG. 10 provides a detailed view of a mouthpiece 409-2 that is similar to that shown in FIG. 8A to FIG. 8C, albeit having a slightly modified shape. Given the similarity, the same references numerals have been used for corresponding features. As is apparent from FIG. 10, the conveying portion 417-2 has a smaller cross-sectional area than the aerosol generating portion 422-2 of the liquid transfer element 415-2. As a result, a step (from the conveying portion 417-2 to the aerosol generating portion 422-2) is defined by a radial transition surface 436-2. The transition surface 436-2 has a concave profile such that there is a smooth transition between the conveying portion 417-2 and the transition surface 436-2 and a sharp/hard edge between the transition surface 436-2 and the aerosol generating portion 422-2.

This edge is an upstream leading edge of the aerosol generating portion 422-2 and defines an upstream end of a constricted region 438-2 of an airflow path between the aerosol generating portion 422-2 and the tube 437-2 defining the aerosolization chamber 419-2. Downstream of this constricted region 438-2 is an expansion region 439-2. In this expansion region 439-2 the airflow path gradually increases in cross-sectional area in the downstream direction. This a result of the aerosol generating portion 422-2 having a slight inward taper towards the planar distal end surface 429-2 and the cylindrical shape of the aerosolization chamber 419-2.

Also shown in more detail in FIG. 10 is the collar 408-2, which partially circumscribes the liquid transfer element 415-2. The collar 408-2 is connected to a mounting portion 443-2, which surrounds the tube 437-2 so as to mount the collar 408-2 to the tube 437-2. In this way, the liquid transfer element 415-2 is fixed with respect to the mouthpiece 409-2 (i.e., so as to move with the mouthpiece 409-2 between the activated and deactivated states discussed above).

Figure 11A:
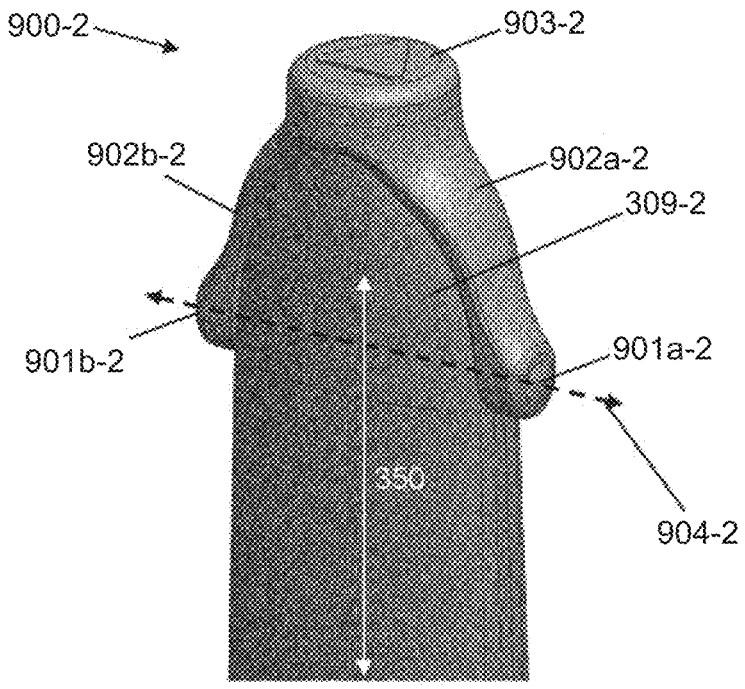
FIG. 11A is a perspective view of a hinged cap in a sealed configuration.

FIG. 11A shows a perspective view of a consumable according to the second mode of the present disclosure. The consumable includes a hinged cap 900-2 located on an exterior of the consumable. The hinged cap includes protrusions 901*a*-2 and 901*b*-2, which extend from an outer housing of the consumable. Around each protrusion is an arm 902*a*-2, 902*b*-2, which is rotatable relative to the protrusion, and which extends away from the protrusion towards an upper end of the consumable. Each arm widens as it projects from the protrusion, and at the end of both arms is a cap portion 903-2. The cap portion 903-2 wider than the mouthpiece 309-2, 409-2, but only slightly, such that a snug interference fit is achieved between the cap portion and the mouthpiece. The hinged cap is rotatable around axis 904-2, which is transversal to the central longitudinal axis 350-2 discuss above. Accordingly, the cap is rotatable from the sealed configuration shown in FIG. 11A in which the mouthpiece 309-2, 409-2 is sealed from the outside of the aerosol delivery device to an open configuration shown in FIG. 11B. In this configuration, the aerosol generating portion 322-2, 422-2 is exposed to the outside environment, and the user can operate the aerosol delivery device. The hinged cap, and notably the arms 902*a*-2, 902*b*-2, and cap portion 903-2 are formed from a resiliently deformable material such as silicone. This allows the cap to fit snugly over the mouthpiece whilst also allowing it to easily be removed through deformation.

Figure 11B:
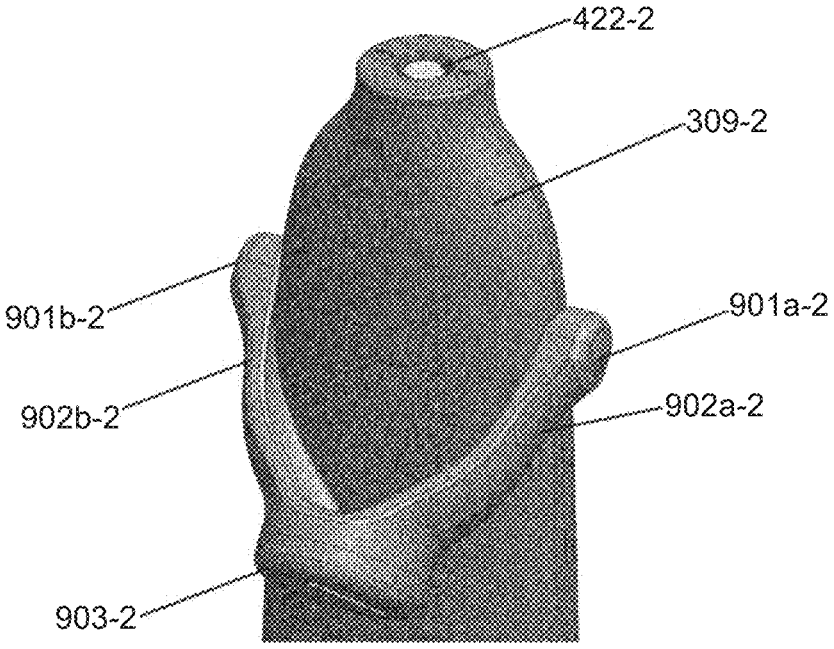
FIG. 11B is a perspective view of the hinged cap of FIG. 11A in an open configuration.

The hinged cap 900-2 of FIG. 11A and FIG. 11B is usable in combination with any of the consumables disclosed herein.

The following numbered illustrative embodiments may be useful in understanding the second mode of the disclosure herein:

Illustrative Embodiment 1. An aerosol delivery device comprising: a mouthpiece comprising an end surface at a longitudinal end of the mouthpiece, and a mouthpiece aperture formed in the end surface; an aerosolization chamber extending longitudinally into the device from the mouthpiece aperture; a storage chamber for storing an aerosol precursor; and a porous liquid transfer element comprising an aerosol generating portion at least partly received in the aerosolization chamber and a conveying portion for conveying liquid from the storage chamber to the aerosol generating portion, characterized in that a transverse cross-sectional area of the aerosolization chamber is uniform along a longitudinal length of the aerosolization chamber.

Illustrative Embodiment 2. An aerosol delivery device according to illustrative embodiment 1, wherein the aerosol generating portion has a larger transverse cross-sectional area than a transverse cross-sectional area of the conveying portion.

Illustrative Embodiment 3. An aerosol delivery device according to illustrative embodiment 2, wherein a transversely extending transition surface is defined between the conveying portion and the aerosol generating portion.

Illustrative Embodiment 4. An aerosol delivery device according to illustrative embodiment 3, wherein the transition surface comprises a concave profile.

Illustrative Embodiment 5. An aerosol delivery device according to any one of the preceding illustrative embodiments 1 or 2, wherein the aerosolization chamber has a cylindrical shape.

Illustrative Embodiment 6. An aerosol delivery device according to any one of the preceding illustrative embodiments, where a distal transversely extending end surface of the aerosol generating portion is substantially planar.

Illustrative Embodiment 7. An aerosol delivery device according to illustrative embodiment 6, wherein the planar transversely extending end surface is spaced from the mouthpiece aperture in an upstream longitudinal direction.

Illustrative Embodiment 8. An aerosol delivery device according to illustrative embodiment 7, wherein the spacing of the transversely extending end surface from the mouthpiece aperture is less than 1 mm.

Illustrative Embodiment 9. An aerosol delivery device according to any one of the preceding illustrative embodiments, wherein the aerosol generating portion is fully received in the aerosolization chamber.

Illustrative Embodiment 10. An aerosol delivery device according to illustrative embodiment 9, wherein an airflow path through the aerosolization chamber is defined between the aerosol generating portion and one or more walls defining the aerosolization chamber, the airflow path comprising a constricted region defining the narrowest part of the airflow path.

Illustrative Embodiment 11. An aerosol delivery device according to illustrative embodiment 10, wherein the airflow path comprises an expansion region downstream of the constricted region.

Illustrative Embodiment 12. An aerosol delivery device according to illustrative embodiment 11, wherein the cross-sectional area of the airflow path in the expansion region increase in the downstream direction.

Illustrative Embodiment 13. An aerosol delivery device according to any one of the preceding illustrative embodiments, comprising an inlet and a flow passage fluidly connecting the inlet to the aerosolization chamber.

Illustrative Embodiment 14. An aerosol delivery device according to any one of the preceding illustrative embodiments, further comprising a cartomizer comprising a vaporizer in fluid communication with the inlet of the flow passage for delivering a vapor to the flow passage.

Illustrative Embodiment 15. An aerosol delivery device system, comprising an aerosol delivery device according to any one of the preceding illustrative embodiments and a base unit comprising a power source.

The following further numbered illustrative embodiments may be useful in understanding the second mode of the disclosure herein:

Illustrative Embodiment 16. An aerosol delivery device, comprising: a passive aerosol generator, for passively generating an aerosol from an aerosol precursor; a mouthpiece, fluidly connected to the passive aerosol generator; a reservoir of aerosol precursor, fluidly connected to the passive aerosol generator; and a hinged cap, which is rotatable relative to the mouthpiece, such that the hinged cap is movable between a sealing configuration in which the hinged cap seals the mouthpiece, and an open configuration in which the hinged cap does not seal the mouthpiece.

Illustrative Embodiment 17. The aerosol delivery device of illustrative embodiment 16, wherein the hinged cap is rotatable around an axis which is transversal to a longitudinal axis of the aerosol delivery device.

Illustrative Embodiment 18. The aerosol delivery device of either illustrative embodiment 16 or illustrative embodiment 17, wherein the hinged cap includes a first hinge and a second hinge, disposed on opposite sides of the aerosol delivery device.

Illustrative Embodiment 19. The aerosol delivery device of illustrative embodiment 18, wherein each hinge is formed of: a protrusion from an outer housing of the aerosol delivery device; and an arm, attached to the protrusion, and rotatable relative thereto.

Illustrative Embodiment 20. The aerosol delivery device of illustrative embodiment 18 or illustrative embodiment 19, wherein the hinged cap including a first arm attached to the first hinge and a second arm attached to the second hinge, wherein the arms extend from their respective hinges to a cap portion, and which increase in width towards the cap portion.

Illustrative Embodiment 21. The aerosol delivery device of any of illustrative embodiment 16 to illustrative embodiment 20, wherein the hinged cap is formed of a resiliently deformable material.

Illustrative Embodiment 22. The aerosol delivery device of illustrative embodiment 21, wherein the hinged cap is formed of silicone.

Illustrative Embodiment 23. The aerosol delivery device of any of illustrative embodiment 16 to illustrative embodiment 22, wherein in the sealing configuration, the hinged cap sits over an end portion of the aerosol delivery device.

Illustrative Embodiment 24. The aerosol delivery device of any of illustrative embodiment 16 to illustrative embodiment 23, wherein the mouthpiece has a cross-sectional profile, and wherein the hinged cap has a corresponding cross-sectional profile.

Illustrative Embodiment 25. The aerosol delivery device of any of illustrative embodiment 16 to illustrative embodiment 24, wherein the hinged cap seals the mouthpiece via an interference fit around the mouthpiece.

Illustrative Embodiment 26. The aerosol delivery device of any of illustrative embodiment 16 to illustrative embodiment 25, wherein a portion of the passive aerosol generator is provided within the mouthpiece.

Illustrative Embodiment 27. The aerosol delivery device of any of illustrative embodiment 16 to illustrative embodiment 26, wherein the passive aerosol generator includes a Venturi aperture, and a porous member is located within the Venturi aperture and fluidly connected to the reservoir of aerosol precursor.

Illustrative Embodiment 28. The aerosol delivery device of any of illustrative embodiment 16 to illustrative embodiment 26, wherein the aerosol precursor is flavor aerosol precursor and is substantially nicotine free.

Illustrative Embodiment 29. The aerosol delivery device of any of illustrative embodiment 16 to illustrative embodiment 28, wherein the aerosol delivery device is a consumable for a smoking substitute device.

Illustrative Embodiment 30. A substitute smoking device, including the aerosol delivery device according to any of illustrative embodiment 16 to illustrative embodiment 28.

Third Mode: An Aerosol Delivery Device Configured to Reduce Leakage by Including an Absorbent Member to Absorb Condensed e-Liquid Vapor.

Figure 12A:
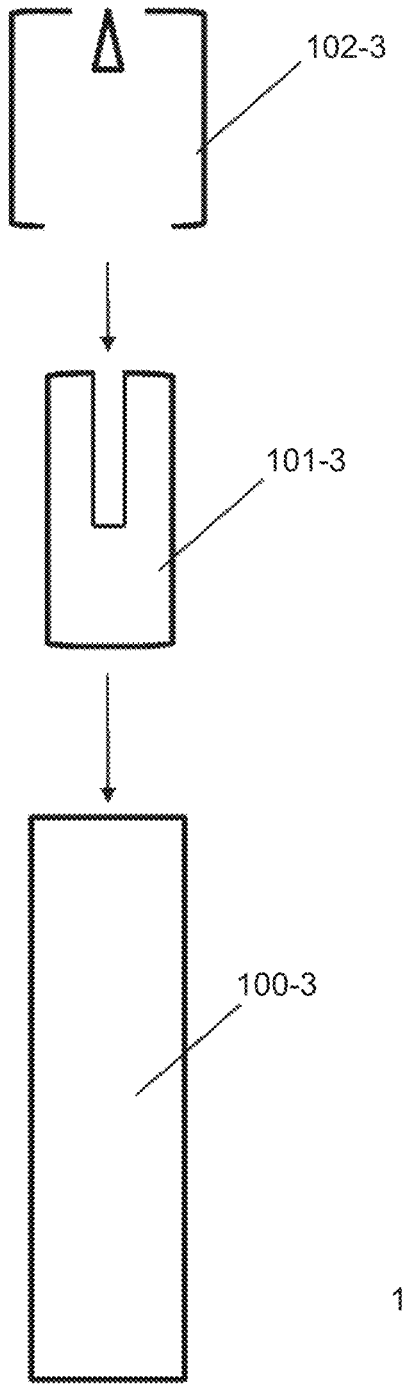
FIG. 12A and FIG. 12B is a schematic drawing of an aerosol delivery system according to a first embodiment of a third mode.
Figure 12B:
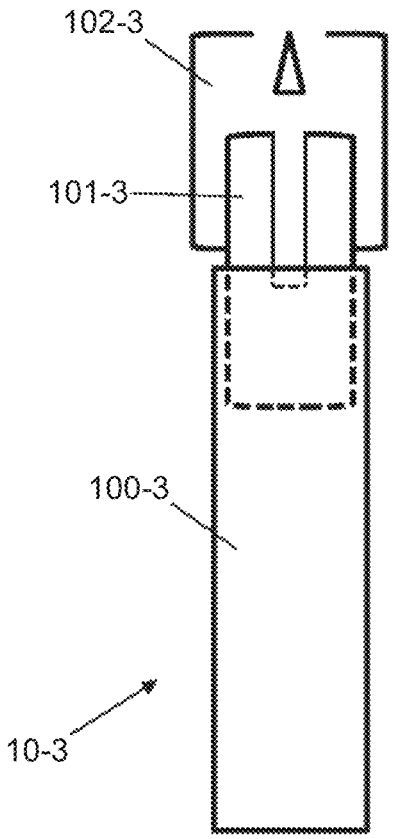

Referring to FIG. 12A and FIG. 12B, there is shown a schematic view of an aerosol delivery device, according to a first embodiment of a third mode, in the form of a smoking substitute system 10-3. In this example, the smoking substitute system 10-3 comprises a cartomizer 101-3 and an additive delivery article in the form of a flavor pod 102-3 connected to a base unit 100-3. In this example, the base unit 100-3 includes elements of the smoking substitute system 10-3 such as a battery, an electronic controller, and a pressure transducer (not shown). The cartomizer 101-3 may engage with the base unit 100-3 via a push-fit engagement, a screw-thread engagement, or a bayonet fit, for example. A cartomizer may also be referred to as a "pod".

The flavor pod 102-3 is configured to engage with the cartomizer 101-3 and thus with the base unit 100-3. The flavor pod 102-3 may engage with the cartomizer 101-3 via a push-fit engagement, a screw-thread engagement, or a bayonet fit, for example. FIG. 12B illustrates the cartomizer 101-3 engaged with the base unit 100-3, and the flavor pod 102-3 engaged with the cartomizer 101-3. As will be appreciated, in this example, the cartomizer 101-3 and the flavor pod 102-3 are distinct elements.

As will be appreciated from the following description, in other embodiments the cartomizer 101-3 and the flavor pod 102-3 may be combined into a single component that implements the combined functionality of the cartomizer 101-3 and flavor pod 102-3. Such a single component may also be referred to as an aerosol delivery device. In other examples, the cartomizer may be absent, with only a flavor pod 102-3 present.

Figure 13A:
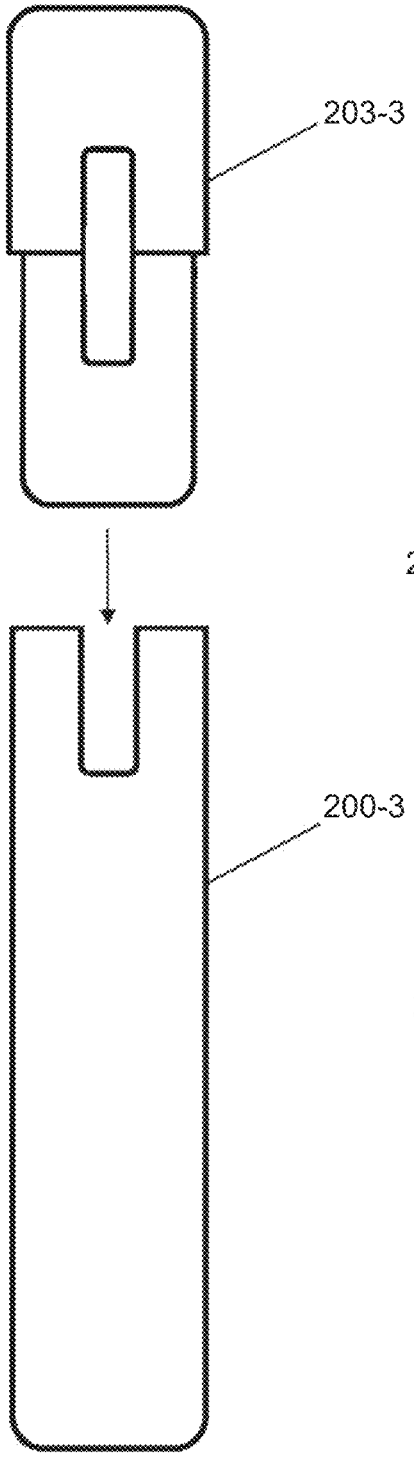
FIG. 13A and FIG. 13B is a schematic drawing of an aerosol delivery system according to a second embodiment of the third mode.
Figure 13B:
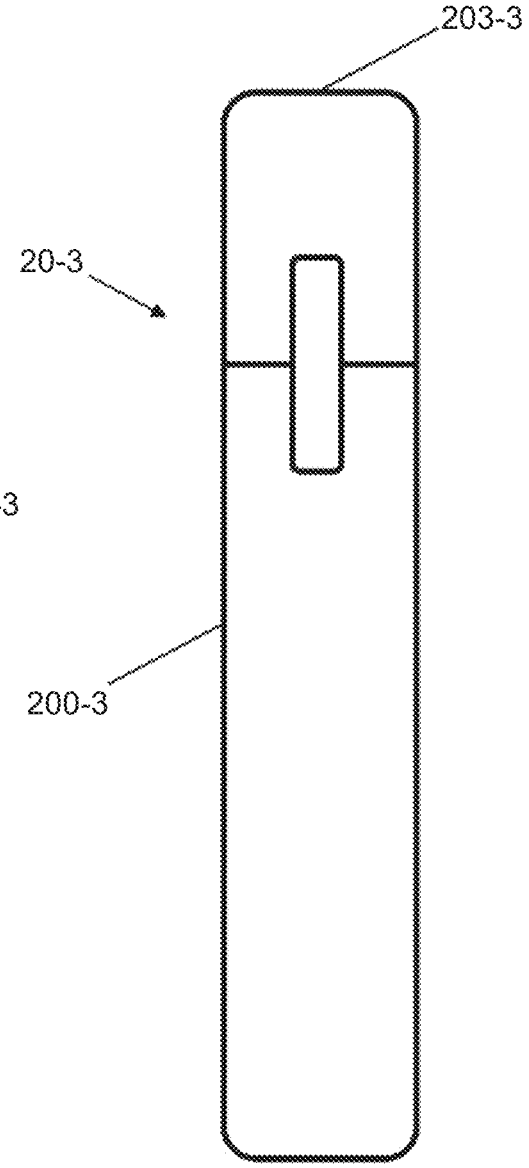
Figure 14A:
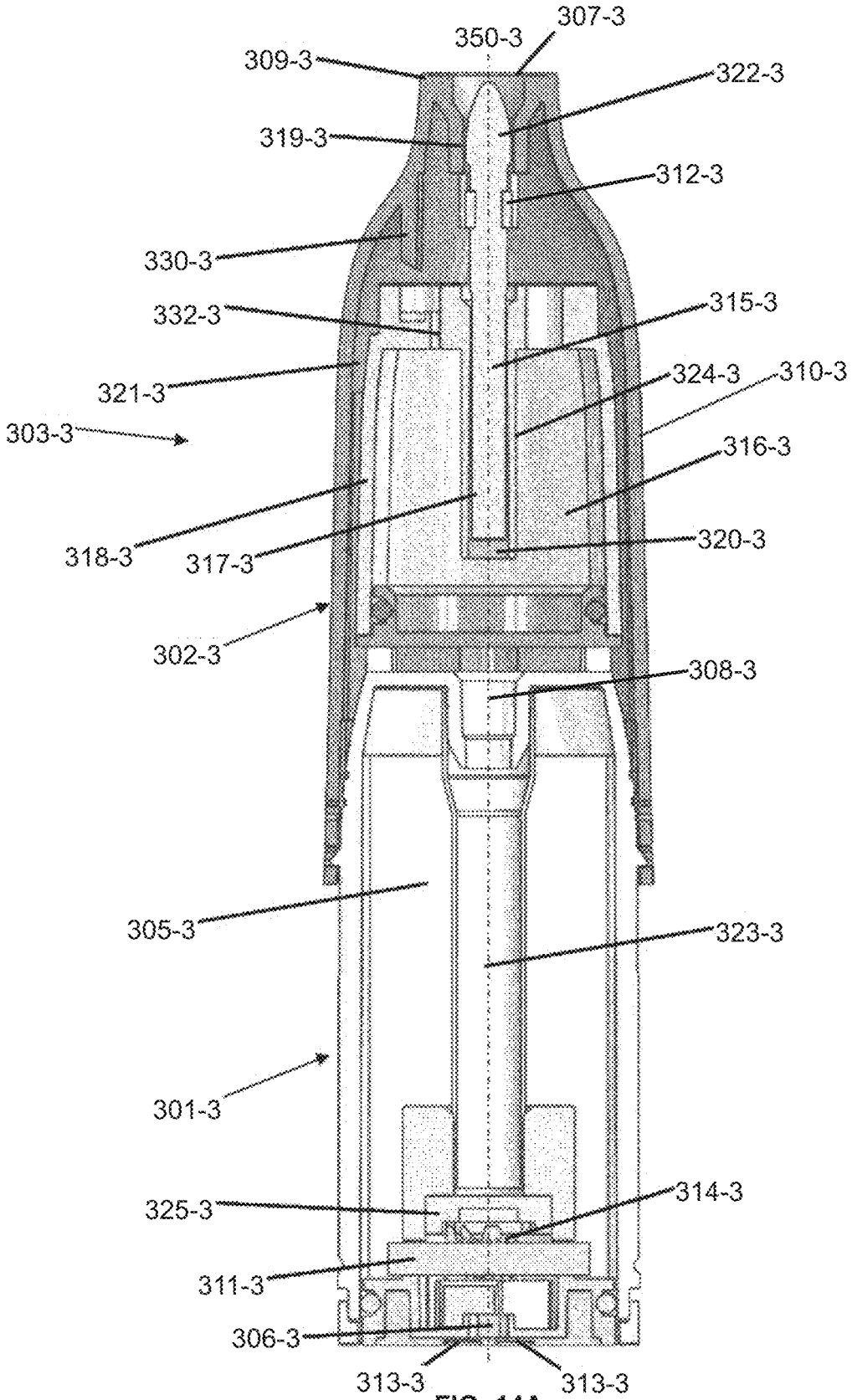
FIG. 14A is a cross-sectional view of a consumable according to a third embodiment of the third mode in a deactivated state.

As is set forth above, reference to a "consumable" component may mean that the component is intended to be used once until exhausted, and then disposed of as waste or returned to a manufacturer for reprocessing. Referring to FIG. 13A and FIG. 13B, there is shown a smoking substitute system 20-3 comprising a base unit 200-3 and a consumable 203-3, according to a second embodiment of the third mode. The consumable 203-3 combines the functionality of the cartomizer 101-3 and the flavor pod 102-3. In FIG. 13A, the consumable 203-3 and the base unit 200-3 are shown separated from one another. In FIG. 13B, the consumable 203-3 and the base unit 200-3 are engaged with each other to form the smoking substitute system 20-3. Referring to FIG. 14A, there is shown a consumable 303-3 engageable with a base unit (not shown) via a push-fit engagement, according to a third embodiment of the third mode. The consumable 303-3 is shown in a deactivated state. The consumable 303-3 may be considered to have two portions—a cartomizer portion 301-3 and flavor pod portion 302-3 (i.e., additive delivery article), both of which are located within a single consumable component 303-3 (as in FIG. 13A and FIG. 13B). It should, however, be appreciated that in a variation, the cartomizer portion 301-3 and flavor pod portion 302-3 may be separate (but engageable) components.

The consumable 303-3 includes an upstream cartomizer inlet opening 306-3 and a downstream mouthpiece aperture 307-3 (i.e., defining an outlet of the consumable 303-3). In other examples a plurality of inlets and/or outlets are included. Between, and fluidly connecting, the inlet opening 306-3 and the mouthpiece aperture 307-3 there is an airflow passage 308-3. This airflow passage 308-3 is formed (in a downstream flow direction) of a vaporizing chamber 325-3 of the cartomizer, a vapor outlet 323-3 (also of the cartomizer) and a downstream vapor flow passage 321-3 of the flavor pod portion 302-3. The mouthpiece aperture 307-3 is located at the mouthpiece 309-3 of the consumable 303-3.

As above, the consumable 303-3 includes a flavor pod portion 302-3. The flavor pod portion 302-3 is configured to generate a (flavor) aerosol for output from the mouthpiece aperture 307-3. The flavor pod portion 302-3 of the consumable 303-3 includes a liquid transfer element 315-3. This liquid transfer element 315-3 acts as a passive aerosol generator (i.e., an aerosol generator which does not use heat to form the aerosol), and is formed of a porous material. The liquid transfer element 315-3 comprises a conveying portion 317-3 and an aerosol generating portion 322-3, which is located in the vapor flow passage 321-3. In this example, the aerosol generating portion 322-3 is a porous nib. When activated, as discussed in more detail below, a storage chamber 316-3 (defined by a tank 318-3) for storing a flavored liquid aerosol precursor is fluidly connected to the liquid transfer element 315-3. The flavored aerosol precursor, in this embodiment, is stored in a porous body within the storage chamber 316-3 (but may be a free liquid). In the activated state, the liquid transfer element 315-3 is in contact with the flavored aerosol precursor stored in the storage chamber 316-3 by way of contact with the porous body/free liquid. The liquid transfer element 315-3 comprises an aerosol generating portion 322-3 and a conveying portion 317-3. The aerosol generating portion 322-3 is located at a downstream end (top of FIG. 14A) of the liquid transfer element 315-3, whilst the conveying portion 317-3 forms the remainder of the liquid transfer element 315-3. The conveying portion 317-3 is elongate and substantially cylindrical. The aerosol generating portion 322-3 is bulb/bullet-shaped, and comprises a portion which is wider (has a greater radius) than the conveying portion 317-3. The aerosol generating portion 322-3 tapers to a tip at a downstream end of the liquid transfer element 315-3.

The liquid transfer element 315-3 extends into and through the storage chamber 316-3, such that the conveying portion 317-3 is in contact with the contents of the storage chamber 316-3. In particular, an inner wall of the tank 318-3 defines a conduit 324-3, through which the liquid transfer element 315-3 extends. The liquid transfer element 315-3 and the conduit 324-3 are located in a substantially central position within the storage chamber 316-3 and are substantially parallel to a central longitudinal axis of the consumable 303-3.

The porous nature of the liquid transfer element 315-3 means that flavored aerosol precursor in the storage chamber 316-3 is drawn into the liquid transfer element 315-3. As the flavored aerosol precursor in the liquid transfer element 315-3 is depleted in use, further flavored aerosol precursor is drawn from the storage chamber 316-3 into the liquid transfer element 315-3 via a wicking action.

Before activation, the storage chamber 316-3 is fluidly isolated from the liquid transfer element 315-3. In this example, the isolation is achieved via a plug 320-3 (preferably formed from silicone) located at one end of a conduit 324-3 surrounding the liquid transfer element 315-3. In other examples, the plug may be replaced by any one of: a duck bill valve; a split valve or diaphragm; or a sheet of foil. The storage chamber 316-3 further includes an air bleed channel 332-3, which in the deactivated state is sealed by a pierceable membrane (preferably made from foil). Activation (or piercing) member 330-3, which projects inwardly from the mouthpiece 309-3, and may take the form of a blade, pierces the pierceable membrane and opens the air bleed channel 332-3 when the consumable is moved to the activated state (as is discussed in more detail below). The aerosol generating portion 322-3 is located within the vapor flow passage 321-3 that extends through the flavor pod portion 302-3. The aerosol generating portion 322-3, by occupying a portion of the vapor flow passage 321-3, constricts or narrows the vapor flow passage 321-3. This constricted or narrowed portion of the vapor flow passage 321-3 defines an aerosolization chamber 319-3 of the consumable 303-3. The aerosolization chamber 319-3, which is adjacent the aerosol generating portion 322-3, is the narrowest portion of the vapor flow passage 321-3. The constriction of the vapor flow passage 321-3 at the aerosolization chamber 319-3 results in increased air velocity and a corresponding reduction in air pressure of the air flowing therethrough and thus may be referred to as a Venturi aperture. The aerosolization chamber 319-3 is generally toroidal in shape (extending circumferentially about the aerosol generating portion 322-3), but this toroidal shape may include one or more interruptions where supports extend inwardly to contact the aerosol generating portion 322-3 and to support the aerosol generating portion 322-3 within the aerosolization chamber 319-3. The cartomizer portion 301-3 of the consumable 303-3 includes a reservoir 305-3 (defined by a container) for storing an e-liquid aerosol precursor (which may contain nicotine). A wick 311-3 extends into the reservoir so as to be in contact with (i.e., partially submerged in) the e-liquid aerosol precursor. The wick 311-3 is formed from a porous wicking material (e.g., a polymer) that draws the e-liquid aerosol precursor from the reservoir 305-3 into a central region of the wick 311-3 that is located in the vaporizing chamber 325-3. A heater 314-3 is a configured to heat the central region of the wick 311-3. The heater 314-3 includes a resistive heating filament that is coiled around the central region of the wick 311-3. The wick 311-3 and the heater 314-3 generally define a vaporizer, and together with the reservoir 305-3 act as an active aerosol generator. The vaporizer (i.e., wick 311-3 and heater 314-3) and aerosol generating portion 322-3 are both at least partially located within the airflow passage, with the aerosol generating portion 322-3 being downstream of the vaporizer.

So that the consumable 303-3 may be supplied with electrical power for activation of the heater 314-3, the consumable 303-3 includes a pair of consumable electrical contacts 313-3. The consumable electrical contacts 313-3 are configured for electrical connection to a corresponding pair of electrical supply contacts in the base unit (not shown). The consumable electrical contacts 313-3 are electrically connected to the electrical supply contacts (not shown) when the consumable 303-3 is engaged with the base unit. The base unit includes an electrical power source, for example a battery.

Figure 14B:
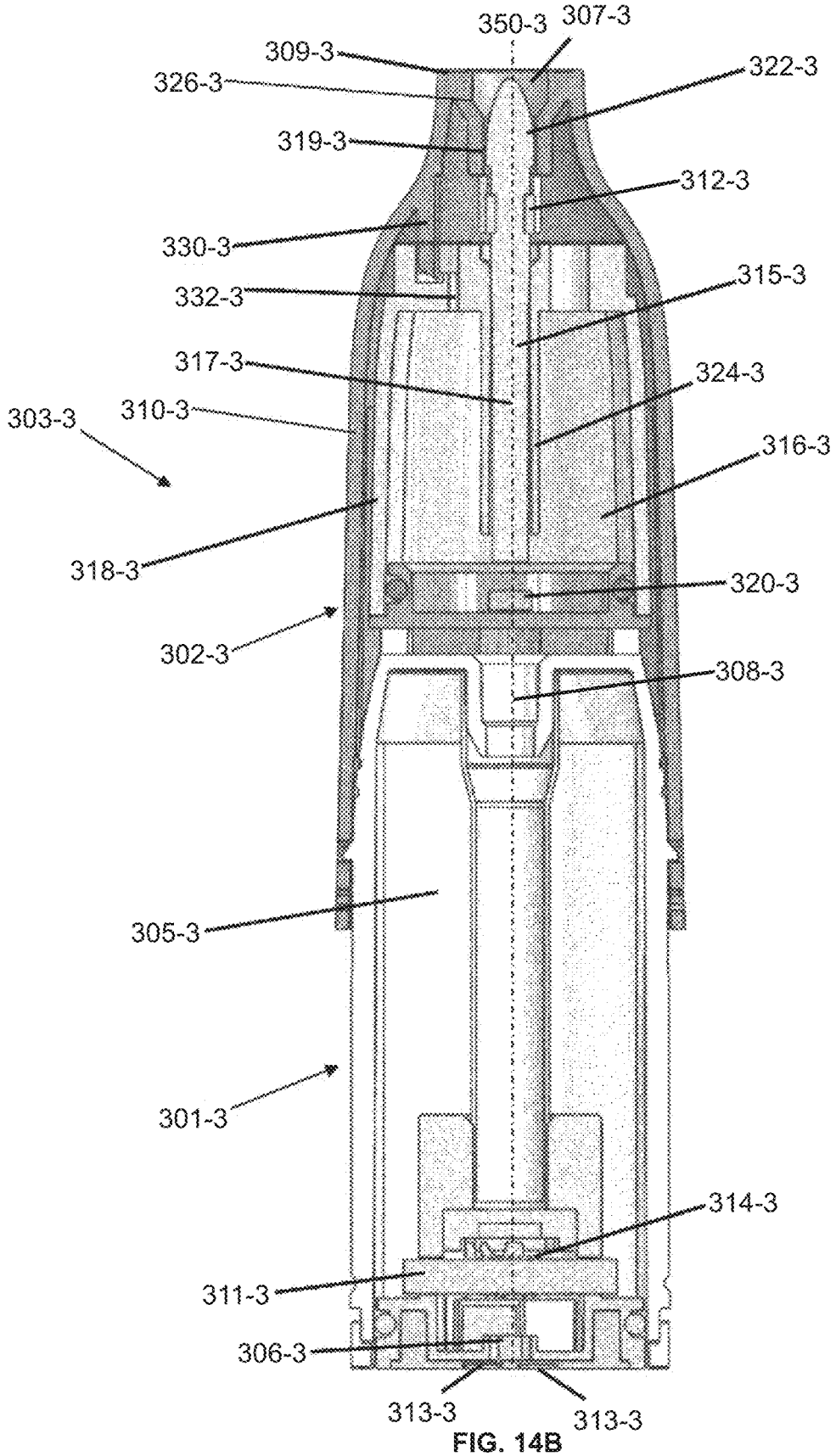
FIG. 14B is a cross-sectional view of the consumable of FIG. 14A in an activated state.

FIG. 14B shows the consumable 303-3 of FIG. 14A in an activated state. To transition from the deactivated state to the activated state, mouthpiece 309-3 is moved along a central longitudinal axis 350-3 in an upstream direction towards cartomizer portion 301-3. The mouthpiece 309-3 is fixed by a collar 312-3 to the conveying portion 317-3 of the liquid transfer element 315-3 and therefore liquid transfer element 315-3 moves with the mouthpiece 309-3. The mouthpiece 309-3 and liquid transfer element 315-3 are moved relative to the tank 318-3.

When the mouthpiece 309-3 is moved upstream, activation/piercing member 330-3 contacts and pierces a sealing element in the form of a pierceable membrane extending across the air bleed channel 332-3 thereby fluidly connecting the vapor flow passage 321-3 the storage chamber 316-3. This allows air from the vapor flow passage 321-3 to enter the storage chamber 316-3 as aerosol precursor is removed from the storage chamber 316-3 by the liquid transfer element 315-3.

In addition to piercing of the membrane by the piercing member 330-3, liquid transfer element 315-3 pushes on, and moves, plug 320-3 out of the conduit 324-3 which then allows liquid transfer element 315-3 to come into contact with the first aerosol precursor stored in the storage chamber 316-3. The plug 320-3 may then be unconstrained within the storage chamber, or may be pushed by liquid transfer element 315-3 into a holding location.

Once activated, and in use, a user draws (or "sucks", "pulls", or "puffs") on the mouthpiece 309-3 of the consumable 303-3, which causes a drop in air pressure at the mouthpiece aperture 307-3, thereby generating air flow through the inlet opening 306-3, along the airflow passage through the device, out of the mouthpiece aperture 307-3 and into the user's mouth. When the heater 314-3 is activated by passing an electric current through the heating filament in response to the user drawing on the mouthpiece 309-3 (the drawing of air may be detected by a pressure transducer), the e-liquid located in the wick 311-3 adjacent to the heating filament is heated and vaporized to form a vapor in the vaporizing chamber 325-3. The vapor condenses to form the e-liquid aerosol within the vaporizer outlet 323-3. The e-liquid aerosol is entrained in an airflow along the vapor flow passage 321-3 to the mouthpiece aperture 307-3 for inhalation by the user when the user draws on the mouthpiece 309-3.

The base unit supplies electrical current to the consumable electrical contacts (not shown). This causes an electric current flow through the heating filament of the heater 314-3 and the heating filament heats up. As described, the heating of the heating filament causes vaporization of the e-liquid in the wick 311-3 to form the e-liquid aerosol.

As the air flows through the vapor flow passage 321-3, it encounters the aerosol generating portion 322-3. The constriction of the vapor flow passage 321-3, at the aerosolization chamber 319-3, results in an increase in air velocity and corresponding decrease in air pressure in the airflow in the vicinity of the porous aerosol generating portion 322-3. The corresponding low pressure and high air velocity region causes the generation of the flavored aerosol from the porous surface of the aerosol generating portion 322-3 of the liquid transfer element 315-3. The flavored aerosol becomes entrained in the airflow and ultimately is output from the mouthpiece aperture 307-3 of the consumable 303-3 and into the user's mouth.

The flavored aerosol is sized to inhibit pulmonary penetration. The flavored aerosol is formed of particles with a mass median aerodynamic diameter that is greater than 70 microns. The flavored aerosol is sized for transmission within at least one of a mammalian oral cavity and a mammalian nasal cavity. The flavored aerosol is formed by particles having a maximum mass median aerodynamic diameter that is less than 100 microns. Such a range of mass median aerodynamic diameter will produce aerosols which are sufficiently small to be entrained in an airflow caused by a user drawing air through the device and to enter and extend through the oral and or nasal cavity to activate the taste and/or olfactory receptors.

The e-liquid aerosol generated is sized for pulmonary penetration (i.e., to deliver an active ingredient such as nicotine to the user's lungs). The e-liquid aerosol is formed of particles having a mass median aerodynamic diameter of less than 1 micron. Such sized aerosols tend to penetrate into a human user's pulmonary system, with smaller aerosols generally penetrating the lungs more easily. The e-liquid aerosol may also be referred to as a vapor.

The size of aerosol formed without heating is typically smaller than that formed by condensation of a vapor.

Figure 14C:
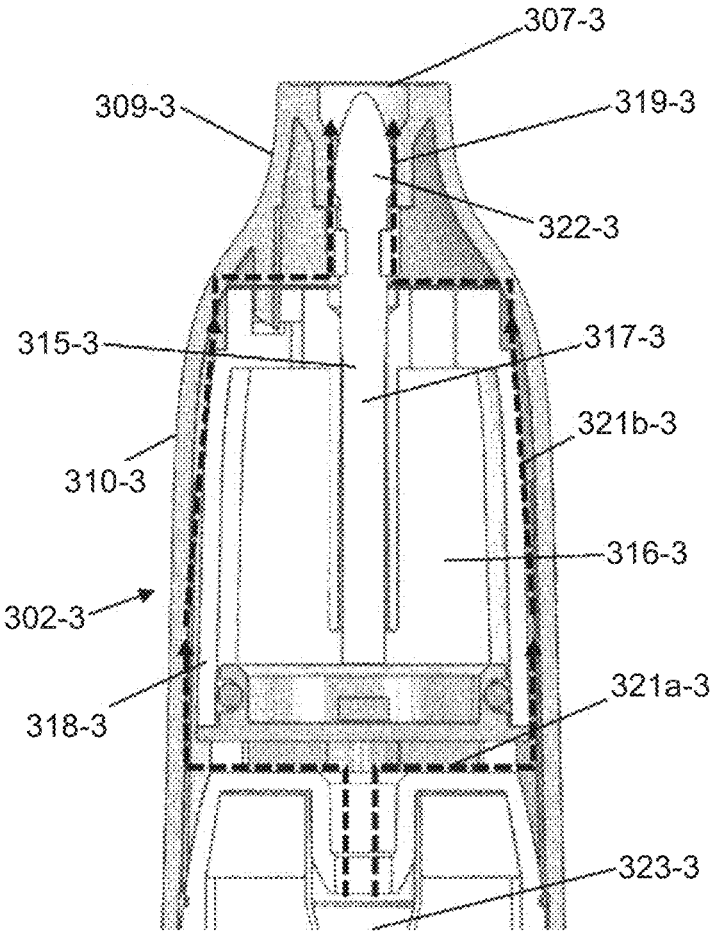
FIG. 14C is a cross-sectional schematic view of the flavor pod portion of the consumable of the third embodiment of the third mode.

FIG. 14C illustrates the flow of vapor through the flavor pod portion 302-3 of FIG. 14A and FIG. 14B. The flavor pod portion 302-3 is shown in the activated state. The cartomizer is not shown, but it should be appreciated that the flavor pod portions 302-3 is engaged with the cartomizer 301-3 of FIG. 14A and FIG. 14B. In other embodiments, however, the consumable 303-3 may not comprise a cartomizer portion, and may provide only flavor to the user.

As is provided above, the flavor pod portion 302-3 comprises an upstream (i.e., upstream with respect to flow of air in use) vapor passage inlet 304-3 (in fluid communication with the vapor outlet 323-3) and a downstream (i.e., downstream with respect to flow of air in use) outlet in the form of a mouthpiece aperture 307-3. Between, and fluidly connecting the vapor passage inlet 304-3 and the mouthpiece aperture 307-3, is a vapor flow passage 321-3.

The vapor flow passage 321-3 comprises a transverse portion **321*a*-3. The airflow path through the device deflects at the vapor passage inlet 304-3, i.e., there is a deflection between the vapor outlet 323-3 and the transverse portion 321*a*-3 of the vapor flow passage 321-3**.

The vapor flow passage 321-3 then deflects again from the transverse portion **321*a*-3 to a longitudinal portion 321*b*-3 which extends generally longitudinally in the spacing between a device housing 310-3 (which is integral with the mouthpiece 309-3) and the tank 318-3. The vapor flow passage deflects again at the upper surface of the tank 318-3 within the mouthpiece 309-3 proximal the liquid transverse element, through the aerosolization chamber 319-3, towards the mouthpiece aperture 307-3**.

The vapor flow passage 321-3 may be a single (annular) flow passage around the tank 318-3 or it may comprise two branches which split around the tank 318-3 and re-join within the mouthpiece 309-3 (proximal the liquid transverse element).

A transition surface 326-3, between the aerosolization chamber 319-3 and the mouthpiece aperture 307-3 flares outwardly in the downstream direction, such that a diameter of the mouthpiece aperture 307-3 is greater than a diameter of the aerosolization chamber 319-3. In use, when a user draws on the mouthpiece 309-3, air flow is generated through the air flow passage through the device. Air (comprising the e-liquid aerosol from the cartomizer portion 301-3 as explained above with respect to FIG. 14A) flows through the vapor outlet 323-3 and into the vapor passage 321-3. Further downstream, as air flows past the aerosol generating portion 322-3 in the aerosolization chamber 319-3, the velocity of the air increases, resulting in a drop in air pressure. As a result, the flavored aerosol precursor held in the aerosol generating portion 322-3 becomes entrained in the air so as to form the flavored aerosol. The flavored aerosol has the particle size and other properties described above with respect to FIG. 14A.

As the flavored aerosol precursor becomes entrained within the air, the liquid transfer element 315-3 transfers further flavored aerosol precursor from the storage chamber 316-3 to the aerosol generating portion 322-3. More specifically, the liquid transfer element wicks the flavored aerosol precursor from the storage chamber 316-3 to the aerosol generating portion 322-3.

Figure 14D:
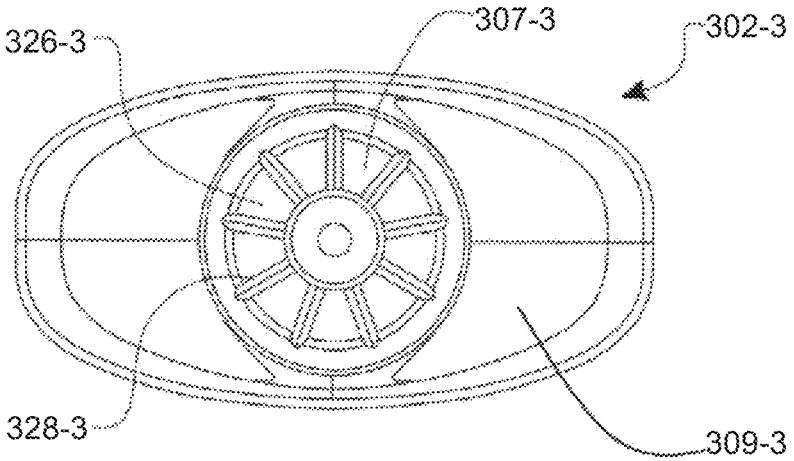
FIG. 14D and FIG. 14E are respective top and perspective views of a mouthpiece of the third embodiment of the third mode.
Figure 14E:
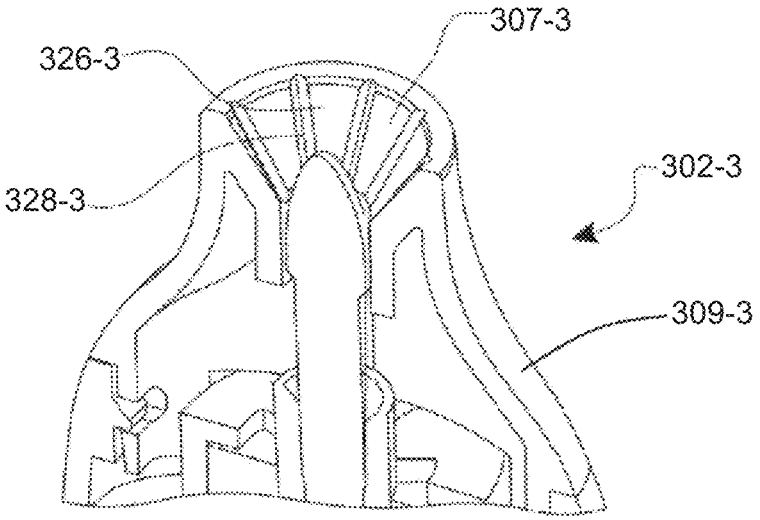

FIG. 14D and FIG. 14E show further views of the flavor pod portion 302-3 which highlight features of the mouthpiece 309-3. Many of the reference numerals of FIG. 14C are omitted from FIG. 14D and FIG. 14E for clarity.

An uneven inner (transition) surface 326-3 is located between the mouthpiece aperture 307-3 and the aerosolization chamber 319-3. In the present example, the inner surface 326-3 has the form of a substantially frustoconical surface, but includes grooves or channels 328-3 to make the inner surface 326-3 somewhat uneven. In other examples, the inner surface 326-3 may have another form (for example, the form a substantially cylindrical surface), and may include any type of protrusion or groove to make the inner surface uneven. The inner surface 326-3 is angled with respect to an axial direction (i.e., relative to a central axis extending from a base of the consumable to the mouthpiece) such that the diameter of the passage 321-3 proximate the mouthpiece aperture 307-3 increases in the downstream direction. The inner surface 326-3 is downstream of the aerosolization chamber 319-3 of the vapor flow passage 321-3.

The grooves 328-3 are generally V-shaped in cross-sectional profile, and extend in the axial direction for the full length of the inner surface 326-3. Each groove 328-3 is formed from a pair of surfaces angled at between 30 and 90 degrees (e.g., 60 degrees) relative to each other. The grooves 328-3 have a depth (measured normal to the inner surface 326-3) of at least 0.2 mm (e.g., at least 0.4 mm). The grooves 328-3 have a depth of less than 0.8 mm (e.g., less than 0.6 mm). The grooves have a depth of substantially 0.5 mm. The inner surface 326-3 comprises 9 grooves 328-3, but may comprise more or less grooves. The grooves 328-3 are spaced apart from each other by substantially 1 mm at the downstream end of the inner surface 326-3. In other examples, the spacing at the downstream end of grooves or protrusions may be selected such that it is equal to or less than the mass median diameter (as described above) of particles in the first aerosol.

The inner surface 326-3 comprises a smooth polished surface between the grooves 328-3. Polishing the surface in this way may provide improved aerodynamic properties. However, in other examples, the inner surface 426-3 may be textured. In such examples, the texture of the surface may provide the uneven surface, and no grooves may be required.

In use, the uneven nature of the inner surface 326-3 may make it easier for droplets to form on the inner surface 326-3, preventing large droplets from entering the user's mouth. The grooves 328-3 may help to channel the large droplets back into the consumable.

Although not shown in FIG. 14A, FIG. 14B, and FIG. 14C, the device includes an absorbent pad 412-3 interposed between the cartomizer portion 301-3 and the flavor pod portion 302-3. Such a pad is described below in more detail in relation to FIG. 15A, FIG. 15B, and FIG. 16.

Figure 15A:
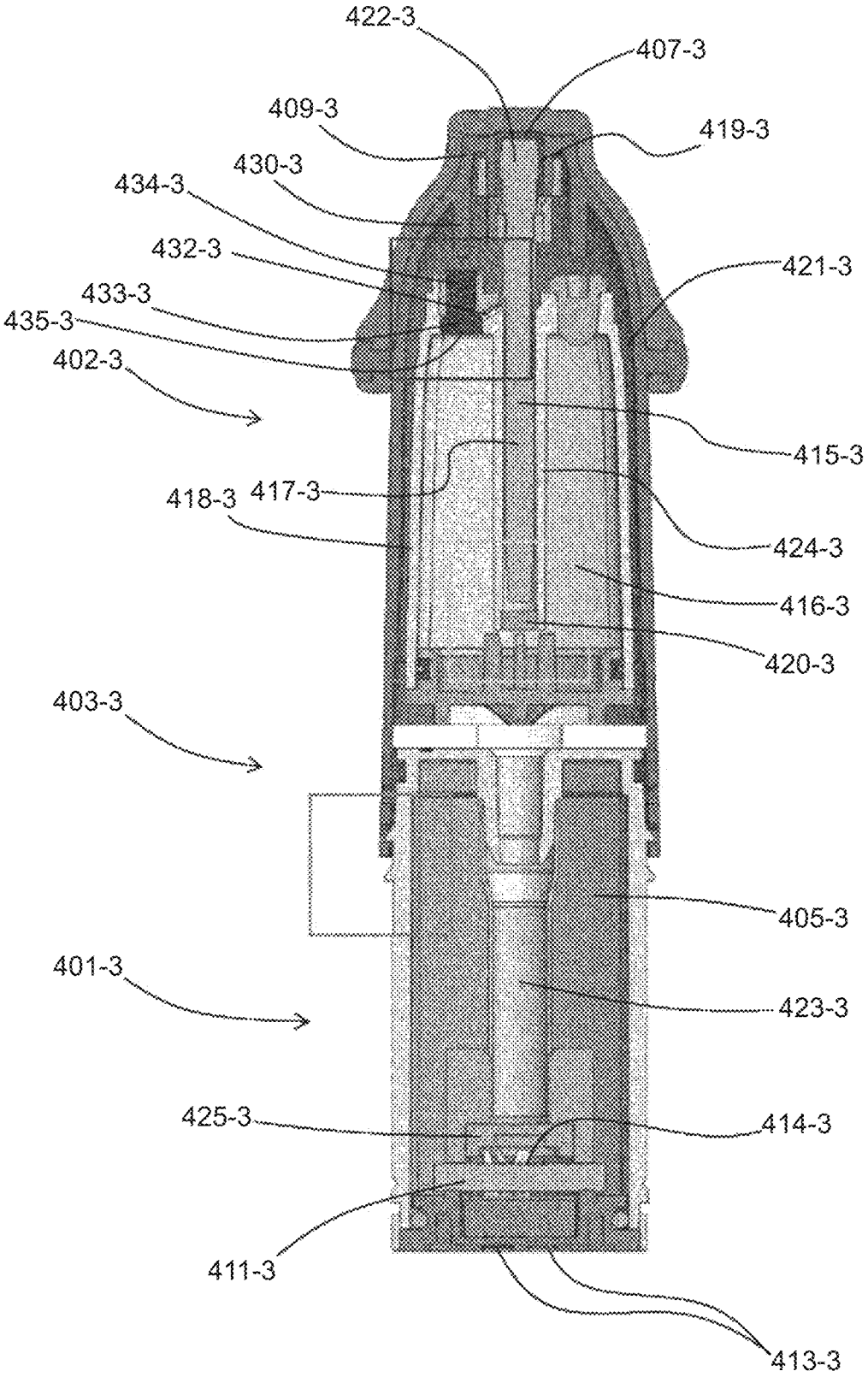
FIG. 15A is a cross-sectional view of a consumable according to a fourth embodiment of the third mode in a deactivated state.
Figure 15B:
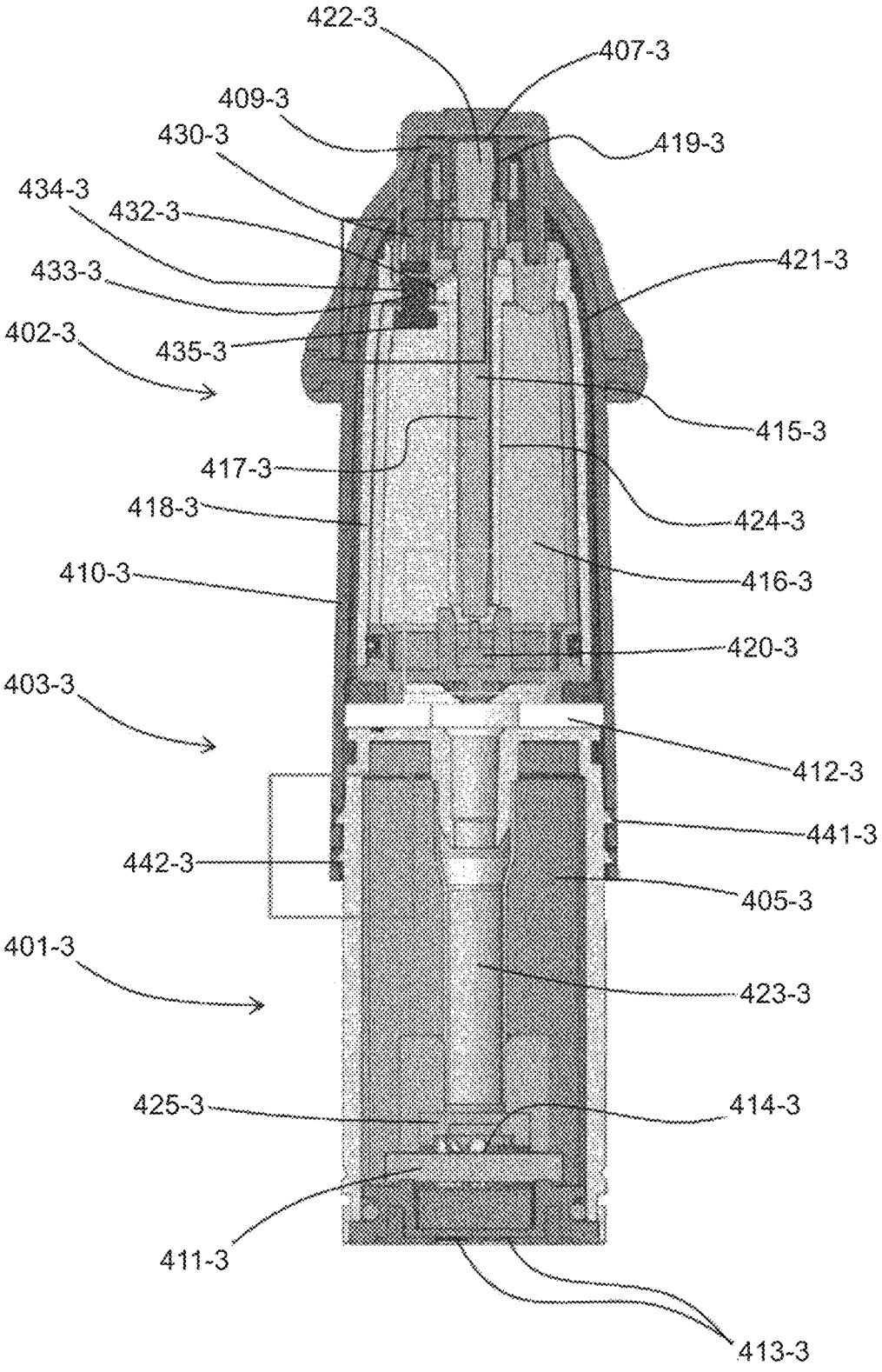
FIG. 15B is a cross-sectional view of a consumable according to the fourth embodiment of the third mode in an activated state.

FIG. 15A and FIG. 15B illustrate a consumable 404-3 of an aerosol delivery device, according to a fourth embodiment of the third mode. This embodiment includes many of the same features of the embodiment described above and shown in FIG. 14A to FIG. 14E and, for that reason, corresponding reference numerals have been used (albeit with a unit increase of the first digit to represent the further embodiment). The description of those features has not been repeated here. FIG. 15A shows the consumable 404-3 in a deactivated state and FIG. 15B shows the consumable 404-3 in an activated state.

Unlike the previously described embodiment, the presently illustrated embodiment comprises a different mechanism for opening the air bleed channel 432-3 upon activation of the consumable 403-3. In this embodiment, when in the deactivated state (FIG. 15A) the air bleed channel 432-3 is obstructed by a silicone bung 433-3 sealing element received in the air bleed channel 432-3. In particular, a body 434-3 of the bung 433-3 is received in the air bleed channel 432-3, but does not fully obstruct the air bleed channel 432-3. That is, a portion of the air bleed channel 432-3 remains unobstructed by the body 434-3 of the bung 433-3. However, an enlarged head 435-3 of the bung 433-3, which is located in the storage chamber 416-3, extends fully across the entrance to the air bleed channel 432-3 so as to obstruct the channel 432-3.

When the mouthpiece 409-3 is moved in the upstream longitudinal direction to activate the consumable 403-3, an elongate activation member (extending inwardly from the mouthpiece 409-3) engages the body 434-3 of the bung 433-3 and pushes the bung 433-3 in the upstream direction (see FIG. 15B). This moves the enlarged head 435-3 of the bung 433-3 away from the entrance of the air bleed channel 432-3 such that the head 435-3 no longer obstructs the air bleed channel 432-3. This allows air to pass from the vapor flow passage 421-3 and into the storage chamber 416-3 (which, in turn, allows for flow of the first aerosol precursor from the storage chamber 416-3).

It should be noted that the bung sealing element shown in FIG. 15A and FIG. 15B could be used in place of the pierceable membrane in FIG. 14A and FIG. 14B and vice versa.

The aerosol generating portion 422-3 of the liquid transfer element shown in the FIG. 15A and FIG. 15B has a flattened upper (downstream) surface. Such a liquid transfer element could be used in the embodiment shown in FIG. 14A and FIG. 14B.

The device comprises an absorbent pad 412-3 interposed between the cartomizer portion 401-3 and the flavor pod 402-3. The pad 412-3 extends transversely across the width of the device perpendicular of the longitudinal axis of the device and perpendicular to the vapor outlet 423-3. The pad 412-3 is positioned proximal (downstream) of a deflection in the airflow path between the vapor outlet 423-3 and the transverse portion of the vapor passage.

Figure 16:
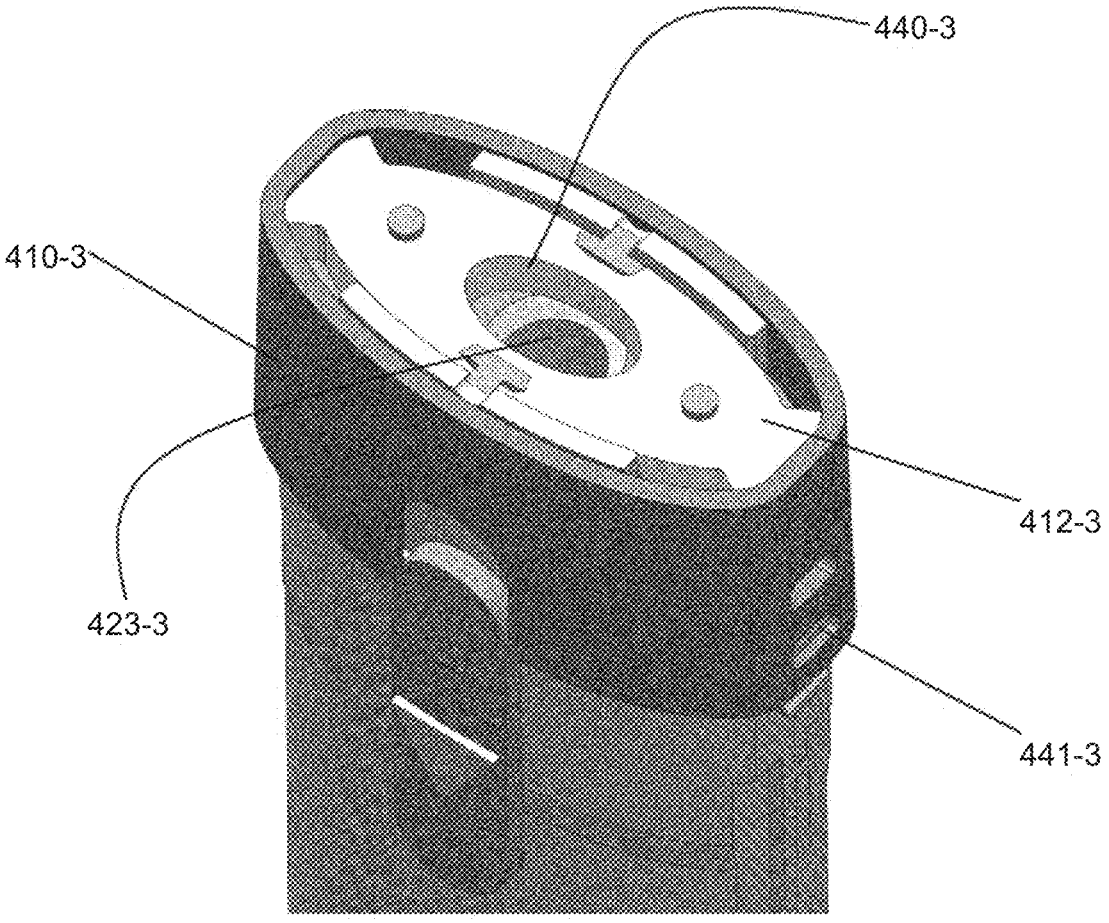
FIG. 16 shows an absorbent pad.

As can be seen from FIG. 16 (in which the flavor pod has been removed and the device housing 410-3 cut down), the pad 412-3 comprises an axial aperture 440-3 which is substantially aligned with the vapor outlet 423-3 so that vapor generated in the vaporizing chamber 425-3 can pass along the vapor outlet 423-3 and to the vapor flow passage 421-3 through the aperture 440-3.

It will be appreciated that the flow in the transverse portion of the vapor passage (not shown) will pass over the absorbent pad 412-3 (between the cartomizer portion 401-3 and the flavor pod 402-3) such that any condensate forming within the transverse portion of the vapor flow passage will be collected and retained within the absorbent pad. This will prevent leakage of any condensate, e.g., through the apertures 441-3 provided in the device housing 410-3 for cooperation with lugs 442-3 on the cartomizer 401-3 for retaining the device housing 410-3 in place on the cartomizer 401-3.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the scope of the disclosure as defined in the claims.

For the avoidance of any doubt, any theoretical explanations provided herein are provided for the purposes of improving the understanding of a reader. The inventors do not wish to be bound by any of these theoretical explanations. Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. An aerosol delivery device, comprising:

a storage for storing aerosol precursor liquid, the storage comprising an air bleed channel for permitting air to enter the storage as the storage empties of aerosol precursor liquid in use;

an aerosol generator for generating an aerosol from the aerosol precursor liquid for inhalation by a user; and a liquid transfer element for transferring the aerosol precursor liquid from the storage to the aerosol generator, wherein the air bleed channel and the liquid transfer element are configured such that the aerosol precursor liquid from the liquid transfer element forms an obstruction in the air bleed channel in use to reduce flow through the air bleed channel, and the aerosol delivery device is further configured such that the obstruction is removed to open the air bleed channel in response to the user drawing on the aerosol delivery device by causing the aerosol precursor liquid in the liquid transfer element to reduce and the obstruction to be pulled from the air bleed channel into the storage to open the air bleed channel.

2. An aerosol delivery device according to claim 1, wherein an external opening of the air bleed channel is located adjacent to the liquid transfer element and wherein the liquid transfer element defines a portion of the air bleed channel.

3. An aerosol delivery device according to claim 1, wherein the air bleed channel follows a tortuous path.

4. An aerosol delivery device according to claim 1, and further comprising a sealing element for inhibiting flow through the air bleed channel when the sealing element is in a deactivated state, wherein the sealing element is openable into an activated state to permit air flow through the air bleed channel when the obstruction is removed from the air bleed channel.

5. An aerosol delivery device according to claim 1, and further comprising a barrier arrangement for inhibiting flow of the aerosol precursor liquid from the storage to the liquid transfer element, wherein the barrier arrangement is openable so that the liquid transfer element can receive the aerosol precursor liquid from the storage and wherein the liquid transfer element is movable to contact the barrier arrangement to open the barrier arrangement.

6. An aerosol delivery device for delivering an aerosol for inhalation by a user, comprising:

a storage tank defining a storage chamber for storing a liquid aerosol precursor;

a porous liquid transfer element for transferring the liquid aerosol precursor from the storage chamber to an aerosolization chamber in an activated state of the aerosol delivery device;

an air bleed channel configured to allow bleeding of air into the storage chamber of the storage tank to replace the liquid aerosol precursor as it is transferred by the porous liquid transfer element in the activated state of the aerosol delivery device; and a sealing element for sealing the air bleed channel in a deactivated state of the aerosol delivery device, wherein the device further comprises first and second activation members extending from an inner surface of a terminal element, wherein, in a first orientation of the terminal element, the first activation member is longitudinally aligned with the sealing element configured to engage the sealing element to provide the activated state of the aerosol delivery device, and wherein, in a second orientation of the terminal element, the second activation member is longitudinally aligned with the sealing element configured to engage the sealing element to provide the activated state of the aerosol delivery device.

7. An aerosol delivery device according to claim 6, wherein the terminal element is rotated by 180 degrees between the first and second orientations.

8. An aerosol delivery device according to claim 6, wherein the storage tank further comprises a filling port and, wherein, in the first orientation of the terminal element, the second activation member is longitudinally aligned with the filling port and wherein, in the second orientation of the terminal element, the first activation member is longitudinally aligned with the filling port.

9. An aerosol delivery device according to claim 6, wherein the porous liquid transfer element is interposed between the first and second activation members.

10. An aerosol delivery device according to claim 6, wherein the porous liquid transfer element is an elongate, liquid transfer element extending longitudinally along a longitudinal axis of the aerosol delivery device and the first and second activation members extend parallel to the liquid transfer element and parallel to the longitudinal axis of the aerosol delivery device.

11. An aerosol delivery device according to claim 6, comprising a flow passage extending between an upstream flow passage inlet to a downstream mouthpiece aperture on a mouthpiece portion of the terminal element, wherein the first and second activation members extend from an inner surface of the terminal element within the mouthpiece portion on opposing lateral and/or transverse sides of the downstream mouthpiece aperture.

* * * * *